US006455235B1

(12) United States Patent
Kokeguchi et al.

(10) Patent No.: US 6,455,235 B1
(45) Date of Patent: Sep. 24, 2002

(54) PHOTOGRAPHIC PROCESSING ELEMENT AND IMAGE FORMING METHOD BY THE USE THEREOF

(75) Inventors: Noriyuki Kokeguchi; Hiromichi Mizukami; Yoshihiko Suda, all of Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/732,659

(22) Filed: Dec. 8, 2000

(30) Foreign Application Priority Data

| | | |
|---|---|---|
| Dec. 17, 1999 | (JP) | 11-358973 |
| Mar. 10, 2000 | (JP) | 2000-066784 |
| May 30, 2000 | (JP) | 2000-160129 |
| Oct. 12, 2000 | (JP) | 2000-312253 |

(51) Int. Cl.[7] ..... G03C 7/305; G03C 7/32; G03C 7/413; G03C 7/407; G03C 7/42

(52) U.S. Cl. ..... 430/351; 430/376; 430/380; 430/404; 430/457; 430/467; 430/959

(58) Field of Search ..... 430/404, 351, 430/380, 206, 959, 467, 457, 376

(56) References Cited

U.S. PATENT DOCUMENTS

| | | | | | |
|---|---|---|---|---|---|
| 3,179,517 | A | * | 4/1965 | Tregillus et al. | 430/404 |
| 3,342,599 | A | * | 9/1967 | Reeves | 430/380 |
| 3,576,632 | A | * | 4/1971 | Bornemisza | 430/404 |
| 3,719,492 | A | * | 3/1973 | Barr et al. | 430/959 |
| 4,157,915 | A | * | 6/1979 | Hamaoka et al. | 430/959 |
| 5,965,332 | A | | 10/1999 | Kikuchi | 430/351 |
| 6,306,551 | B1 | * | 10/2001 | Owczarcz et al. | 430/404 |
| 6,309,810 | B1 | * | 10/2001 | Sawinski et al. | 430/404 |
| 6,319,173 | B1 | * | 11/2001 | Irving et al. | 430/404 |

FOREIGN PATENT DOCUMENTS

| | | |
|---|---|---|
| EP | 0 120 403 A2 | 10/1984 |
| EP | 0 123 908 A2 | 11/1984 |
| JP | 2-282241 | 11/1990 |
| JP | 11-184051 | 7/1999 |

OTHER PUBLICATIONS

Derwent Abst. of Japanese 11/184051, Konica Co., Jul. 1999.*

JPAB Abstr. of JP 11/184051, Konica Co., Jul. 1999.*

* cited by examiner

*Primary Examiner*—Richard L. Schilling
(74) *Attorney, Agent, or Firm*—Frishauf, Holtz, Goodman & Chick, P.C.

(57) ABSTRACT

A photographic processing element is disclosed, comprising a color developing agent or its precursor. The element further comprises a base or its precursor. An image forming method is also disclosed, comprising superposing a processing element comprising a color developing agent or its precursor on an exposed silver halide photographic material to perform development of the photographic material to form an image.

44 Claims, No Drawings

PHOTOGRAPHIC PROCESSING ELEMENT AND IMAGE FORMING METHOD BY THE USE THEREOF

FIELD OF THE INVENTION

The present invention relates to a photographic processing element used for developing silver halide photographic light sensitive materials and an image forming method and image information preparation method by the use of the processing element.

BACKGROUND OF THE INVENTION

Silver halide photographic light sensitive materials (hereinafter, also denoted as photographic light sensitive materials or photographic materials) are now broadly used due to their high sensitivity, superior gradation and superior characteristic compared to other photosensitive materials. Specifically, silver halide photographic light sensitive materials are recognized in the market to be a recording material which is superior in recording, enjoyment and storage of image information, in terms of its low cost, superior image quality and superior image storage stability.

Recently, a popular embodiment of preparing color prints is that photographed color films are processed in photofinishing laboratories, in which images obtained in a color film are printed on color paper to obtain color prints.

The photofinishing time of from the time the lab receives a photographed color film from a customer to the time color prints are available to the customer is about one hour in a mini-lab having a relatively compact processor. However, such a time is rather long for a customer who requests development and prints while waiting for them in the store. It is difficult to further shorten the finishing time to a level of completion of photofinishing during the typical time customers remain in a store, while such shortening of the finishing time is also strongly desired. Of the time to produce final prints, the processing time of a color film accounts for a large portion of the total working time, so that shortening the processing time of a color film is strongly desired.

Recently, so-called lens-fitted film units are popular for picture-taking, which are commercially available in the form of loading a silver halide photographic material into a plastic resin camera fitted with a fixed focus lens. This releases users from troublesome film-loading of the camera and failures due to film-loading mistakes, resulting in an increase of photo-shooting chance due to its simplicity.

The lens-fitted film unit is a camera-use unit in which a photographic material has been loaded by the maker. The user uses the loaded photographic material for picture-taking and the lens-fitted film unit, after completion of picture-taking, is sent to a processing lab in the form with the photographic material still being loaded, so that a camera of an extremely simple structure is available at a relatively low price.

The foregoing system is a broadly popular one at present and requirement for further enhanced convenience thereof becomes stronger. Desired improvements include, for example, (1) reduced amounts of processing solutions to be used in color development, bleaching and fixing of photographic materials and a more simplified apparatus, and space-saving thereof (2) reduction or elimination of compounds such as a color developing agent or an iron-chelate compound in processing solutions, which are limited in discharging to the natural environment, and (3) enhancement of the processing speed.

As a means for overcoming the foregoing problems, a color image forming method is proposed in JP-A 11-52526 (hereinafter, the term, JP-A refers to an unexamined, published Japanese Patent Application), in which some of the processing steps of color films are omitted so that image information is directly read from developed images and transformed to an optical or electrical digital information, which is further transformed to image characteristic values obtained through the standard process of color photographic materials to form color images. Such a technique achieved an improvement in terms of time-shortening.

However, the processing apparatus, although relatively compact, still occupies a space in the typically small store and load in exchange of processing solution still is a burden for the mini-lab so that development of a space-saving apparatus or a easier maintenance system is strongly desired.

JP-A 10-260518 discloses an image forming method in which a photosensitive member containing silver halide, a coupler and a color developing agent, is superimposed onto a processing element containing a base or its precursor and is then heated to form images. Although such a technique was expected to meet the foregoing requirement, there were problems that the disclosed silver halide photographic material was inferior in layer strength and storage stability of performance over a long period of time. Such characteristics are supposed to be due to the developing agent being contained in the silver halide photographic member.

Pictrography system is provided by Fuji Photo Film Co., Ltd., in which a small amount of water is provided onto a photosensitive member, which is laminated with an image receiving member containing a base precursor and heated to cause a development reaction. In this system, processing without using a bath is advantageous for the environment and released dye is diffusion-transferred to a dye-fixing layer to be fixed to form a dye image. However, since the color photographic material used in this system contains a colored dye-providing material, making difficult to achieve a sufficient speed for use as a camera material. Further, image quality required as a camera material used for enlarging can be achieved due to bleeding of a dye image caused in diffusion transfer, which causes no problem in viewing. Accordingly, development of a system which can be employed as a recording material for camera use is desired.

A series of processing systems proposed in JP-A 10-260518 and Pictorography system, to which commercially available conventional silver halide color photographic materials containing no developing agent cannot be applied, are deficient in universal applicability.

In general, conventional silver halide color photographic materials, after exposure, are subjected to liquid development using a developer solution containing a developing agent to form silver and/or dye images upon reaction of a coupler with an oxidization product of the developing agent after reduction of silver ions. Such a developer solution is usually an aqueous alkaline solution to enhance developing activity. The trade-off for the increase in pH to enhance the developing activity is the decrease in storage stability of a developing agent in the developer solution. The use of a large amount of a developer solution and sufficient replenishment thereof do not produce any problem, however, in cases when the processing frequency or the processing amount is relatively small, troublesome solution-exchanging work is needed to maintain process stability, due to relatively short life of the developer solution.

To minimize the foregoing disadvantages, it is effective to remove a developing agent unstable to an alkali or to remove an alkaline agent. Examples thereof include a technique of occluding a developing agent into a silver halide photographic material. However, p-phenylenediamines included in the photographic material are subject to aerial oxidation which cause brown staining or cause fogging of silver halide to form a dye upon reaction with a coupler present in the photographic material, leading to overall deteriorated photographic performance. Alternatively, occlusion of a precursor of a developing agent which is stable relative to the developing agent is known. Examples of p-phenylenediamine precursors include compounds described in JP-A Nos. 6-347963, 58-192031 and 56-6235 and U.S. Pat. No. 4,060,418. However, even if such compounds are employed, deterioration in photographic performance during storage can be avoided, resulting in marked fogging of the photographic material.

There is also disclosed a photographic material including a color developing agent containing hydrazine, sulfonamidophenol or sulfonamidoaniline within its molecular structure formula, as described as a relatively stable color developing agent in JP-A Nos. 11-167179, 11-184056 and 11-202458. As a result of the inventors' study thereof, it was proved that even when such a compound was employed, raw stock stability was not sufficient, leading to defects that process variation between before and after storage was large, resulting in heavy fogging and incorporation in the form of an oil dispersion leading to an increase in layer thickness, deteriorating physical properties and image sharpness.

Such a photographic material often contains a sparingly water-soluble metal compound such as zinc hydroxide. Although an alkali can be advantageously removed from the developer solution by the use of the foregoing alkali-generating system, such kind of a metal oxide or metal hydroxide often exhibits amphoterism and the stable precipitation region is in the vicinity of the neutral region. From the relationship of precipitation equilibrium, it is in principle difficult to lower the layer pH of the photographic material to 7 or less so that the photographic material has to be designed at a relatively high pH, leading to defects such as silver halide being easily fogged during storage. JP-A Nos. 8-179458 and 9-106057 disclose a monochromatic photothermographic materials employing silver images but even in this case, similar problems are encountered. In addition, incorporation of a large amount of the metal oxide or hydroxide results in an increase of haze, leading to deteriorated photographic performance such as image sharpness.

In view of the foregoing, it is desired to develop a color forming system in which a developing agent or an alkali can be removed from the photographic material or developer solution and which as a result exhibits high color formation and superior storage stability.

SUMMARY OF THE INVENTION

The present invention was achieved in response to the foregoing problems and therefore, it is an object of the invention to provide an image forming method whereby silver halide photographic materials including commercially available photographic films such as 135 film and APS film can be simply and rapidly processed in a smaller space, enabling stable processing of the silver halide photographic material and providing photographs superior in performance; an image information preparing method by the use of the image forming method, and a processing element for use therein.

Concretely, the present invention accomplishes at least one of the following objects.

It is a first object of the invention to provide an image forming method enabling rapid development without allowing a developing agent to be contained in a developing solution or without using a developing solution at all and achieving low fogging and high sensitivity, and to provide a processing element which are superior in storage stability over an extended period of time.

It is a second object of the invention to provide a processing element used for silver halide photographic materials which is a system of a space-saving apparatus and provides easy maintenance as well as a system for finishing prints while a customer remains in the store and one which is universally applicable, exhibits little deteriorating storage stability of photographic materials and exhibiting little staining due to the developing agent after processing, and an image forming method by the use thereof.

It is a third object of the invention to provide an image forming method which is a system of a space-saving apparatus and which provides easy maintenance as well as a system for finishing prints while a customer remains in the store and which is improved in processing non-uniformity of images.

It is a fourth object of the invention to provide an image forming method which is a system of a space-saving apparatus and provides easy maintenance as well as a system for finishing prints while a customer remains in the store and which exhibits less processing fluctuation in density during continuous processing.

It is a fifth object of the invention to provide a processing element which is a system of a space-saving apparatus and provides easy maintenance as well as a system for finishing prints while a customer remains in the store and which is improved in raw stock stability, sensitivity and discrimination, a preparation method thereof and a novel image forming method by the use thereof.

It is a sixth object of the invention to provide an image forming method which is simple, rapid and safe, enabling development of silver halide photographic materials, without directly handling chemicals which are detrimental for the environment and some of which are not always safe for human body.

It is a seventh object of the invention to provide an image information preparing method which is simple and rapid-accessible.

The foregoing objects of the invention can be accomplished by the following constitution:

1. A photographic processing element used for processing silver halide photographic materials comprising a color developing agent or a precursor of a color developing agent;
2. The processing element described in 1, wherein the element comprises the precursor of a color developing agent;
3. The processing element described in 2, wherein the precursor is represented by the following formulas (1) through (6):

formula (1)

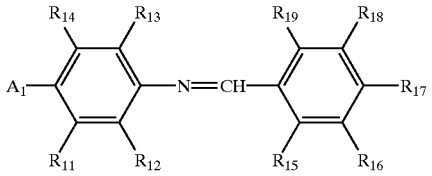

wherein $R_{11}$ through $R_{19}$ each represent a hydrogen atom or a substituent, provided that $R_{11}$ and $R_{12}$, $R_{13}$ and $R_{14}$, $R_{15}$ and $R_{16}$, $R_{16}$ and $R_{17}$, $R_{17}$ and $R_{18}$, or $R_{18}$ and $R_{19}$ may combine with each other to form a ring; and A1 represents a hydroxy group or a substituted amino group, provided that the substituted amino group of $A_1$ may combine with $R_{11}$ or $R_{14}$ to form a ring;

formula (2)

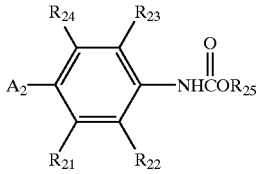

wherein $R_{21}$ through $R_{25}$ each represent a hydrogen atom or a substituent, provided that $R_{21}$ and $R_{22}$, or $R_{23}$ and $R_{24}$ may combine with each other to form a ring; and $A_2$ represents a hydroxy group or a substituted amino group, provided that the substituted amino group of $A_2$ may combine with $R_{21}$ or $R_{24}$ to form a ring;

formula (3)

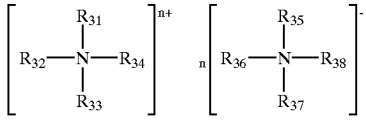

wherein $R_{31}$ through $R_{38}$ each represent a hydrogen atom or a substituent;

formula (4)

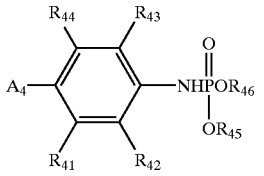

wherein $R_{41}$ through $R_{44}$ each represent a hydrogen atom or a substituent, provided that $R_{41}$ and $R_{42}$, or $R_{43}$ and $R_{44}$ may combine with each other to form a ring; $A_4$ represents a hydroxy group or a substituted amino group, provided that the substituted amino group of $A_4$ may combine with $R_{41}$ or $R_{44}$ to form a ring; and $R_{45}$ and $R_{46}$ each represent an alkyl group having 1 to 12 carbon atoms or an aryl group;

formula (5)

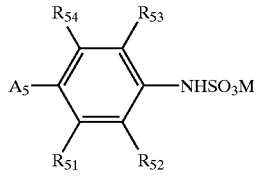

wherein $R_{51}$ through $R_{54}$ each represent a hydrogen atom or a substituent, provided that $R_{51}$ and $R_{52}$, or $R_{53}$ and $R_{54}$ may combine with each other to form a ring; $A_5$ represents a hydroxy group or a substituted amino group, provided that the substituted amino group of $A_5$ may combine with $R_{51}$ or $R_{54}$ to form a ring; and M represents a hydrogen atom, an alkali metal, ammonium, a nitrogen-containing organic base or a quaternary nitrogen-containing compound;

formula (6)

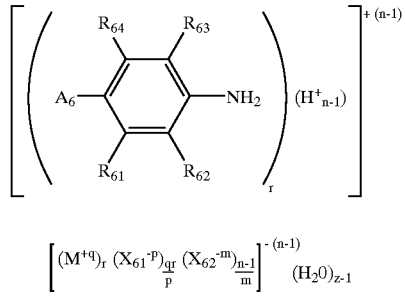

wherein $R_{61}$ through $R_{64}$ each represent a hydrogen atom or a substituent, provided that $R_{61}$ and $R_{62}$, or $R_{63}$ and $R_{64}$ may combine with each other to form a ring; $A_6$ represents a hydroxy group or a substituted amino group, provided that the substituted amino group of $A_6$ may combine with $R_{61}$ or $R_{64}$ to form a ring; $M^+$ is a metal ion; q is an integer of 2 or 3; r is an integer of 1 or 2; $X_{61}^-$ and $X_{62}^-$ each represents an anion, which may be the same or different; p is an integer of 1 or 2; m is an integer of 1 or 2; n is an integer of 1 through 3; and z is an integer of 1 through 5;

4. The processing element described in 2, wherein the processing element further comprises a base or a precursor of a base;

5. The processing element described in 1, wherein the processing element comprises a compound represented by the following formula (I) or (II):

formula (I)

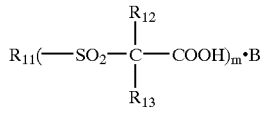

wherein m is an integer of 1 or 2; when m is 1, $R_{11}$ represents a univalent group selected from the group consisting of an alkyl group, a cycloalkyl group, an alkenyl group, an alkynyl group, an aralkyl group, an aryl group and a heterocycric residue, and when m is. 2, $R_{11}$ represents a bivalent group selected from the group consisting of an alkylene group, an arylenes group and a heterocyclic residue, each of which may be substituted; $R_{12}$ and $R_{13}$ each represent a hydrogen atom or a univalent group selected from the group consisting of an alkyl group, an alkenyl, a cycloalkyl group, an aralkyl group, an aryl group and a heterocycric moiety group, each of which may be substituted; and B represents an organic base, an alkali metal or an alkaline earth metal hydroxide;

$$R_{21}(—C\equiv C—COOH)_n.B \qquad \text{formula (II)}$$

wherein n is an integer of 1 or 2; when n is 1, $R_{21}$ represents a univalent group selected from the group consisting of an alkyl group, a cycloalkyl group, an alkenyl group, an alkynyl group, an aralkyl group, a carboxy group, an aryl group and a heterocycric residue, and when n is 2, $R_{21}$ represents a bivalent group selected from the group consisting of an alkylene group, an arylenes group and a heterocyclic residue, each of which may be substituted; and B represents an organic base, an alkali metal or an alkaline earth metal hydroxide;

6. The processing element described in 1, wherein the processing element comprises a quaternary ammonium phthalate or a ammonium salt of oxalic acid;
7. The processing element described in 1, wherein the processing element comprises a compound represented by formula (III):

$$Z_mX_n \qquad \text{formula (III)}$$

wherein Z represents a metal other than an alkali metal; X represents an oxide ion, hydroxide ion, carbonate ion, phosphate ion, borate ion or aluminate ion; m and n are each an integer necessary to allow the valence number of Z to counter-balance with that of X;

8. The processing element described in 7, wherein the processing element comprises a component layer containing the compound represented by formula (III) and a component layer containing a compound capable of reacting with the compound of formula (III) to form a complex;
9. The processing element described in 8, wherein the processing element comprises a hot water-soluble layer which is provided between the component layer containing the compound represented by formula (III) and the component layer containing a compound capable of reacting with the compound of formula (III) to form a complex;
10. The processing element described in 1, wherein the processing element comprises a compound represented by the following formula (7):

formula (7)

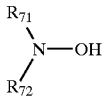

wherein $R_{71}$ and $R_{72}$ each represent a hydrogen atom or an alkyl group, which may be substituted;

11. The processing element described in 2, wherein the processing element comprises sulfite ion in an amount of 1 to 50 mmol/$m^2$;
12. The processing element described in 2, wherein the processing element comprises a halide ion in an amount of 1 to 50 mmol/$m^2$;
13. The processing element described in 2, wherein the processing element comprises a silver halide solvent;
14. The processing element described in 2, wherein the processing element comprises a development inhibitor;
15. The processing element described in 1, wherein the processing element consists of at least one selected from the group consisting of a water-soluble layer and a water-permeable layer;
16. The processing element described in 1, wherein the processing element comprises a water-insoluble support having thereon at least a component layer, and a peel layer being provided between the support and the component layer;
17. The processing element described in 1, wherein the processing element comprises a hot water-soluble layer;
18. The processing element described in 17, wherein the processing element comprises a layer containing a color developing agent or a precursor of a color developing agent and a layer containing a base or a precursor of a base, and further comprising a hot water-soluble layer which is provided between the layer containing a color developing agent or a precursor of a color developing agent and the layer containing a base or a precursor of a base;
19. The processing element described in 1, wherein the processing element comprises a heat-sealable water-permeable binder layer;
20. The processing element described in 1, wherein the processing element comprises a layer containing a water-soluble adhesive;
21. An image forming method comprising superposing a processing element comprising a color developing agent or a precursor of a color developing agent on an exposed silver halide photographic material comprising a support having thereon a silver halide emulsion layer to perform development of the photographic material to form an image;
22. The image forming method described in 21, wherein the processing element comprises a precursor of a color developing agent;
23. The image forming method described in 22, wherein the processing element comprises a base or a precursor of a base;
24. The image forming method described in 22, wherein the precursor of a color developing agent is represented by the above-described formulas (1) through (6);
25. The image forming method described in 22, wherein the development is performed in the presence of water;
26. The image forming method described in 21, wherein the processing element comprising a color developing agent or a precursor of a color developing agent is a processing film;
27. The image forming method described in 26, wherein the method further comprises superposing a processing sheet comprising a base or a precursor of a base on the processing film;
28. The image forming method described in 21, wherein the method comprises superposing a processing element comprising a base or a precursor of a base on the photographic material and further superposing the processing element comprising a color developing agent or a precursor of a color developing agent on the processing sheet comprising a base or a precursor of a base;
29. The image forming method described in 28, wherein the processing element comprising a base or a precursor of a base is a processing film, and the processing element comprising a color developing agent or a precursor of a color developing agent being a processing sheet;
30. The image forming method described in 21, wherein the method comprises superposing the processing element comprising a color developing agent or a precursor and a processing element on the photographic material, and at least one of the processing element comprising a color developing agent or a precursor and the processing element comprising a water-insoluble support;

31. The image forming method described in 22, wherein the development is performed at a temperature of 43° C. or more;
32. The image forming method described in 31, wherein the development is performed at a temperature of 55 to 95° C.;
33. The image forming method described in 21, wherein the processing element comprises a hot water-soluble layer;
34. The image forming method described in 33, wherein the processing element comprises a component layer (1) containing a color developing agent or a precursor of a color developing agent and a component layer (2) containing a base or a precursor of a base, and the processing element further comprising a hot water-soluble layer which is provided between the component layer (1) and component layer (2);
35. The image forming method described in 34, wherein the development is performed at a temperature of 55 to95° C. in the presence of water;
36. The image forming method described in 21, wherein the processing element is a processing sheet comprising a water-insoluble support having thereon a peel layer and further thereon a component layer containing a color developing agent or a precursor of a color developing agent, the method further comprising, after superposing the processing sheet on the photographic material, peeling a portion including the support from the processing sheet, while remaining the other portion including the component layer;
37. The image forming method described in 36, wherein the method further comprises, after peeling a portion including the support, performing development at a temperature of 43° C. or more;
38. The image forming method described in 36, wherein the method further comprises, after peeling a portion including the support, superposing thereon a processing element;
39. The image forming method described in 21, wherein the processing element further comprises a compound represented by formula (III), the method further comprising superposing processing element containing a compound capable of reacting with the compound of formula (III) to form a complex.

DETAILED DESCRIPTION OF THE INVENTION

The present invention will now be described in detail.

Photographic materials used in this invention are not specifically limited, including commercially available monochromatic (or black-and-white) negative films, color films and color reversal films. The size of these films is, for example, 135 size, APS and Brownie size (or 120 size). Exemplary examples of commercially available films include Konica Color Centuria 100, Konica Color Centuria 200, Konica Color Centuria 400, Konica Color Centuria 800, Konica Chrome SINRA 100 High Grade, Fuji Color SUPERIA Zoom Master Master 800, Fuji Color Nexia Zoom Master 800, and Kodak GOLD MAX films.

It is preferred that the photographic materials used in this invention do not substantially contain a developing agent or a precursor of a developing agent (or a developing agent precursor), or a base or a base precursor. Herein, the expression "do not substantially contain" means no content or a negligible content or contained in such a degree to having no effect on image formation.

In the image forming method according to this invention, color images based on non-diffusible dye(s) are preferably formed in the photographic material. The non-diffusible dye is preferably a dye formed reaction of a compound contained in the photographic material (coupler) with an oxidation product of a developing agent produced through reduction of silver halide by the developing agent. Examples of couplers usable in this invention include those which are described in Research Disclosure (also denoted as RD) 17643, page 25 VII-C to -G, and RD308119, page 1001, VII-C to -G.

The processing element used according to this invention refers to a sheet-formed processing element which contains no photosensitive material and which undergoes development by superimposing it on a photographic material. Unless otherwise stated, the processing element used in this invention may or may not contain a color developing agent or its precursor and may or may not comprise a support, as described later. In this invention, a processing element having a water-insoluble support is also referred to as a processing sheet and a processing element having no water-insoluble support and a water-soluble or water-permeable layer is also referred to as a processing film. Unless otherwise indicated, the processing sheet or processing film may or may not contain a color developing agent or its precursor. Of the processing sheets, a processing sheet containing a color developing agent or its precursor is also referred to as a developing sheet; and of the processing films, a processing film containing a color developing agent or its precursor is also referred to as a developing film.

The development refers to an operation in which a latent image formed upon exposure to light is reduced to undergo amplificatory transformation to an image and does not include an operation such as bleaching or fixing. The development is usually often conducted by immersing a photographic material into a solution of chemicals. In this invention, however, the development is conducted by superimposing the processing element on the photographic material, instead of immersing it into a chemical solution, thereby enabling development without using any chemical solution or reducing the chemical solution. In addition thereto, no space for a bath in which the chemical solution is contained is required and the developing time can also be shortened.

The processing element of this invention may have a multi-layer structure, as in the case of commercially available color negative films. In this case, each of the layers is also refers simply to a layer or to a component layer. In the component layer, a hydrophilic binder may be used and the binder composition can be optionally selected according to the function of the layer. In this invention, superimposing the processing element on the photographic material refers to bringing the component layer side of the processing element into contact with the emulsion layer side of the photographic material. Further, in cases of two or more processing elements, a first processing element is superposed on the photographic material and then a second processing element is superposed on the first processing element.

The processing element having a support can be provided with a function of cutting off air during development, preventing vaporization of substances from the photographic material or removing unnecessary component materials, after developing, of the photographic material or unwanted material formed during development. Examples of preferred supports usable in this invention include plastic resin films such as polyolefins (such as polyethylene and polypropylene), polycarbonates, cellulose acetate, polyethylene terephthalate, polyethylene naphthalate, and polyvinyl chloride. These can be obtained through polymerization according to the methods described in JP-A Nos. 62-117708, 1-46912 and 1-178505. Further, support usable in the photographic materials include, for example, paper supports such as photographic raw paper, graphic arts paper, baryta paper, and resin-coated paper; the foregoing resin film having thereon a reflection layer; and supports described in JP-A No. 62-253195 (page 29–31). Supports described in RD No. 17643, page 28, RD18716, right. column of page 647, to left column of page 48; and RD 307105, page 879 are also preferably employed. Polystyrenes having a syndiotactic structure are also preferred, which can be obtained through polymerization by the methods described in JP-A Nos. 62-117708, 1-46912 and 1-178505. Roll-set curl can be minimized by subjecting the support to a thermal treatment at a temperature lower than the glass transition point (Tg), as described in U.S. Pat. No. 4,141,735. The support surface may be subjected to a surface treatment to enhance adhesion between the support and a sub-layer. In this invention, glow discharge, UV ray irradiation, corona discharge and flame treatment are employed as a surface treatment. Supports described in Kochigijutsu (Disclosed Techniques) No. 5 (Mar. 22, 1991, published by Aztec Corp.) are also usable. There can be also employed a transparent support such as polyethylene naphthalene-dicarboxylate and a transparent support having thereon transparent magnetic powder.

Supports usable in the photographic materials used in this invention are described in RD 17643, page 28, and RD 308119, page 109; and Product Licensing Index vol. 92, page 108, item "Support". In cases when the photographic material is subjected to development at a relatively high temperature, as described later, a support resistant to such a high temperature must be used.

In cases where the processing element of this-invention has a support, there can be employed the same supports as described in the photographic materials.

Of processing elements having no support are preferred a water-soluble processing element or a water-permeable processing element. Such processing elements (hereinafter denoted as processing film) will now be described in detail.

The water-soluble processing film of this invention refers to a sheet-form film having no water-insoluble support and comprised of a water-soluble substrate, which is definitely different in form or function from an image receiving element having a support, as described in JP-A 10-293388 and a processing element having a support, as described in JP-A 11-184052. The expression "water-soluble" is defined as follows. A sample cut to a square of 2×2 cm is laminated between slide mounts and placed into water of a temperature of 10 to 20° C. and a pH of 2 to 12, while stirring and the time for the film sample to be completely dissolved (i.e., dissolution time) is measure. In this case, a processing film having a dissolution time of not more than 1200 sec is defined as being water-soluble.

Techniques of employing the water-soluble processing film have been applied to agricultural chemicals, water treatment agents, detergents and antiseptic agents, as described in JP-A Nos. 2-155999, 62-4800, 63-12466 and 61-57700. As application of this water-soluble processing film to photographic processing, a water-soluble processing film which is used for packaging of processing chemicals used as a replenisher is the only one known in the art.

The sheet-form water-soluble processing film may a contain photographically useful compound. The photographically useful compound refers to a compound which is usefully employed in the photographic art, and examples thereof include couplers, high boiling organic solvents, surfactants, developing agents, color developing agents, redox compounds, auxiliary developing agents, dyes, antioxidants, development inhibitors, silver solvents, development accelerators, bleaching agents, bleach-accelerating agents, fixing agents, alkali-generating agents and sparingly water-soluble metal compounds and their complex compounds.

As a substrate of the water-soluble processing element, there are preferably employed polyvinyl alcohol-type, polyethyleneoxide-type, starch-type, polyvinyl pyrrolidine-type, hydroxypropylcellulose-type, pullulan-type, alginic acid-type, phaselan-type, caragienan-type, agar-type, pectin-type, tamarind gum-type, xanthane gum-type, gua gum-type, tara gum-type, roast bean gum-type, arabinogalactan-type, jelan gum-type, cardlan gum-type, starch-type, dextran-type, arabic gum-type, gelatin-type, polyvinyl acetate-type, hydroxyethyl cellulose-type, carboxymethyl cellulose-type, carboxymethylhydroxyethyl cellulose-type, poly(alkyl)oxazoline-type and polyethylene glycol-type substrates. Of these, polyvinyl alcohol-type and gelatin-type substrates are more preferred. The solids content of not less than 30% by weight, based on total solids is specifically preferred. Preferably used gelatin include any one of the gelatins for photographic use, such as alkali-processed gelatin and acid-processed gelatin. Gelatin derivatives in which at least a part of the amino groups of the gelatin molecule is modified are also usable. The average molecular weight thereof is preferably 10,000 to 200,000. It is specifically preferred that gelatin having a number-average molecular weight of 500,000 or more is contained in an amount of not more than 10% of the total gelatin. Of gelatin derivatives, modified gelatin is preferred, in which the amino group of gelatin is modified by ioscyanate addition, acylation or deamination. Preferred examples of modified gelatin include gelatin which is added with phenyisocyanate or alkylisocyanate and gelatin which is allowed to react with acid anhydride such as phthalic acid anhydride or acid chloride such as phthalic acid chloride. The proportion of the modified amino group within the gelatin is preferably at least 70%, more preferably at least 80% and still more preferably at least 90%. The film using the foregoing gelatin may be hardened within the range to meet water-solubility by controlling the kind or amount of a hardener and the reaction time.

Preferred polyvinyl alcohol is extremely superior film forming material, exhibiting superior strength and flexibility under almost all conditions. Commercially available polyvinyl alcohol compositions which are formed as film are different with respect to molecular weight and extent of hydrolysis, and the molecular weight is preferably 10,000 to 100,000. The extent of hydrolysis refers to the proportion of substitution of an acetic acid ester group of polyvinyl alcohol by a hydroxide group, which is the same as a saponification degree. In cases where being applied to film, the range of hydrolysis is usually 70 to 98%. The term, polyvinyl alcohol usually includes polyvinyl acetate compounds. The water-soluble processing film requires optimal strength and flexibility, and preferably contains polyhydric alcohol such as sorbitol or glycerine, polyethers, phenol derivatives or amide compounds.

The water-soluble processing film can be prepared according to the commonly known methods, as described in JP=A 2-124945, 61-97348, 60-158245, 2-86638, 57-117867, 59-226018, 63-218741 and 54-13565. Examples thereof include a casting method in which a solution containing 5 to 50% solids and having a viscosity of 1500 to 50000 mPs·S (measured by a B-type viscometer) is cast onto a roll heated to about 70° C., a method of continuously casting on a stainless steel belt with drying with hot air, a method of coating by the knife-coating method with cooling to be solidified and then drying out any moisture and a method in which a solution is cast onto a support (e.g., polyethylene terephthalate) running along the manufacturing line while cooling to be solidified, dried and wound up or thermally compressed to another member.

The water-soluble processing film preferably contains photographically useful compounds during the preparation thereof. Of photographically useful compounds, it is preferred to contain a compound selected from a developing agent, base or base precursor, a silver halide solvent and a development inhibitor. It is also preferred to incorporate a plasticizer such as a high boiling solvent dispersion to provide plasticity to the film.

Polyvinyl alcohol films 7-000 series are preferably used, which are available from Chris Craft Industries Inc., MONO-SOL division, are soluble in water at a temperature of 1.1 to 93.3° C., are non-toxic, and exhibit high chemical resistance. Examples of other commercially available films include Nobon of a starch type film (available from Lambert Corp.), Matervy of cone-starch and modified PVA (available from Novermont Corp.), polyoxyalkylene-type Paogen or Furekishinu (available from DAIICHIKOGYO SEIYALU Co., Ltd.), PVA-type Soruburon (available from AISERO Chemicals Co., Ltd.), Kuralia (available from KURARAY Co., Ltd.), Tosuron (available from TOCELO Co., Ltd.), Haiseron (available from NICHIGO Film Co., Ltd.), Gosenol (available from NIHON GOSEIKAGAKU Co., Ltd.), and polysaccharide type PULLULAN (available from HAYASHIBARA Lab.), Soageena )available from MRC Polysaccharide Corp.) and Carrageenan (available from TAITO Co., Ltd.).

The thickness of the water-soluble processing film is preferably 10 to 200 $\mu$m, and more preferably 25 to 100 $\mu$m. In the case of less than 10 $\mu$m, sufficient strength cannot be achieved and in the case of more than 200 $\mu$m, it takes a too much time to dissolve the processing film and is unsuitable for the purpose of this invention. The water-soluble processing film preferably is thermally plastic, not only making easier heat-sealing or ultrasonic sealing but also enhancing effects of this invention. The tensile strength of the water-soluble processing film used in this invention is preferably $0.5\times10^6$ to $50\times10^6$ kg/m$^2$, more preferably $1\times10^6$ to $10\times10^6$ kg/m$^2$, and still more preferably $1.5\times10^6$ to $10\times10^6$ kg/m$^2$. The tensile strength can be determined in accordance with the method described in JIS Z-1521.

Water-permeable processing film used in this invention refers to a film as follows: when water is supplied to one side of the film, the film allows the supplied water to permeate and supply water to the other side. Examples of such a water-permeable processing film include film having a large number of penetrating pores which were previously perforated, a film in which a large amount of a fine particle dispersion of inorganic material or a high boiling solvent, a so-called filler is filled, and a film having a large number of fine pores in the form of a foam formed by the foaming method. Other embodiments include synthetic fibers having an anastomosis fiber structure and unwoven paper or Japanese paper comprised of natural fiber. As examples of a commercially available substrate, Ceolas SC-N42, Ceolas Cream FP-03 or Abicel (available from ASAHI Chemicals Ind. Co., Ltd.) can be mixed as a fibrous material. These are synthetic resin films and preferred synthetic resins include, for example, polyethylene terephthalate, stretched polypropylene, polyamide, rayon and acetate. Instead of a form having physically water-permeable voids, another form is a hardened gelatin membrane having the property capable of exchanging free water at the interface or in the interior of the film. As substrates of the water-permeable processing film are usable materials cited in the water-soluble processing film. The thickness of the water-permeable processing film is preferably 10 to 200 $\mu$m, and more preferably 25 to 100 $\mu$m.

The processing element of this invention preferably has a hot water-soluble layer. The hot water-soluble layer refers to a component layer which is not dissolved in cold water of a temperature of 0 to 40° C. within 1200 sec. but is dissolved in hot water at a temperature of 50 to 95° C. within 300 sec in the water dissolution test afore-mentioned. The hot water soluble layer can be used as any one of the component layers provided on the emulsion side of a silver halide photographic material and/or component layers of the processing element. In cases where used in the processing element, the layer containing a developing agent is preferably separate, across the hot water-soluble layer, from the layer containing a base or base precursor.

In embodiments of this invention, a processing system in which the foregoing water-soluble processing film, water-permeable processing film and the hot water-soluble layer are concurrently employed is preferred. Binder constituting the hot water-soluble layer is preferably polyvinyl alcohol or gelatin, which is contained preferably in an amount of at least 30% solids of the total solids content of the component layers. The saponification degree of polyvinyl alcohol used in the hot water-soluble layer is preferably 80 to 97% and the polymerization degree thereof is preferably 500 to 2000. A polymerization degree of 500 to 1000 and a saponification degree of 85 to 90% are specifically preferred. In the case of polyvinyl alcohol, boric acid or borax is preferably used in combination in an amount of not less than 20% of the solids content of polyvinyl alcohol.

In cases where gelatin is used in the hot water-soluble layer, gelatin afore-mentioned can be used and a low molecular weight gelatin having an average molecular weight of not more than 50000 and more preferably not more than 20000 is preferred. The gelatin preferably contains a hardener which is denoted as VS in JP-A 10-153833 and has at least 10 carbon atoms, in an amount of 5 to 40 mg per g of gelatin. Water-based polyurethane or polyacryl described in JP-A Nos. 10-291377, 10-76621 and 10-35127 are also preferably employed. Materials employed in the foregoing water soluble processing film are also usable. The thickness of the hot water-soluble layer is preferably 0.2 to 10 $\mu$m and more preferably 1 to 3 $\mu$m. The hot water-soluble layer is preferably formed by coating a solution having 1 to 30% solids and exhibiting a viscosity of 6 to 100 mPa·S (measure by B-type viscometer), within component layers of the silver halide photographic material and/or processing element, concurrently with these other component layers. These other component layers are insoluble even when subjected to development at a relatively high temperature, while the hot water soluble layer used in this invention is dissolved at a temperature of 50 to 95° C. within 300 sec.

In one preferred embodiment of this invention, the processing element has a peel layer. The peel layer of the processing element will now be described. The peel layer is provided between a support and a component layer containing a photographically useful compound of the processing element to remove the support, so that the remaining component layer contains a photographically useful compound on the photographic material. Of the photographically useful compound contained in the component layer which remains on the photographic material, a developing agent or a developing agent precursor, a base or base precursor and sparingly water-soluble metal compound or its complex forming agent are preferred. There may be provided plural component layers containing photographically useful compounds. Alternatively, plural photographically useful compounds may be contained in a single component layer. There may also be provided a component layer between the peel layer and the support.

Suitable material used in the peel layer include, for example, Arabic gum, acetic acid-phthelic acid cellulose, polymethacrylic acid, polyvinyl alcohol, hydroxyethyl cellulose, hydroxypropyl cellulose, hydroxypropylmethyl cellulose, methyl cellulose, ethyl cellulose, sodium alginate, alginic acid cellulose, pectine, as described in U.S. Pat. No. 2,759,825; straight-chain alkyl-perfluoroalkylate.sulfonamidoester, and polyethyleneoxide-perfluoroalkylate.sulfonamidoester, as described in U.S. Pat. No. 4,459,346; acrylic acid type compound, condensation compound between dialkylbarbituric acid and formaldehyde, as described in JP-A 60-214357; cellulose derivatives described in JP-B No. 45-24075 (hereinafter, the term, JP-B means a published Japanese Patent); starch ethers described in JP-b 50-35820; gallactomannan described in British Patent No. 869,190; water-soluble nylon and polyethylene glycol described in JP-A 4-208940; adipinic acid polyester and cellulose acid hydrogen phthalate described in JP-A 5-257253; nitrocellulose, cellulose acetate, cellulose acetate hydrogen phthalate, carboxymethyl cellulose, and phthalated gelatin. Further, the use of water-insoluble synthetic polymers such as a vinyl acetate-anhydrous maleic acid copolymer and methylmethacrylate-acrylic acid copolymer described in JP-B 45-15902, condensation product of barbituric acid and formaline described in JP-B 49-4333, a hydantoine-formaline condensation compound described in JP-B 49-4334, and a graft polymer between gelatin sufficiently reacted with dicarboxylic acid such as phthalic acid anhydride and a monomer of vinyl ester, vinyl ether or acrylic acid ester or a mixture thereof; the use of a dispersion comprised of a three-dimensional polymer comprised of styrene, acrylic acid (or methacrylic acid) and methyl methacrylic acid (or methyl acrylate) and dispersed in a water-soluble polymer such as ethyl cellulose are also preferred. In addition thereto, perfluoro-removers described in U.S. Patent are also suitably employed. Polyesters of adipinic acid and cellulose acid hydrogen phthalate are preferably employed as material used in the peel layer. The amount of material used in the peel layer is not specifically limited but preferably 0.01 to 10 g/m$^2$, and more preferably 0.05 to 2.0 g/m$^2$. Peel layers which are too thick or too thin lower peelablity, making it difficult to be uniformly peeled and resulting in non-uniformity in peeling.

After a processing element having a peel layer is superimposed on a photographic material in the invention, a part of the processing element including a support from the peel layer, while leaving the other part of the processing element including no support, and another processing element may be superimposed on the remaining part of processing element superimposed on the photographic material.

As a preferred embodiment of the processing element, the processing element preferably has a heat-sealing, water-permeable binder layer. Examples of heat-sealing resins include low density polyethylene, intermediate density polyethylene, high density polyethylene, ethylene-vinyl acetate copolymer, ethylene-acrylic acid copolymer, copolymer of ethylene-acrylic acid alkyl ester, ethylene-acrylic acid copolymer, polypropylene-type resin described in JP-A Nos. 6-316047 and 6-340042, polyester-type resin described in JP-A Nos. 5-222275 and 6-190996, polyimide resin described in JP-A No. 5-131596, and polyvinyl alcohol-type resin described in JP-A 10-510487. preferred of these resins are ethylene-vinyl acetate copolymer and polyvinyl alcohol-type resin. Commercialy available ethylene-vinyl acetate copolymer include, for example, EVA#87, EVA#81, EVA#63, EVA#60, EVA#56, EVA#55, EVA#39, and EVA#30 (any of these are available from DENKI KAGAKU KOGYO Co., Ltd.); and commercially available polyvinyl alcohol include, for example, Hi-celon C-200 (available from NICHIGO Film Co., Ltd.), Kralya H (available from KURARE Co., Ltd.) and Solbron KL (available from Aicero Chemicals Co., Ltd.).

As one preferred embodiment of the processing element of this invention, the processing element preferably has a layer containing a water-soluble adhesive. The water-soluble adhesives include any kind of an adhesive meeting the requirement that when water of at least 20%, based on the weight of the adhesive is supplied, the adhesive exhibits a peel strength of at least 180 g/15 mm in the peeling test at 80° C. (JIS Z-1522). Inorganic adhesives include, for example, alkali silicate; and organic adhesives include, for example, gelatin, glue, starch, polyvinyl alcohol, water-based vinyl urethane, acryl-type resin such as acrylic acid or acrylamide resin, α-olefin-maleic acid resin, and water-soluble fiber derivatives such as methyl cellulose, hydroxyethyl cellulose and carboxymethyl cellulose.

The processing element may further contain a photographically useful material. The photographically useful material refers to a compound useful in image formation, including a coupler, high boiling solvent, surfactant, developing agent, precursor of a developing agent, redox compound, auxiliary developing agent, dye, antioxidant, development inhibitor, silver halide solvent, development accelerator, bleaching agent, bleach-accelerating agent, fixing agent, base, and precursor of a base.

Next, developing agents and a precursor of a developing agent will be described. The developing agent used in this invention refers to a compound capable of reducing silver halide to form an image, including black-and-white developing agent, color developing agent, auxiliary developing agent and their precursors. Exemplary examples of developing agent used in this invention include p-phenylenediamine and p-aminophenol type developing agents, phosphoric acid amidophenol type developing agents, sulfonamidoaniline type developing agents, hydrazone type developing agents, phenols, sulfonamidophenols, polyhyroxybenzenes, naphthols, hydroxybisnaphthyls, methylene-bis-phenols, ascorbic acids, 1-aryl-3-pyrazolidones, hydrazones and precursors of the foregoing reducing agents, as described in U.S. Pat. Nos. 3,351,286, 3,761,270, 3,764,328, 3,342,599, 3,719,492; RD Nos.12146, 15108 and 15127; JP-A Nos. 56-27132, 53-135628, and 57-79035. Of these, p-phenylenediamine type compounds are preferably employed as a color developing agent, and a hydrophilic group-containing p-phenylenedimine compounds are specifically preferred. The hydrophilic group-containing p-phenylenediamine compound exhibit the advantages of causing little staining and little contact dermatitis, compared to p-phenylenediamine compounds containing no hydrophilic group, such as N,N-diethyl-p-phenylenediamine. The hydrophilic group is one which is substituted for an amino group or on a benzene ring of the p-phenylenediamine compound, and examples of the preferred hydrophilic groups include:

$$—(CH_2)_n—CH_2OH$$

$$—(CH_2)_m—NHSO_2—(CH_2)_n—CH_3$$

$—(CH_2)_m—O—(CH_2)_n—CH_3$ $—(CH_2CH_2O)_nC_mH_{2m+1}$

0COOH, and $sO_3H$, where m and n represent an integer of 0 or more. Exemplary examples of preferred color developing agents include compounds (C-1) through (C-16) described in Japanese Patent Application No. 2-203169, page 26–31; compounds (1) through (8) described JP-A 61-289350, page 29–31; compounds (1) through (62) described in JP-A 3-246543 page 5–9; and (C-1) and (C-3) described in Japanese Patent Application No. 2-203169, compound (2) described in JP-A 61-289350 and compound (1) described in JP-A 3-246543 are specifically preferred.

Further, compounds containing sulfonamidophenol, sulfonamidoaniline or hydrazine described in general formulas I through IX of JP-A 11-249275 are also preferably employed. Precusors of a p-phenylenediamine described in JP-A 5-241305, 11-167185 and 11-249275 are also preferred.

The developing agent described above is incorporated preferably in an amount of 0.001 to 100 mmol/$m^2$, and more preferably 1 to 50 mmol/$m^2$. The developing agents used in this invention include not only a developing agent but also a developing agent generated from a developing agent precursor. Once processing has started, the developing agent needs optimal diffusibility. The developing agent preferably exhibits solubility in an alkaline solution of a pH of 10 or more at 25° C. of not less than $1\times10^{-7}$ mol/l, and more preferably not less than $1\times10^{-6}$ mol/l. When dissolved in an alkaline solution of a pH of 10 or more at 25° C., the diffusion constant is preferably not less than $1\times10^{-8}$ $m^2/s$ and more preferably not less than $1\times10^{-6}$ $m^2/s$.

A precursor of a color developing agent usable in this invention (hereinafter, also denoted as a color developing agent precursor) is represented by the following formulas (1) through (6).

First, the compound represented by formula (1) will be described:

formula (1)

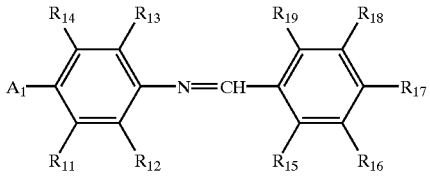

wherein $R_{11}$ through $R_{19}$ each represent a hydrogen atom or a substituent, provided that $R_{11}$ and $R_{12}$, $R_{13}$ and $R_{14}$, $R_{15}$ and $R_{16}$, $R_{16}$ and $R_{17}$, $R_{17}$ and $R_{18}$, or $R_{18}$ and $R_{19}$ may combine with each other to form a ring; and $A_1$ represents a hydroxy group or a substituted amino group, provided that the substituted amino group of $A_1$ may combine with $R_{11}$ or $R_{14}$ to form a ring. $R_{11}$ through $R_{19}$ each represent a hydrogen atom or a substituent; and Examples of the substituent include a halogen atom (e.g., chlorine, bromine), an alkyl group (e.g., methyl ethyl, isopropyl, n-butyl, tobutyl), an aryl group e.g., phenyl tolyl, xylyl), a carbonamido group (e.g., acetylamino, propionylamino, butyloylamino, benzoylamino), sulfonamido group(e.g., methanesulfonylamino, ethanesulfonylamino, benzenesulfonylamino, toluenesulfonylamino), alkoxy group (e.g., methoxy, ethoxy), aryloxy group (e.g., phenoxy, alkylthio group (e.g., methylthio, ethylthio, butylthio), arylthio group (e.g., phenylthio, tolylthio), carbamoyl group (e.g., methylcarbamoyl, dimethylcarbamoyl, ethylcarbamoyl, dimethylcarbamoyl, dibutylcarbamoyl, dibutylcarbamoyl, piperidylcarbamoyl, morpholinocarbamoyl, phenylcarbamoyl, methylphenylcarbamoyl, ethylphenylcarbamoyl, benzylphenylcarbamoyl), sulfamoyl group (e.g., methylsulfamoyl, dimethylsulfamoyl, ethylsulfamoyl, diethylsulfamoyl, dibutylsulfamoyl, piperidylsulfamoyl, morpholinosulfamoyl, phenylsulfamoyl, methylphenylsulfamoyl, ethylphenylsulfamoyl, benzylphenylsulfamoyl), cyano group, sulfonyl group (e.g., methanesulfonyl, ethanesulfonyl, phenylsulfinyl, 4-chlorophenylsulfonyl, p-toluenesulfonyl), alkoxycarbonyl group (e.g., methoxycarbonyl, ethoxycarbonyl, butoxycarbonyl), aryloxycarbonyl group (e.g., phenoxycarbonyl), acyl group (e.g., acetyl, ptopionyl, butyloyl, benzoyl, alkylbenzoyl), ureido group (e.g., methylaminocarbonamido, diethylaminocarbon amido), urethane group (e.g., methoxycarbonamido, butoxycarbonamido), acyloxy group (e.g., acetyloxy, propionyloxy, butyloyloxy), and hydroxy group.

With regard to the substituted amino group of Al, the substituents include, for example, an alkyl group, aryl group, and heterocyclic group, and these substituents may combine with each other to form a ring or may be further substituted.

Exemplary compounds represented by formula (1) are shown below but are not limited to these.

1-1

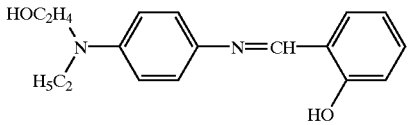

1-2

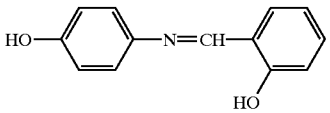

1-3

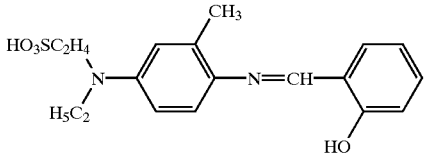

-continued
1-4
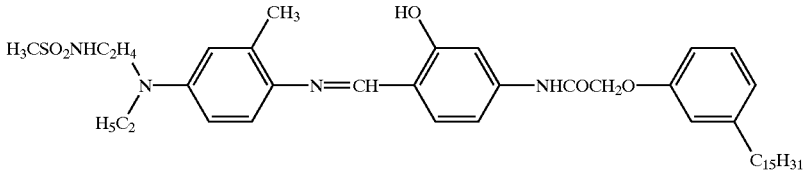
1-5
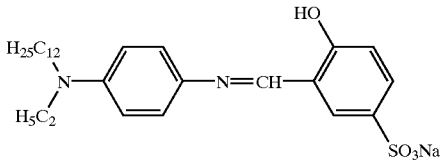
1-6
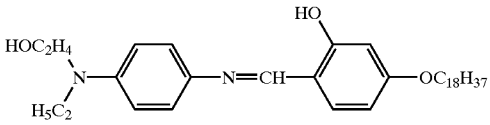
1-7
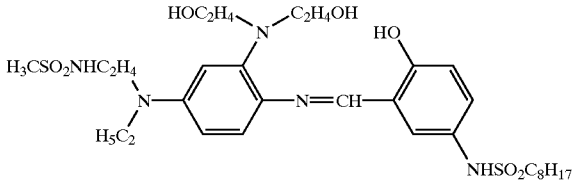
1-8
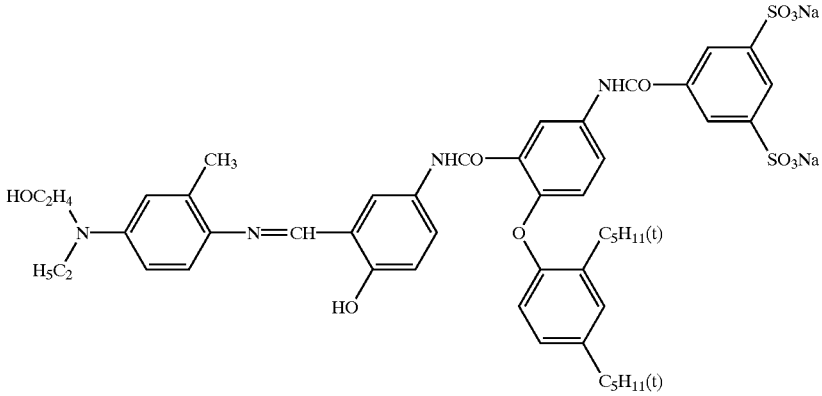
1-9
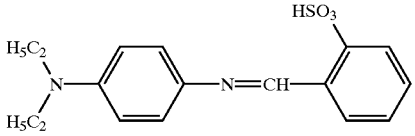
1-10
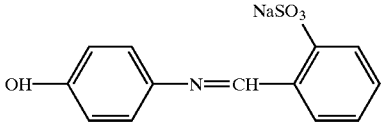
1-11
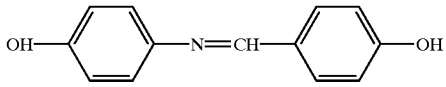
1-12
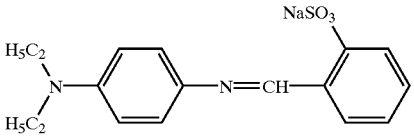
1-13
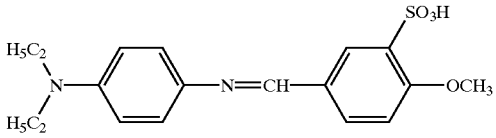
1-14
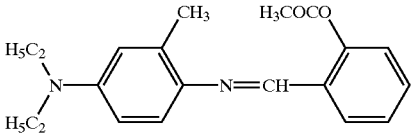
1-15
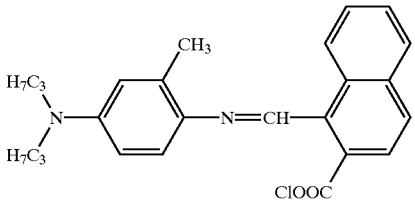
1-16
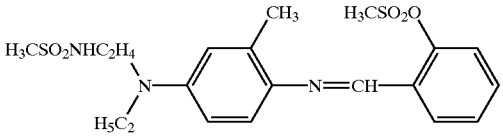

-continued 1-17

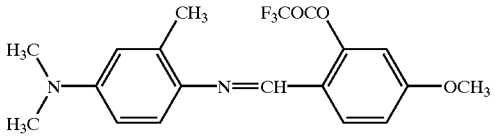

1-18

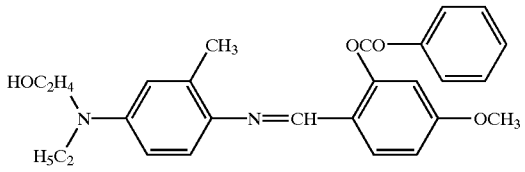

Of the foregoing exemplified compounds, compounds 1-1, 1-4, and 1-18 are specifically preferred.

Next, the compound represented by formula (2) is described:

formula (2)

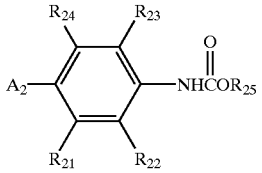

0123 wherein $R_{21}$ through $R_{25}$ each represent a hydrogen atom or a substituent, provided that $R_{21}$ and $R_{22}$, or $R_{23}$ and $R_{24}$ may combine with each other to form a ring; and $A_2$ represents a hydroxy group or a substituted amino group, provided that the substituted amino group of $A_2$ may combine with $R_{21}$ or $R_{24}$ to form a ring.

Exemplary compounds represented by formula (2) are shown below but are not limited to thse.

2-1

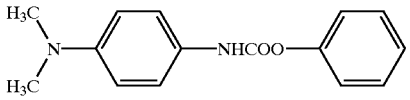

2-2

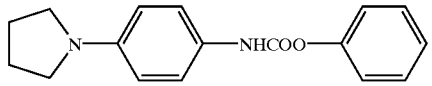

2-3

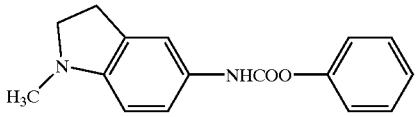

2-4

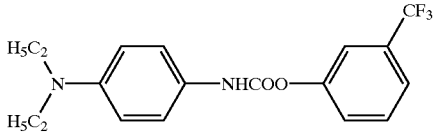

2-5

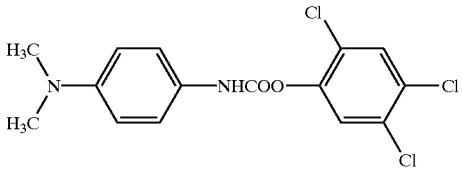

2-6

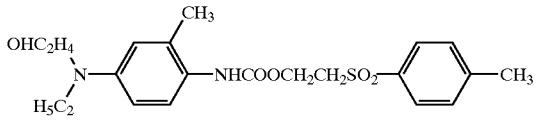

2-7

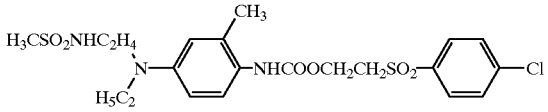

2-8

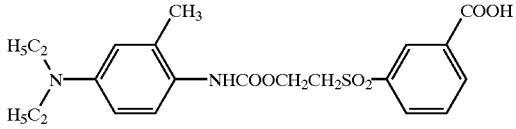

2-9

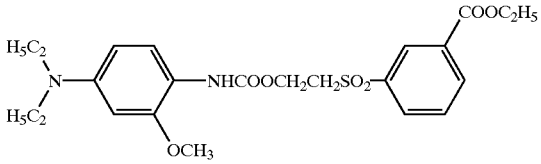

2-10

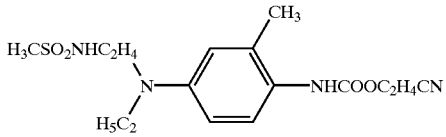

2-11

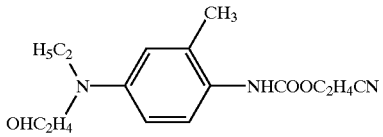

2-12

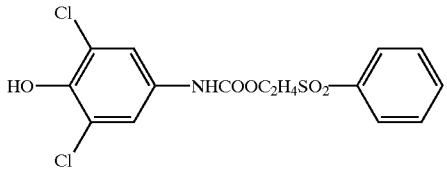

-continued
2-13
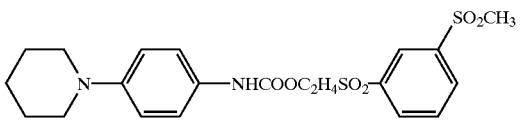
2-14
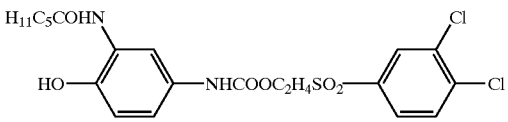
2-15
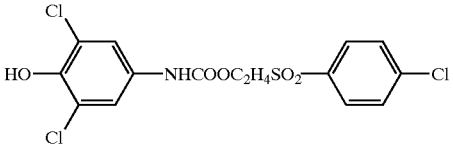
2-16
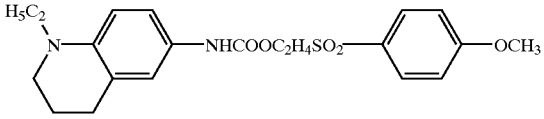
2-17
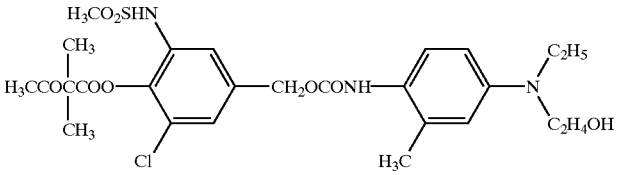
2-18
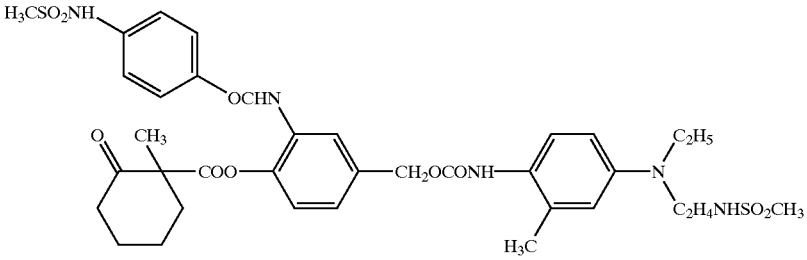
2-19
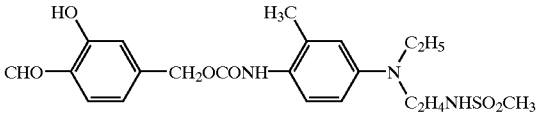
2-20
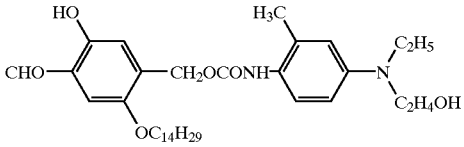
2-21
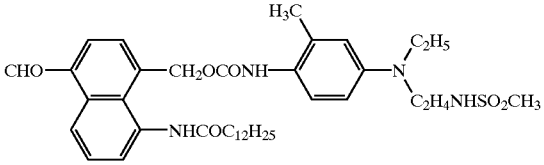
2-22
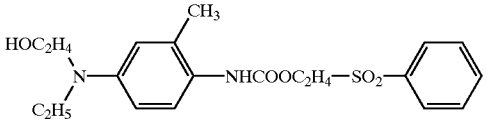
2-23
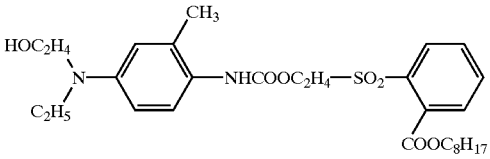
2-24
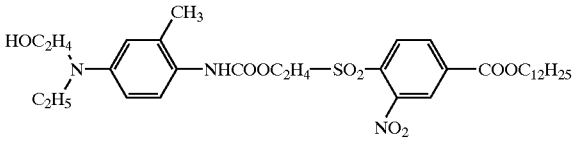
2-25
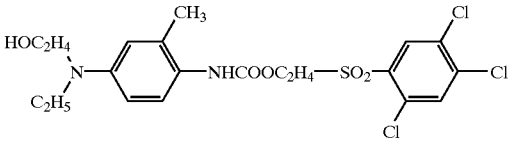

-continued 2-26

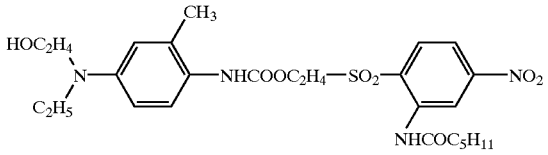

Of the foregoing exemplified compounds, compounds 2-6, 2-7, 2-11, 2-19, 2-20 and 2-22 are specifically preferred.

Next, the compound represented by formula (3) is described:

formula (3)

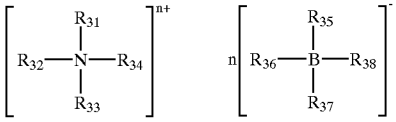

wherein $R_{31}$ through $R_{38}$ each represent a hydrogen atom ot a substituent. The substituents represented by $R_{31}$ through $R_{38}$ are the same as defined in $R_{11}$ through $R_{19}$ of formula (1). Specifically, $R_{31}$ through $R_{34}$ each are a hydrogen atom, an alkyl group, alkenyl group, cycloalkyl group, allyl group, acyl group, amino group, carbamoyl group, sulfonyl group or heterocyclic group. $R_{31}$ and $R_{32}$, or $R_{31}$, $R_{32}$ and $R_{33}$ may combine to form a ring; $R_{31}$ is the same as $R_{32}$ and may form a bonding such as $[R_{31}{=}N(R_{33})(R_{34})]^+$. $R_{31}$ through $R_{34}$ may be a group provided by a nitrogen-containing organic base or a quaternary nitrogen containing compound. $R_{35}$ through $R_{38}$ are each an alkyl group, alkenyl group, cycloalkyl group, allyl group, phenyl group, heterocyclic group; and n is an integer of 1 to 5.

Exemplary compounds represented by formula (3) are shown below but are not limited to these.

3-1

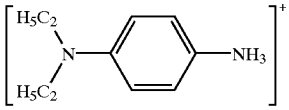

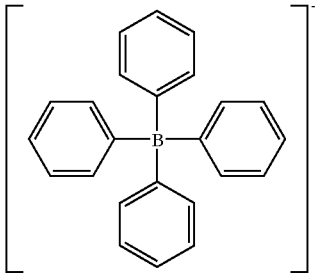

3-2

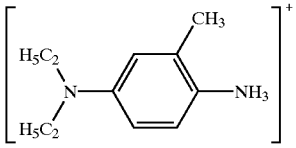

-continued

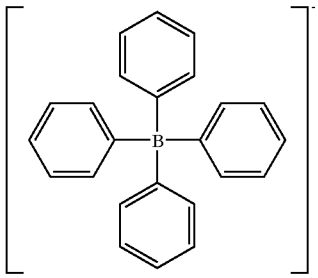

3-3

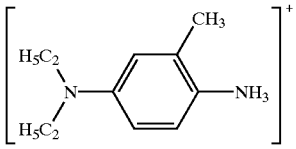

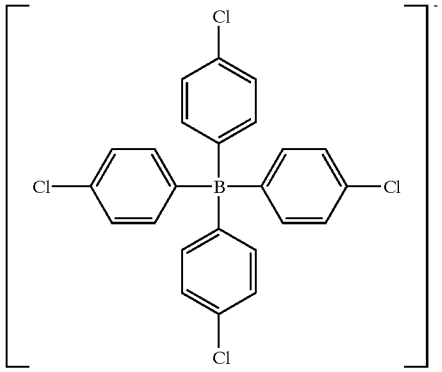

3-4

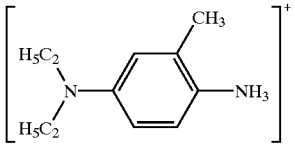

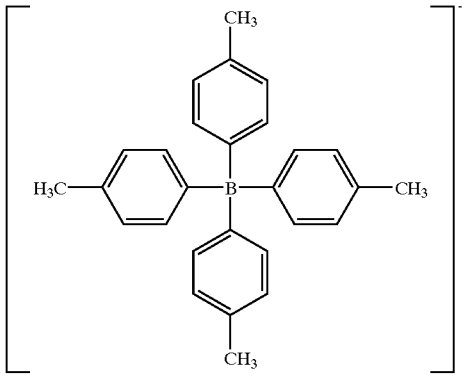

-continued
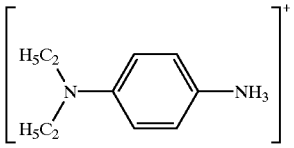
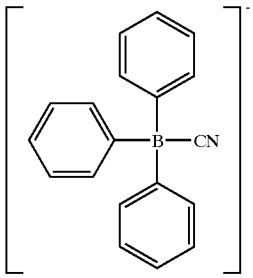
3-6
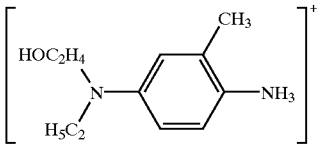
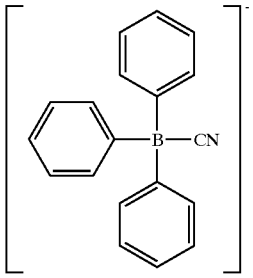
3-7
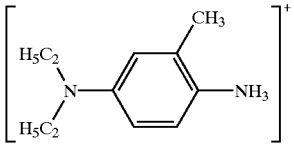
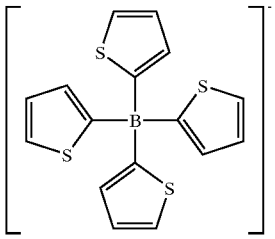
3-8
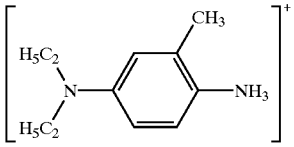
-continued
3-5
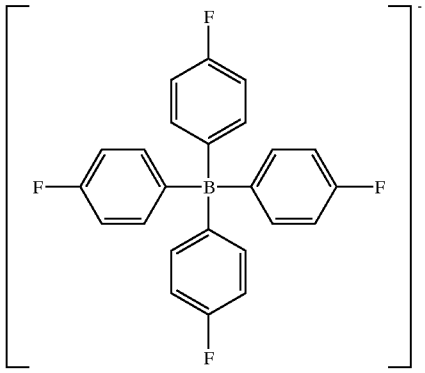
3-9
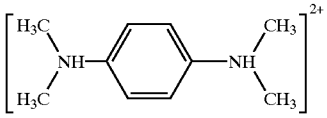
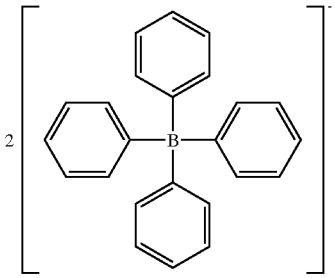
3-10
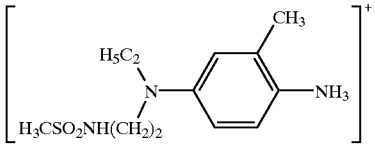
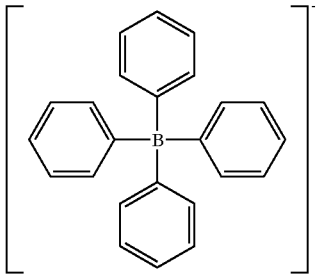
3-11
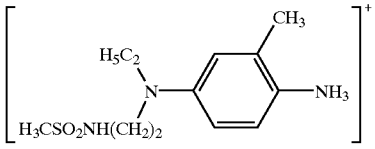

-continued
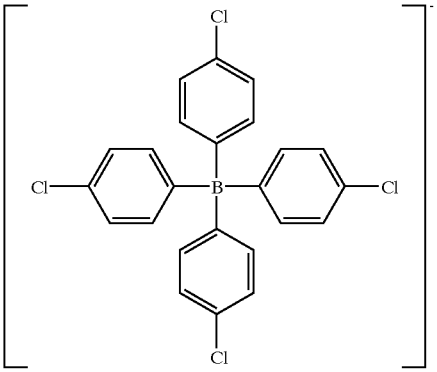
3-12
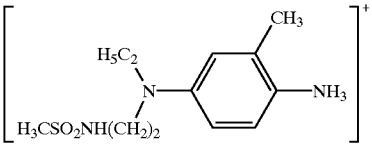
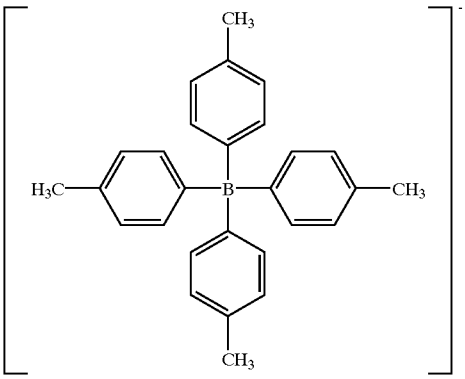
3-13
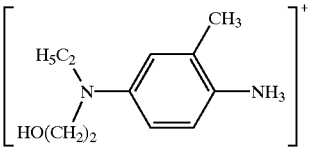
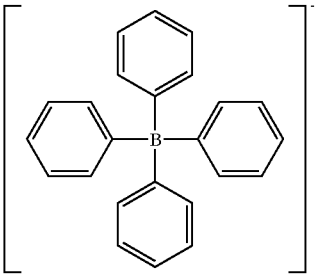
3-14
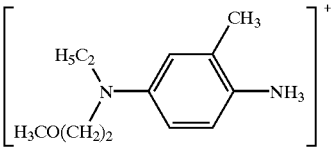
-continued
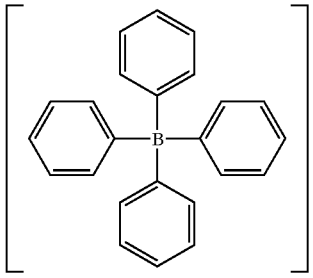
3-15
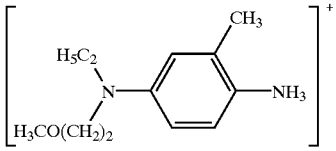
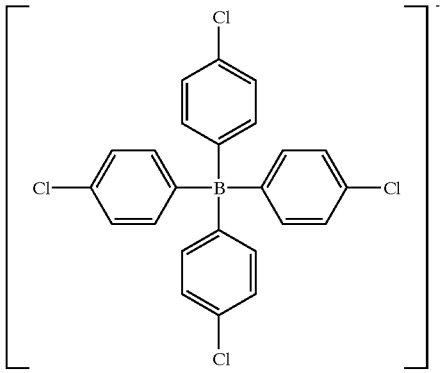
3-16
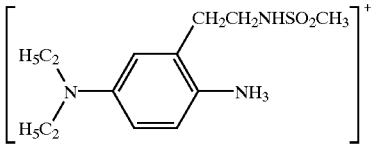
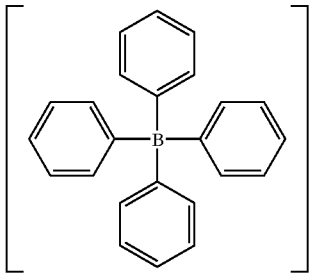
3-17
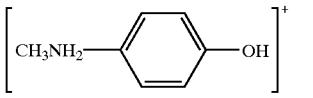
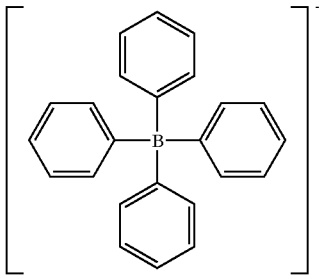

-continued
3-18
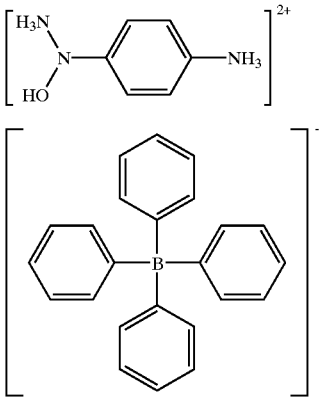
3-19
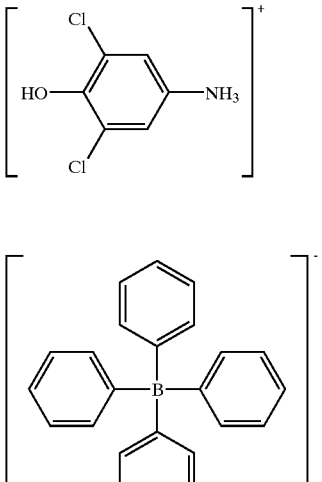
3-20
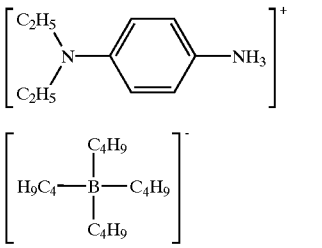
3-21
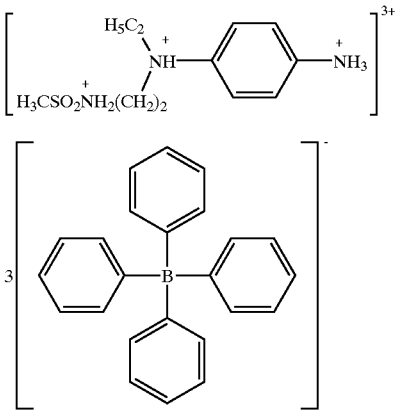
3-22
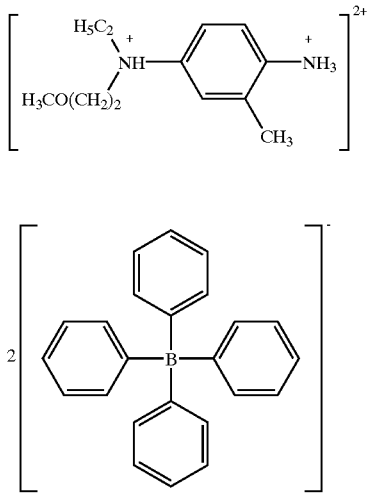
3-23
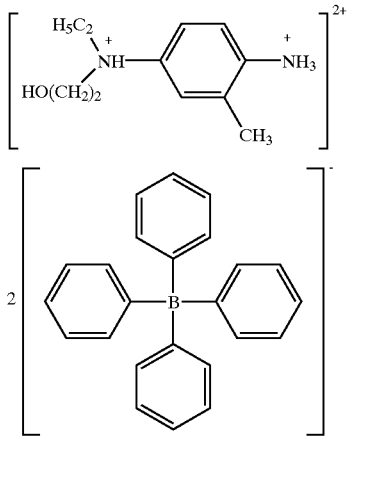
3-24
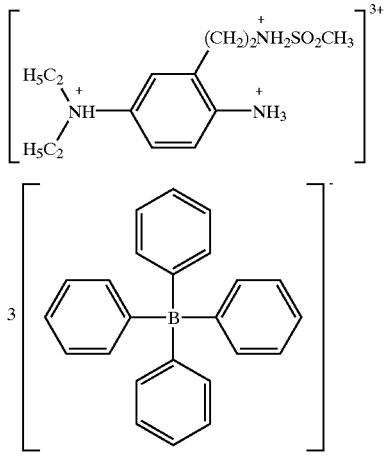
Of the foregoing exemplified compounds, compounds 3-13, 3-15 and 3-31 are specifically preferred.
Next, the compound represented by formula (4) is described below:

formula (4)

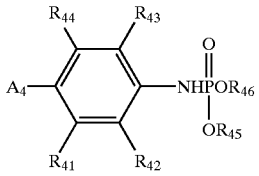

wherein $R_{41}$ through $R_{44}$ each represent a hydrogen atom or a substituent. The substituents represented by $R_{41}$ through $R_{44}$ are the same as defined in $R_{11}$ through $R_{19}$ of formula (1). $A_4$ is the same as defined in $A_1$ of formula (1). $A_4$ represents a hydroxy group or a substituted amino group and the substituted amino group of $A_4$ may combine with $R_{41}$ or $R_{44}$ to form a ring. $R_{45}$ and $R_{46}$ each represent an alkyl group having 1 to 12 carbon atoms, which may be substituted, or an aryl group.

Exemplary exmples of the compound represented by formula (4) are shown below but are not limited to these.

4-1

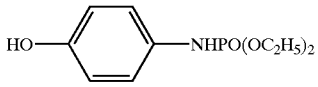

4-2

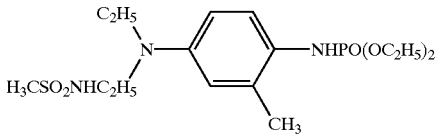

4-3

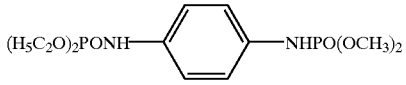

4-4

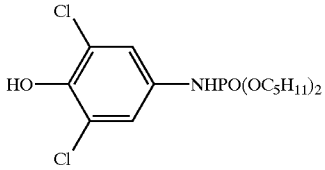

4-5

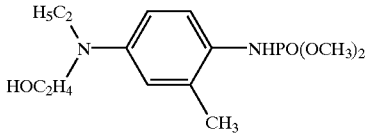

4-6

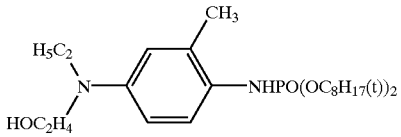

4-7

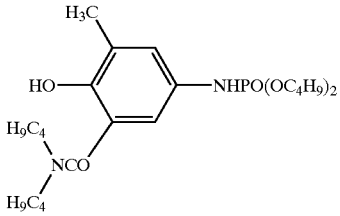

-continued 4-8

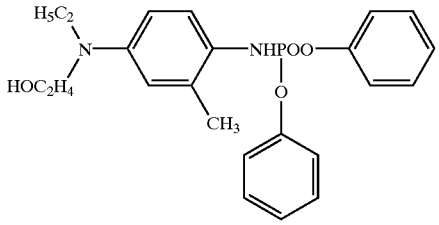

Of the foregoing exemplified compounds, compounds 4-2, 4-4, 4-5 and 4-6 are specifically preferred.

Next, the compound represented by formula (5) is described below:

formula (5)

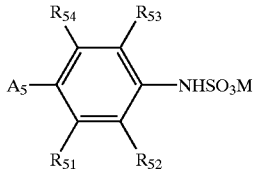

wherein $R_{51}$ through $R_{54}$ each represent a hydrogen atom or a substituent, and the substituents represented by $R_{51}$ through $R_{54}$ are the same as defined in $R_{11}$ through $R_{19}$ of formula (1). $A_5$ is the same as defined in $A_1$ of formula (1). $R_{51}$ and $R_{52}$, or $R_{53}$ and $R_{54}$ may combine with each other to form a ring. The substituted amino group of $A_5$ may combine with $R_{51}$ or $R_{54}$ to form a ring; and M represents a hydrogen atom, an alkali metal, a nitrogen-containing organic base or a quaternary nitrogen-containing compound.

Exemplary examples of the compound represented by formula (5) are shown below but are not limited to these.

5-1

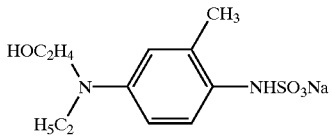

5-2

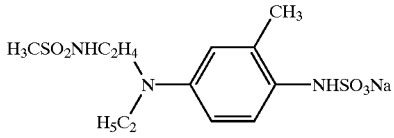

5-3

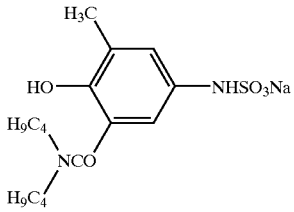

5-4

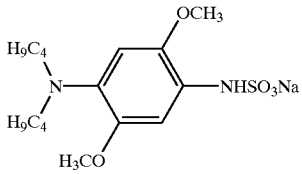

-continued 5-5

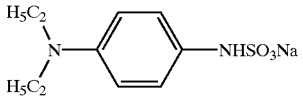

5-6

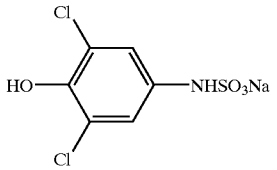

5-7

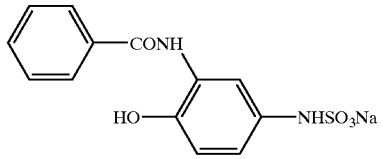

5-8

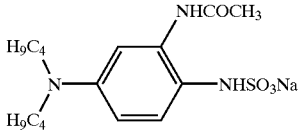

Of the foregoing exemplified compounds, compounds 5-1, 5-2 and 5-8 are specifically preferred.

Next, the compound represented by formula (6) is described below:

formula (6)

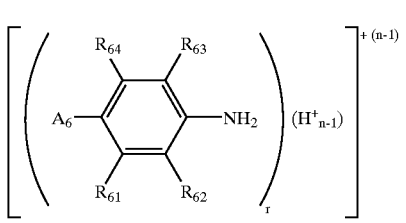

$$\left[(M^{+q})_r\,(X_{61}^{-p})_{\frac{qr}{p}}\,(X_{62}^{-m})_{\frac{n-1}{m}}\right]^{-(n-1)}\,(H_2O)_{z-1}$$

wherein $R_{61}$ through $R_{64}$ each represent a hydrogen atom or a substituent and the substituents represented by $R_{61}$ through $R_{64}$ are the same as defined in $R_{11}$ through $R_{19}$ of formula (1). $A_6$ is the same as $A_1$ of formula (1). $R_{61}$ and $R_{62}$, or $R_{63}$ and $R_{64}$ may combine with each other to form a ring. The substituted amino group of $A_6$ may combine with $R_{61}$ or $R_{64}$ to form a ring; $M^+$ is a metal ion, including , for example, zinc, cupper, cadmium or lead. Of these, the use of zinc and $Cl^-$ or $Br^-$ is preferred; q is an integer of 2 or 3; r is an integer of 1 or 2; $X_{61}^-$ and $X_{62}^-$ each represents an anion, which may be the same or different, and preferred anion represented by $X_{61}^-$ and $X_{62}^-$ is $Cl^-$, $Br^-$, $CLO_3^-$, $BrO^3_$, $CH_3COO^-$, $I^-$, $SO_4^{2-}$, or $NO_3^-$; p is an integer of 1 or 2; m is an integer of 1 or 2; n is an integer of 1 through 3; and z is an integer of 1 through 5.

Exemplary examples of the compound represented by formula (6) are shown below but are not limited to these.

6-1

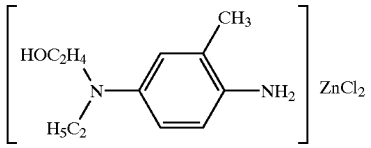

6-2

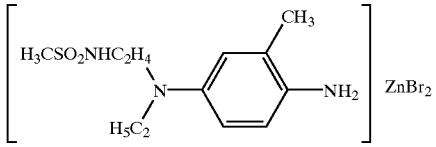

6-3

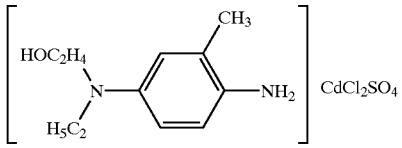

6-4

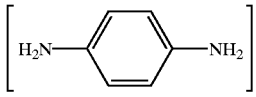

6-5

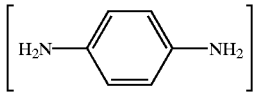

6-6

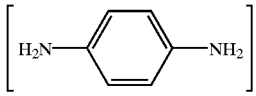

6-7

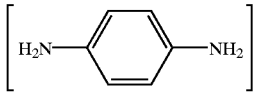

6-8

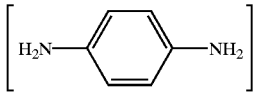

6-9

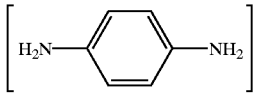

Of the foregoing exemplified compounds, compounds 6-1, 6-2, 6-5 and 6-8 are specifically preferred.

The compounds represented by formulas (1) through (6) can be synthesized according to the methods known in the art.

The compound represented by formulas (1) through (4) is incorporated into the processing element in such a way that the developing agent and a high boiling solvent (e.g., phosphoric acid alkyl ester, phthalic acid alkyl ester) are mixed and dissolved in a low boling solvent (e.g., ethyl acetate, methyl ethyl ketone) and after being dispersed in water by the method known in the art, the dispersin is incorporated. The compound represented by formulas (1) through (6) may be incorporated using the dispersing method described in JP-A 63-271339. The amount of the compouns of formulas (1) through (6) to be incorporated is within the broad range, but preferably 0.001 to 1000 mmol/$m^2$, and more preferably 0.01 to 50 mmol/$m^2$.

The base used in this invention refers to a compound capable of generating a hydroxide ion in the presence of water or a compound generating a salt upon neutralization of an acid in the presence of water. The base includes organic bases and inorganic bases. Examples of the inorganic base include alkali metal or alkaline earth metal hydroxides (e.g., potassium hydroxide, sodium hydroxide, lithium hydroxide, calcium hydroxide, magnesium hydroxide), phosphates (e.g., dipotassium hydrogen phosphate, disodium hydrogen phosphate, ammonium sodium hydrogen phosphate, second or third phosphate of calcium hydrogen phosphate) carbonates (e.g., potassium carbonate, sodium carbonate, sodium hydrogen carbonate, magnesium carbonate), borates (e.g., potassium borate, sodium borate, sodium metaborate), organic acid salts (e.g., potassium acetate, sodium acetate, potassium oxalate, sodium oxalate, potassium tartarate, sodium malate, sodium palmitate, sodium stearate, etc.), as described in JP-A 62-209448; and alkaline earth metal acetylide described in JP-A 63-25208. Examples of the organic bases include ammonia, aliphatic or aromatic amines such as primary amines (e.g., methylamine, ethylamine, butylamine, n-hexylamine, cyclohexylamine, 2-ethylhexylamine, allyamine, ethylenediamine, 1,4-diaminobutane, hexamethylenediamine, aniline, p-tolidine, -naphthylamine, m-phenylenediamine, 1,8-diaminonaphthalene, benzylamine, phenethylamine, ethanolamine, etc.), secondary amines (e.g., dimethylamine, diethylamine, dibutylamine, diallylamine, N-methylaniline, N-methylbenzylamine, N-methylethanolamine, diethanolamine, etc.), tertiary amines (e.g., N-methylmorpholine, N-hydroxyethylmorpholine, N-methylpiperidine, N-hydroxyethylpiperidineN,N'-dimethylpiperadine, N,N'-dihydroxyethylpiperadine, diazabicyclo[2,2,2]octane, N,N-dimethylethanolmine, N,N-dimethylpropanolamine, N-methyldiethanolamine, N-methylpropanolamine, triethanolamine, N,N,N',N'-tetramethylethylenediamine, N,N,N',N'-tetrahydroxyethylethylenediamine, N,N,N',N'-tetramethyltrimethylenediamine, N-methylpyrrolidine, as described in JP-A 62-170954), polyamines (e.g., diethylenetriamine, triethylenetetramine, polyethyleneimine, polyallylamine, polyvinylbenzylamine, poly-(N,N-diethylaminoethyl methacrylate, poly-(N,N-dimethylvinylbenzylamine, etc.), hydroxyamines (e.g., hydroxylamine, N-hydroxy-N-methylaniline, etc.), heterocyclic amines (e.g., pyridine, lutidine, imidazole, aminopyridine, N,N-dimethylaminopyridine, indole, quinoline, isouinoline, poly-4-vinylpyridine, poly-2-vinylpyridine, etc.), amidines (e.g., monoamidine such as acetoamidine, imidazole, 2-methylimidazole, 1,4,5,6-tetrahydropyrimidine, 2-methyl-1,4,5,6-tetrahydropyrimidine2-phenyl-1,4,5,6-tetrahydropyrimidine, iminopiperidine, diazabicyclononene, diazabicycloundecene (DBU), etc.), bis-, tris- or tetra-amidine, guanidines (e.g., water-soluble gianidines such as guanidine, dimethylguanidine, tetramethylguanidine, 2-aminoimidazoline, 2-amino-1,4,5-tetrahydropyrimidine; water-insoluble mono- or bis-guanidine described in JP-A 63-70,845; bis-, tris- or tetra-guanidine) and quaternary ammonium hydroxide (e.g., tetramethylammonium hydroxide, tetraethylammonium hydroxide, tetraethylbutylammonium hydroxide, trimethylbenzylammonium hydroxide, triocylmethylammonium hydroxide, methylpyridinium hydroxide, etc.).

The precusor of a base (or base precursor) refers to a compound capable of releasing an alkali, among compounds to maintain a high pH required for the reaction system of development. U.S. Pat. No. 3,260,598 and JP-A No. 62-129848, for example, disclose a technique of using a sparingly water-soluble metal compound and sodium or potassium salt of a ligand capable of coordinating with the metal of this metal compound (i.e., a complexing agent)and raing the pH by the reaction thereof. In this case, boththe sparingly water-soluble metal compound and the complexing agent both are a base precursor. Further, there can be employed a base generating agent described in JP-A Nos. 56-13745 and 57-132332; and compounds releasing or forming a base component (base precursor) described in British patent No. 998,949; U.S. Pat. Nos. 3,220,846, 3,523,795; JP-A nos. 50-22625, 59-168440, 59-168441, 59-180537, 60-237443, 61-32844, 61-36743, 61-52639, 61-51139, 61-51140, 61-52638, 61 -53631, 61-53634, 61-53635, 61-53636, 61-53637, 61-53638, 61-53639, 61-53640, 61-55644, 61-55645, 61-55646, 61-219950 and 61-251840.

Examples of the sparingly water-soluble metal compound include a metal oxide, hydroxide, carbonate, phosphate, silicate, borate and aluminate, each of which exhibits solubility in water at 20° C. of 0.5 or less (expressed in g per 100 g of 100 g water). Specifically, a metal compound represented by the following formula (III) is preferred:

$$Z_mX_n \qquad \text{formula (III)}$$

wherein Z represents a metal other than an alkali metal; X represents an oxide ion, hydroxide ion, carbonate ion, phosphate ion, borate ion or aluminate ion; m and n are each an interger necessary to allow the valence number of Z to counter-balance with that of X. The metal compound of formula (III) may contain crystal water or may form a double salt. Preferred Z includes, for example, transition metal ions such as $Zn^{2+}$, $Co^{2+}$, $Ni^{2+}$, $Fe^{2+}$, $Mn^{2+}$, $Cu^{2+}$, and $Hg^{2+}$ and alkaline earth metal ions such as $Ba^{2+}$, $Sr^{2+}$ and $Ca^{2+}$, and $Zn^{2+}$, $Co^{2+}$, $Ni^{2+}$, $Mn^{2}$+, and $Cu^{2+}$ are more preferred. Preferred X includes, for example, an oxide ion, hydroxide ion and carbonate ion. Exemplary examples of the sparingly water-soluble metal compound include $Zn(OH)_2$, ZnO, $Co(OH)_2$, CoO, $Ni(OH)_2$, $Cu(OH)_2$, $Fe(OH)_2$, $Mn(OH)_2$, $BaCO_3$, $SrCO_3$, $CaCO_3$, basic zinc carbonate, basic cobalt carbonate, basic nickel carbonate, and basic bismuth carbonate. Of these, when dispersed in an aqueous medium, one which does not color the dispersion is preferred, and ZnO and $Zn(OH)_2$ are specifically preferred.

Examples of the complexing agent capable of forming a complex, in the presence of water, with the metal ion constituting a sparing water-soluble metal compound, as described above include complexing agents forming a complex exhibiting a chelate stability constant (logK) of 1 or more with the metal ion constituting the sparingly water-soluble metal compound. The complexing agents are described, for example, in "Mukikagaku Zensho" (Comprehensive Inorganic Chemistry Series, 1959, published by Maruzen); "Metal Chelate" (1976, published by Nanko-do); and A. E. Martell & R. M. Smith, Critical Stability Constants, vol. 1–5, (Plenum Press). Exemplary examples thereof include aminocarboxylic acids, aminopolycarboxylic acids, aliphatic carboxylic acids (including mono-, di-, tri-, and tetra-carboxylic acids), aromatoic carboxylic acids and their derivatives, pyridine derivatives, β-diketones, polyphosphoric acids, polyacrylates and hydroxamic acids. The sparingly water-soluble metal compound or complex-forming compound (or complexing agent) is incorporated preferably in an amount of 0.1 to 100 $mmol/m^2$, and more preferably 1 to 50 $mmol/m^2$.

The preferred base precursor usable in the invention is represented by the above-described formula (I) or (II).

In formula (I),$R_{11}$ is preferably an aryl group when m is 1, and an arylenes group when m is 2. $R_{12}$ and $R_{13}$ each are an alkyl group, an aryl group or a hydrogen atom, and a hydrogen atom is specifically preferred. The organic base represented by B is preferably a compound exhibiting a pKa of 9 or more and a boiling point of 145° C. or more, and having 9 or more carbon atoms; and exemplary examples thereof include dimethylamine, guanidine, methylguanidine, dimethylguanidine, 2-aminopyridine, 2-methylimidazole, 2-aminoimidazole, piperidine, piperazine, and ethylenediamine. Examples of preferred alkali metal or alkaline earth metal hydroxides include sodium hydroxide, potassium hydroxide, lithium hydroxide and cesium hydroxide.

Exemplary examples of the compound represented by formula (I) are shown below but are not limited to these.

I-1

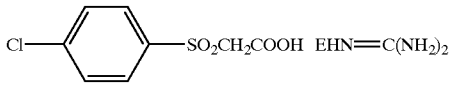

I-2

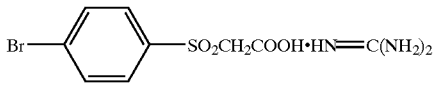

I-3

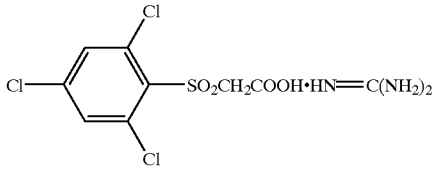

I-4

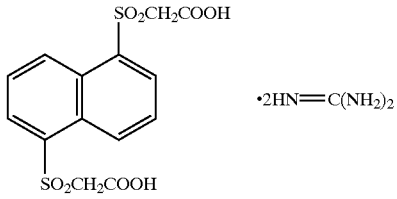

I-5

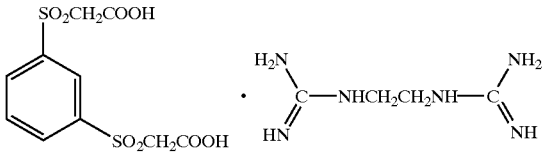

I-6

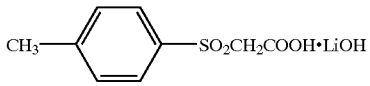

I-7

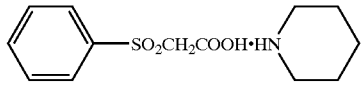

I-8

I-9

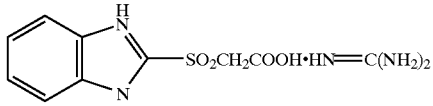

-continued

I-10

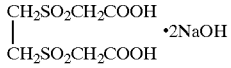

I-11

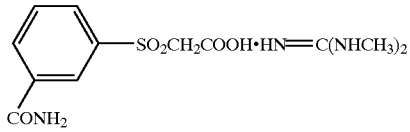

I-12

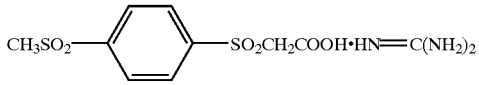

I-13

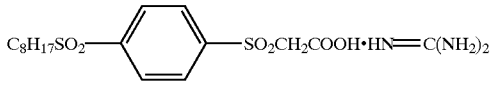

I-14

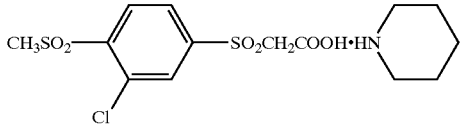

I-15

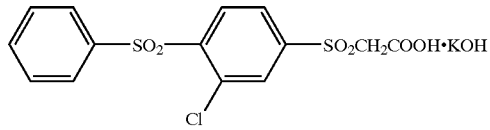

I-16

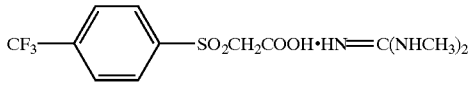

I-17

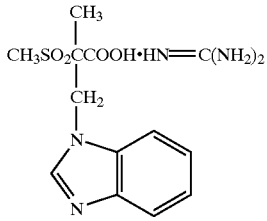

Of these compounds are preferred compounds (I-1), (I-2) and (I-12).

In formula (II), $R_{21}$ is preferably an aryl group when m is 1, and an aryl group when m is 2. The organic base represented by B is preferably a compound exhibiting a pKa of 9 or more and a boiling point of 145° C. or more, and having 9 or more carbon atoms; and exemplary examples thereof include dimethylamine, guanidine, methylguanidine, dimethylguanidine, 2-aminopyridine, 2-methylimidazole, 2-aminoimidazole, piperidine, piperazine, and ethylenediamine. Examples of preferred alkali metal or alkaline earth metal hydroxides include sodium hydroxide, potassium hydroxide, lithium hydroxide and cesium hydroxide.

Exemplary examples of the compound represented by formula (II) are shown below but are not limited to these.

II-1

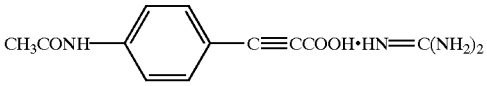

II-2

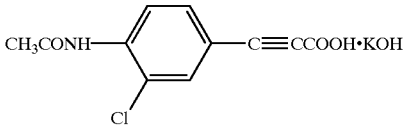

II-3

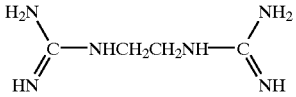

II-4

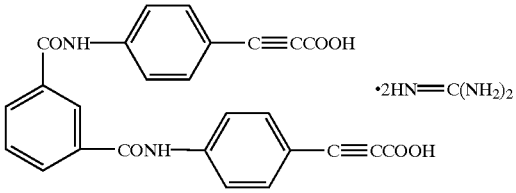

II-5

II-6

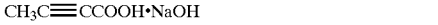

II-7

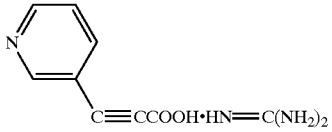

II-8

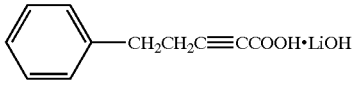

II-9

II-10

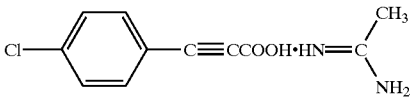

II-11

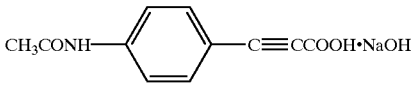

II-12

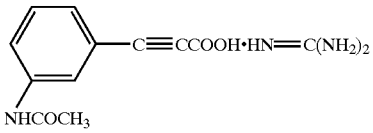

II-13

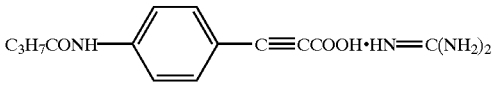

Preferred of these compounds are compounds (II-1), (II-10) and (II-12).

Preferred base precursors used in this invention include a phthalic acid ammonium salt and an oxalic acid ammonium salt. Examples of the ammonium salt include various compounds containing a quaternary nitrogen atom. Specifically, guanidine, methylguanidine and dimethylguanidine are preferably employed (i.e., in the form of an ammonium salt) and guanidine is specifically preferred. Examples of preferred phthalic acid ammonium salt or oxalic acid ammonium salt include guanidine phthalate and guanidine oxalate.

The developing agent, compound represented by formula (I) or (II), and a ammonium salt of phthalic acid or oxalic acid can be incorporated according to the commonly known method, including a method of adding it in the form of an aqueous solution and incorporation through solution in a hydrophilic organic solvent such as methanol or acetone. Further, a compound exhibiting high hydrophobicity is dissolved in a high boiling solvent such as dibutyl phthalate (DBP), tricresyl phosphate or dibutyl sebacate and incorporated in the form of an oil-in-water type dispersion.

The base or base precursor is incorporated Preferably in an amount of 0.1 to 20 g/m$^2$, and more preferably 0.5 to 10 g/m$^2$.

The processing element used in this invention preferably contains a silver halide solvent or a development inhibitor. These compounds may be contained in combination thereof, or plural of the compound may be contained.

To remove unnecessary silver halide after image formation, a compound capable of fixing may be allowed to be contained in the processing element. In one embodiment of such a system, physical development nuclei and a silver halide solvent are contained in the processing element and silver halide of the photographic material is solubilized with heating and fixed in the processing layer. The solublized silver salt which has been diffused from the photographic material is reduced on the physical development nuclei and converted to physical-developed silver to be fixed in the processing layer. There can be employed commonly known physical development nuclei such as colloidal particles of heavy metals including zinc, cadmium, iron, chromium, nickel, tin, cobalt, cupper and ruthenium; noble metals including palladium, platinum, silver and gold; and chalcogen (e.g., sulfur, selenium, tellurium) compounds of these metals. Such physical development nuclei can be obtained by reducing the corresponding metal ion with a reducing agent such as ascorbic acid, sodium hydrogen borate, or hydroquinone to form a metal colloid dispersion or by mixing a soluble sulfide, selenide or telluride solution to form a colloida dispersion of a water-insoluble metal sulfide, metal selenide or metal telluride. Such a dispersion is preferably formed in a hydrophilic binder such as gelatin.

Preparation of colloidal silver particles is described in U.S. Pat. No. 2,688,601. There may be optionally conducted desalting to remove soluble salts, as is known in the preparation of silver halide emulsions. The size of the physical development nuclei is preferably 2 to 200 nm. The physical development nuclei is incorporated usually in an amount of $10^{-3}$ to 100 mg/m$^2$, and preferably $10^{-2}$ to 10 mg/m$^2$. In a coating solution containing a hydrophilic binder, for example, silver nitrate and sodium sulfide, or chloroauric acid and a reducing agent may be reacted with each other to cause nucleation. Silver, silver sulfide or palladium sulfide is preferably used as nuclei for physical development.

To fix silver halide in such a system, a reducing agent capable of causing physical development needs to be present in the layer containing physical development nuclei. A non-diffusible reducing agent has to be incorporated into the layer; and a diffusible reducing agent may be contained in either the photographic material or the processing element. As a reducing agent having such a function, commonly known auxiliary developing agents are preferably employed.

Silver halide may be fixed without using physical development nuclei or a reducing agent. In such as case, so-called salt substitution for a silver ion is caused by the silver halide solvent to form a light-insensitive silver salt.

In either case, silver halide solvents known in the photographic art are usable. Thus, thiosulfates, thiosulfites, thiocyanates, thioether compounds such as 1,8-di-3,6-dithiaoctane, 2,2'-thiodiethanol, and 6,9-dioxa-3,12-dithiatetradecane-1,14-diol described in JP-B No. 47-11386, compound containing 5- or 6-membered imide ring such as uracil and hydantoin described in Japanese Patent Application No. 6-325350, mercapto compounds, thiouracil compounds, nitrogen-containing heterocyclic compounds containing a sulfide group described in JP-A 4-365037 at page 11–21, and 5-66540 at page 1088–1092, and the compound of formula (I) described in JP-A 53-144319. Meso-ion thiolate compounds of trimethyltriazolium thiolate described in Analytica Chemica.Acta, vol. 248, page 604–614 (1991) are also preferred. Compounds described in Japanese Patent 89 4573 Application 6-206331, which fix silver halide to stabilize it, is also usable. These silver halide solvents may be used in combination. Of the foregoing compounds, sulfites and 5- or 6-membered imide ring compounds such as uracil and hydantoin are more preferred. Specifically, Incorporation of uracil or hydantoin in the form a potassium salt leads to an improvement in deteriorated glossiness during storage.

The total content of a silver halide solvent in the processing layer is preferably 0.01 to 100 mmol/m$^2$, more preferably 0.1 to 50 mmol/m$^2$, and still more preferably 1 to 30 mmol/m$^2$. The molar ratio of the silver halide solvent to silver coverage of a photographic material is preferably 1/20 to 20, more preferably 1/10 to 10, and still more preferably 1/3 to 3. The silver halide solvent may be added into a solvent such as water, methanol; ethanol, acetone, dimethylformamide or methylpropyl glycol, or an aqueous alkaline or acidic solution. Alternatively, it may be added to a coating solution in the form of a solid particle dispersion.

Preferred silver solvent and/or development inhibitor include, for example, diols described in JP-A 55-28099; mercapto inhibitors having an amino endo-group; mercaptobenzoazoles, mercaptodiazoles and mercaptotetrazoles; hydrophobic group-containing, mercaptotetrazoles, mercaptobenzoazoles and mercaptoazoles described in JP-A 1-167750; and 1,3-sulfur-nitrogen compounds described in JP-A 6-51474. The silver solvent and/or development inhibitor is added preferably in an amount of 0.0001 to 100 mmol/m$^2$, and more preferably 0.01 to 20 mmol/m$^2$.

The processing element preferably contains a halide ion of 1 to 50 mmol/m$^2$. The halide ion usable in halide ion content of less than 1 mmol/m$^2$ results in increase stain as well as increased fogging, and the content of more than 50 mmol/m$^2$ retards development, making it difficult to attain the maximum density. In cases where the halide ion is directly added to the processing element, the chloride ion-providing materials include, for example, sodium chloride, potassium chloride, ammonium chloride, nickel chloride, magnesium chloride, manganese chloride, calcium chloride, and cadmium chloride. Preferred of these are sodium chloride and potassium chloride. Bromide ion-supplying sources include, for example, sodium bromide, potassium bromide, ammonium bromide, lithium bromide, calcium bromide, magnesium bromide, manganese bromide bromide, nickel bromide, cadmium bromide, cerium bromide, and thallium bromide. Preferred of these are potassium bromide and sodium bromide. The halide ion may be incorporated in the form of a counter ion of other additives.

The processing element used in this invention preferably contains a compound represented by the following formula (7):

formula (7)

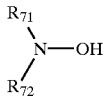

wherein $R_{71}$ and $R_{72}$ each represent a hydrogen atom or a substituted alkyl group. The substituents of the alkyl group include, for example, a sulfonic acid group, hydroxy group, alkoxy group such as methoxy, ethoxy or propyloxy, carboxy group, amino group, phosphonic acid group, phosphinic acid group and sulfinic acid group. The compound of formula (7) is contained preferably in an amount of 1 to 50 mmol/m$^2$, and more preferably 3 to 25 mmol/m$^2$. An insufficient content results in deteriration of a developing agent and an excessive content leads to a reduced dye-forming rate and reduced maximum density.

Exemplary examples of the compound represented by formula (7) are shown below but are not limited to these.

7-1

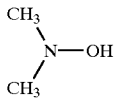

7-2

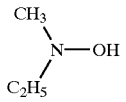

7-3

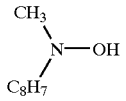

7-4

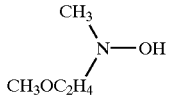

7-5

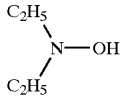

-continued
7-6
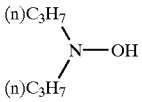
7-7
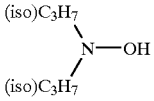
7-8
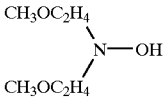
7-9
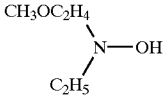
7-10
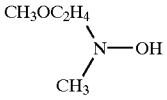
7-11
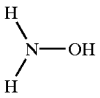
7-12
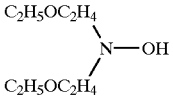
7-13
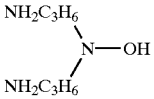
7-14
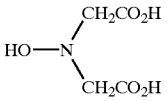
7-15
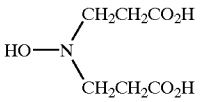
7-16
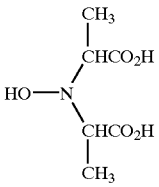
7-17
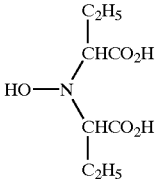
-continued
7-18
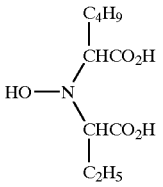
7-19
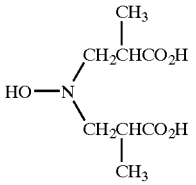
7-20
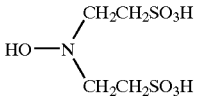
7-21
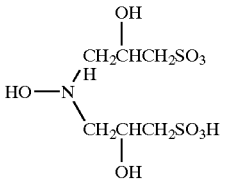
7-22
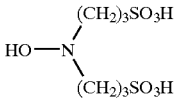
7-23
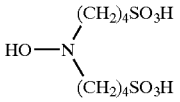
7-24
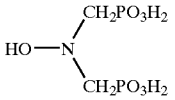
7-25
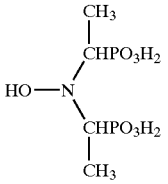
7-26
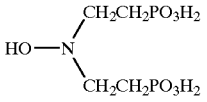
7-27
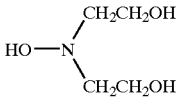
7-28
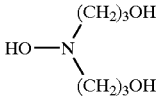

-continued
7-29
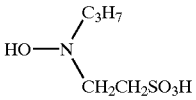
7-30
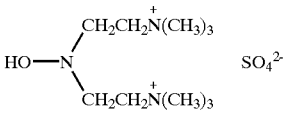
7-31
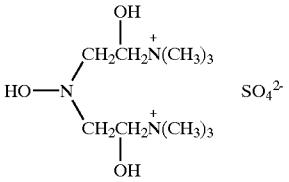
7-32 $HONHCH_2CO_2H$
7-33 $HONHCH_2CH_2CO_2H$
7-34 $HONHCH(CH_3)CO_2H$
7-35 $HONHCH(C_2H_5)CO_2H$
7-36 $HONHCH(C_4H_9)CO_2H$
7-37 $HONHCH(CH_3)CH_2CO_2H$
7-38 $HONHCH_2CH(CH_3)CO_2H$
7-39 $HONHCH_2CH_2SO_3H$
7-40 $HONHCH_2CH(OH)CH_2SO_3H$
7-41 $HONH(CH_2)_3SO_3H$
7-42 $HONH(CH_2)_4SO_3H$
7-43 $HONHCH_3PO_3H_2$
7-44 $HONHCH(CH_3)PO_3H_2$
7-45 $HONHCH_2CH_2PO_3H_2$
7-46 $HONHCH_2CH_2OH$
7-47 $HONH(CH_2)_3OH$
7-48 $HONHCH_2PO_3H_2$
7-49
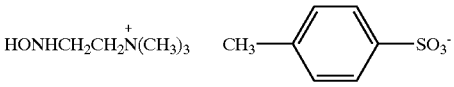
-continued
7-50
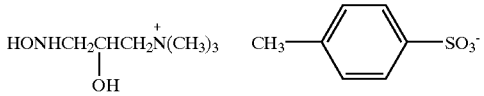
7-51
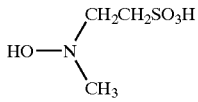
7-52
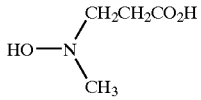
7-53
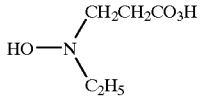
7-54
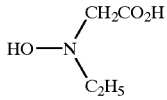
7-55
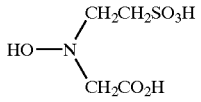
7-56
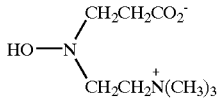
7-57
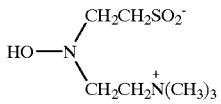
7-58
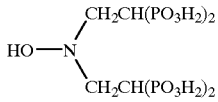
7-59 $HONHCH_2CH(PO_3H_2)_2$
7-60
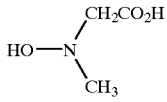
7-61
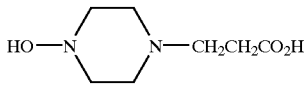
7-62
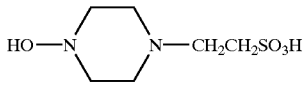
7-63
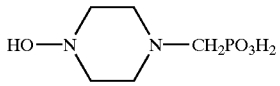
7-64
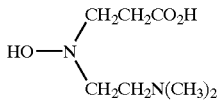

-continued 7-65

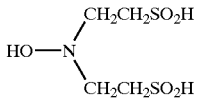

7-66

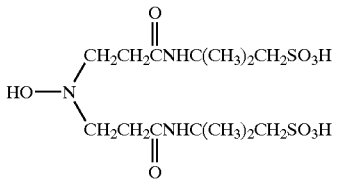

7-67

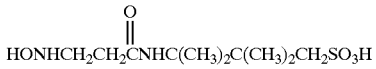

7-68

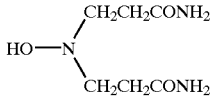

7-69

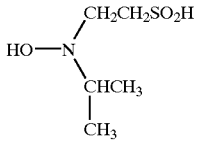

Of the exemplified compounds are specifically preferred compounds 7-5, 7-12 and 7-20. The compound of formula (79 can be readily synthesized according to the method known in the art.

In this invention, high temperature development is preferred. Thus, the high temperature development in the invention refers to development performed at a higher temperature relative to conventional development, preferably at a temperature of 43+ C. or more, and more preferably at a temperature of 55 to 95° C. When performing such high temperature development using the processing element of this invention, it is preferred to use a small amount of aqueous medium (including water) to accelerate development, to promote transfer of processing materials or to promote leaching-out of unwanted material. Specifically, the use of an aqueous medium is indispensable in the method of generating a base by using combination of a sparingly water-soluble basic metal compound and the compound capable of forming a complex with the metal ion constituting the basic metal compound. The aqueous medium may contain an inorganic alkali metal salt or an organic base, a low boiling solvent, a surfactant, an antifoggant, a compound forming a complex with a sparingly water-soluble metal compound, a ungicide, or an antiseptic. In this invention, solution containing the foregoing additives is also included in "water" used in this invention. Water or any aqueous medium used as dispersing medium is usable. Examples thereof include distilled water, tap water, well water, and mineral water. In the apparatus for performing high temperature development by the use of the photographic material and processing element, water or an aqueous medium may be used at one time or may be repeatedly use through recycling. In the latter case, water containing the leached-out components is to be used. There may be employed an apparatus or water (aqueous medium) described in JP-A 63-144354, 63-144355, 62-38460 and 3-210555. Water or the aqueous medium may be provided to both the photographic material and the processing element. The amount used therein is an amount corresponding to 1/10 to 1 of the amount necessary to allow the total coated layer (except for the back layer) to swell to its maximum level. The water-providing method described in JP-A Nos. 62-253159 and 63-85544 is preferably applicable. Allowing a solvent to be enclosed into a microcapsule or to be occluded, in the form of a hydrate, in either or both of the photographic material and processing element is feasible. The temperature of the water or aqueous medium to be provided is preferably 30 to 60° C., as described in JP-A 63-85544.

The expression "in the presence of water or an aqueous medium" means that water exists in at least one of a component layer provided on the emulsion side of a photographic material and a component layer of the processing element. Apparatus for developing at a relatively high temperature In cases when developing the photographic material at a relatively high temperature, commonly known heating means are applicable, including a system of bringing it into contact with a heated block or a face heater, a system of bringing it into contact with a heated roller or heated drum, a system of bringing into contact with an infrared or far-infrared lamp heater, a system of allowing it to pass through an atmosphere maintained at a high temperature, and a method of employing a high frequency heating system. In addition thereto, a system is also applicable, in which an exothermic conductive material is provided on the back side of the photographic material or an image receiving element and electrically generated Joule heat is employed. In such a case, an exothermic element described in JP-A 61-145544 can be employed. There can be applicable a method of superposing the processing element on the photographic material, in the form of the photosensitive layer facing the processing layer, as described in JP-A 62-253159 and 61-147244. Further, it is preferred to pre-heat the processing element, prior to superposition thereof, at a temperature of 80 to 150° C. for a period of 10 to 300 sec.

A various types of apparatuses for processing the photographic material including the processing element of the invention at a relatively high temperature can be employed and the apparatuses described in JP-A Nos. 59-75247, 59-177547, 59-181353, 60-18951; Japanese Utility Model open to public inspection publication No. 62-25944; Japanese Patent Application Nos. 4-277517, 4-243072, 4-244693, 6-164421 and 6-164422 are preferably employed. Examples of commercially available apparatuses include Pictrostat 100, Pictrostat 200, Pictrostat 300, Pictrostat 330, Pictrostat 50, Pictrography 300 and Pictrography 2000 (all of which are available from Fuji Photo Film Co., Ltd.).

As a sparingly water-soluble metal compound contained in the photographic material, the compounds afore-mentioned can be employed. An aqueous complexing agent-containing solution or a solution exhibiting a pH of 9.5 or more can be obtained by dissolving the afore-mentioned compounds.

In one embodiment of this invention, water is provided to the photographic material or the processing element by a coating system or a system of supplying droplets via a gas phase. Various means are applicable for such systems and examples thereof include a water-coating means of coating water onto the material to be provided with water, such as a curtain coater; and a water-ejecting means of ejecting water by applying pressure to water with a pressure-applying means, such as an ink-jet head or spray bar of a ink-jet printer.

The expression "supplying droplets via a gas phase" means that the liquid-supplying section supplies droplets of water through a gaseous space without being brought into contact with the surface of material to be supplied. Of means for supplying liquid through the gas phase, a water-ejecting means of causing water to be ejected by a pressurizing means i-s specifically preferred, and a water-supplying means having a water-supplying route to a water pressure room in which water is pressurized by a pressurizing means. The pressurizing means is preferably pressurization employing compressed air, a solenoid, liquid boiling or deformation by an electricity-machine conversion means. Examples of deformation by an electricity-machine conversion means include a piezo element. The water-supplying means used in this invention is preferably a type causing water to be ejected through a nozzle. The area of a single aperture in the nozzle aperture section is preferably 500 to 10000 $\mu m^2$, and more preferably 1000 to 8000 $\mu m^2$ in terms of ejection stability. The aperture may be a circular, square or elliptic form. The distance between the nozzle aperture section and a material to be supplied with water is preferably 50 $\mu$m to 5 mm, and more preferably 100 $\mu$m to 1 mm. To supply sufficient water to the material by the water-supplying means, water is preferably supplied in an amount of 30 to 500 mg, and more preferably 40 to 300 mg per one time, and 500 to 20000 times, and more preferably 1000 to 1500 times per second. In this invention, the liquid-supplying amount refers to the ejection amount per one nozzle at one time or the amount of a single droplet. The number of the nozzle apertures is preferably 1 to 100 in terms of the water-supplying amount and life of the water-supplying means. Supplying liquid through gas phase can be conducted using the method known in the art, as described in U.S. Pat. No. 5,698,382 and WO98/19216.

Supplying water by a coating system is to supply water through coating to the material surface by bringing a water-supplying means into contact with the material surface or by providing a space equivalent to the thickness of water to be supplied between the water-supplying means and the material surface. In this case, it is excluded to allow the material to immerse in a tank filled with water so as to allow the component to be permeated into the material through diffusion from a bulk solution. Such water-supplying means include, for example, an air doctor coater, a blade coater, a rod coater, a knife coater, a squeeze coater, an impregnation coater, a reverse coater, transfer coater, a curtain coater, a double roller coater, a slide hopper coater, a gravure coater, a kiss roll coater, a bead coater, a cast coater, a. spray coater, a calender coater and an extrusion coater.

The amount of water to be supplied is preferably 35 to 200 ml/m$^2$, and more preferably 60 to 120 ml/m$^2$. In cases when the amount of water is insufficient, dissolution of a water-soluble compound supplied from the processing element is insufficient, deactivating development. An excessive water supply dilutes the concentration of the water-soluble compound, also deactivating development. The temperature of water to be supplied is preferably 15 to 50° C. The swelling (or water-absorbing) speed of the layer is insufficient at a temperature of less than 15° C. and non-uniform swelling of the layer easily occurs at a temperature of more than 50° C.

The surface tension of water or the aqueous medium is preferably $15\times10^{-3}$ to $60\times10^{-3}$ N/m, and more preferably $18\times10^{-3}$ to $45\times10^{-3}$ N/m. In the case of being less than the lower limit, the amount of water supplied is not stabilized and in the case of more than the upper limit, water supplied water does not uniformly spread, leading to unevenness in processing. The surface tension can be controlled by selecting the kind of a surfactant or solvent, or by adjusting the amount of a surfactant or solvent. The surface tension can be measured by any commonly known method, for example, as described in "Analysis and Test of Surfactant" by F. Kitahara, S. Hayano & I. Hara (Mar. 1, 1938, published by Kodan-sha). In this invention, the surface tension is one which was measured at 25° C. by any conventional method. Water-soluble surfactants are preferably employed to control the surface tension in this invention. Exemplary examples thereof are described in RD308119, page 1005, XI.

The viscosity of water or the aqueous medium is preferably 1.5 to 10 cp, more preferably 1.6 to 8 cp, and still more preferably 1.8 to 5 cp. In cases of being less than 1.5 cp, the amount of water supplied is not stabilized and in the case of more than 10 cp, the supplied water does not uniformly spread, leading to unevenness in processing. The viscosity can be controlled, for example, by allowing a water-soluble polymer to be contained within the range which does not adversely affect processing performance, by controlling a salt concentration within the range of not adversely affecting processing performance, or by allowing a hydrophilic solvent to be contained, but means therefore is not limited to these. Examples of the water-soluble polymer include vinyl polymers and their derivatives such as polyvinyl alcohols, polyvinyl pyrrolidones, polyvinyl pyridinium halide, and various modified polyvinyl alcohols; acryl group-containing polymers such as polyacrylamide, polydimethylacrylamide, polydimethylaminoacrylate, poly(sodium acrylate), acrylic acid/methacrylic acid copolymer, poly(sodium methacrylate), acrylic acid/vinyl alcohol copolymer; natural polymeric materials and their derivatives such as starch, oxidized starch, carboxyl-starch, dialdehyde starch, cationic starch, dextrin, sodium alginate, Arabic gum, casein, pulullan, dextran, methyl cellulose, ethyl cellulose, carboxymethyl cellulose, and hydroxymethyl cellulose; and synthetic polymers such as polyethylene glycol, polypropylene glycol, polyvinyl ether, polyglycerine, maleic acid/alkyl vinyl ether copolymer, maleic acid/N-vinylpyrrole copolymer, styrene/anhydrous maleic acid copolymer and polyethyleneimine. Of these polymers, polyvinyl pyrrolidones, polyvinyl alcohols and polyalkylene glycols are preferred.

The electroconductivity of water or the aqueous medium used in this invention is preferably 0.01 to 1000 $\mu$s/cm at 25° C. The electroconductivity can be readily measured by the method as defined in JIS K 0400-13-10 (1999). In cases when water or aqueous medium exhibiting excessively high electroconductivity is used, electrolytes existing therein adversely affect development performance, resulting in unacceptable unevenness in density when repeatedly employed. The electroconductivity is more preferably 0.01 to 600 $\mu$s/m. In cases where a water-supplying apparatus is provided with an electroconductivity monitor, commonly known ohm meter can be employed and a sensor using two platinum electrodes, for example, can be employed. A system of automatically exchanging water or an aqueous medium with fresh water or a system of warning such exchange through warning buzzer when the monitored electroconductivity exceeds the foregoing upper limit, may be installed along with the electroconductivity monitor.

The remaining free chlorine concentration is preferably 0.1 to 200 ppm. The remaining free chlorine concentration can be measured by the method defined in JIS K 0400-3 (1999). In cases when water or an aqueous medium exhibiting excessively high remaining free chlorine concentration is used, electrolytes existing therein adversely affect development performance, resulting in unacceptable unevenness in density when repeatedly employed. At a concentration of less than 0.1 ppm, bactericidal action is reduced and water-insoluble substances are liberated, causing image defects. The remaining free chlorine concentration is more preferably 0.2 to 150 ppm.

Water or an aqueous medium which has been filtered with a filter having a filtering diameter of 0.015 to 10 $\mu$m is preferred. Examples of filters usable in this invention include commercially available polysulfon membrane filter having a filtering mesh diameter of 0.02, 0.025, 0.1, 0.22, 0.33, 0.65, 1.2, 3.0, 5.0 or 8.0 $\mu$m. The use of such filtered water or aqueous medium removes insoluble substance larger than the removal limit, leading to prevention of image defects and enhanced closeness at the time of superposing materials, and thereby resulting in images exhibiting no non-uniformity in density.

It is preferred that after providing water or an aqueous medium, the processing element superposed on the photographic material is compressed at a pressure of 4 to 200 $N/m^2$ at least once. Thereby, the compression removes excess water or aqueous medium, uniformly providing water or the aqueous medium, further leading to enhanced closeness between the photographic material and the processing element, after superposition thereof. In the case of pressure less than 4 $N/m^2$, such effects cannot be achieved and in the case of more than 200 $N/M^2$, excessive load often causes damage to the material or peeling troubles occur when peeling the processing element from the photographic material. Compression is preferably conducted by allowing the superposed material to pass between paired squeegee rollers.

It is preferred to heat the photographic material or the processing element at a temperature of 20 to 150° C. before or during development. It is contemplated that such heating enhances permeation of water and its uniformity, leading to reduced non-uniformity in processing and reduced density variation in repeated processing. Heating can be conducted in a commonly known manner such that the material is allowed to pass between rollers heated to a given temperature, the material is allowed to pass through a vessel heated to a given temperature or the material is allowed to be transported while being in contact with a belt heated to a given temperature. Of these, it is preferred to allow the material to pass between heated rollers. The heating temperature is preferably 40 to 90° C.

In this invention, the time of from providing water or an aqueous medium to the photographic material or processing element to the start of development is preferably 15 to 300 sec. In cases of less than 15 sec., permeation of water or an aqueous medium progrsses non-uniformly, resulting in uneven diffusion of water-soluble compounds contained in the material. It was proved that in the case of more than 300 sec., water was partially vaporized, causing unevenness at the periphery of the material or causing a secondary reaction to adversely affect development.

Images obtained according to this invention are read using an image sensor such as a scanner or CCD camera and converted to electronic image information. The scanner used in this invention is an apparatus of converting reflection or transmission density obtained by optically scanning a processed photographic material to image information. Scanning the processed photographic material is generally or preferably conducted in such a way that the optical portion of a scanner is allowed to move in a direction different from the moving direction of the processed photographic material. However, the processed photographic material may be fixed and the optical portion of the scanner alone may be moved; alternatively, the optical portion of the scanner may be fixed and the processed photographic material alone may be moved. The combination thereof may also be conducted. Image information of the processed photographic material is preferably read in such a manner that at least three lights having different wavelengths, each of which is within the wavelength region of dye absorption, are irradiated overall or by scanning through a slit to measure the reflected or transmitted light. In this case, diffuse light is more preferable to remove information due to a matting agent or flaws, rather than specular light. A semiconductor image sensor (e.g., area-type CCD, CCD line-sensor, etc.) is preferably employed in the receptor section. The processing element may or may not exist in image reading.

The thus obtained image date can be viewed using various types of image display apparatuses. Examples thereof include a color or black-and-white CRT, a liquid crystal display, a plasma emission display, and an EL display.

Further, the thus read image signals can be outputted onto a recording material to form images. Besides silver halide photographic materials, various recording materials can be employed using various types of hard copying apparatuses, including an ink-jet system, sublimation type thermal transfer system, melt type thermal transfer system, electrophotography system, Cycolor system, thermoautochrome system, silver halide color paper system and silver halide photothermography system.

In one embodiment of this invention, image information of a developed photographic material, not having been subjected to bleaching and fixing treatments is read with an image sensor such as a scanner and converted to digital image information. Thereby, bleaching and fixing solutions can be saved and the processing time is also shortened. After developing a silver halide photographic material, developed images are converted to digital image information, so that it is not necessary to store images of the silver halide photographic material itself and such a process can be eliminated. The bleaching and fixing treatments are described in "Shashin Kogaku no Kiso (Basis of Photographic Engineering), edited by the Japanese Society of Photographic Science and Engineering (First edition, 1979) at section 4.2.3. and 4.3.3.

In image sensors such as a scanner, infrared rays are preferably employed. Since the developed silver halide photographic material is not fixed nor bleached, electronic noise caused by developed silver and silver halide remaining in the photographic material. also remain when reading images of the photographic material with an image sensor such as a scanner. However, when image data of such noise is read using an infrared ray, the noise can be corrected via the digital image information to obtain superior digital image information.

EXAMPLES

The present invention will be described based on examples but embodiments of the invention are by no means limited to these examples.

Example 1

Preparation of Seed Emulsion T-1

Seed emulsion T-1 comprised of seed grain having two parallel twin planes was prepared according to the following procedure.

| A-1 Solution | |
|---|---|
| Ossein gelatin | 38.0 g |
| Potassium bromide | 11.7 g |
| Water to make | 34 lit. |
| **B-1 Solution** | |
| Silver nitrate | 810.0 g |
| Water to make | 3815 ml |
| **C-1 Solution** | |
| Potassium bromide | 567.3 g |
| Water to make | 3815 ml |
| **D-1 Solution** | |
| Ossein gelatin | 163.4 g |
| $CH_3.HO(CH_2CH_2O)m(CHCH_3O)_{19.8}(CH_2CH_2O)nH$ (m + n = 9.77, 10% ethanol solution) | 5.5 ml |
| Water to make | 3961 ml |
| **E-1 Solution** | |
| Sulfuric acid (10%) | 91.1 ml |
| **F-1 Solution** | |
| Aqueous 56% acetic acid solution | necessary amount |
| **G-1 Solution** | |
| aqueous ammonia (28%) | 105.7 ml |
| **H-1 Solution** | |
| Aqueous potassium hydroxide (10%) | necessary amount |

To solution A-1 with vigorously stirring at 30° C. by the use of a stirrer described in JP-A 62-160128 was added solution E-1 and then, solutions B-1 and C-1, each 279 ml, were added by the double jet addition at a constant flow rate for a period of 1 min. to form silver halide nucleus grains. Subsequently, solution D-1 was added thereto and after the temperature was raised to 60° C. in 31 min., solution G-1 was further added, and after adjusting the pH to 9.3 with solution H-1, ripening was carried out for 6.5 min. Then after the pH was adjusted to 5.8 with solution F-1, residual B-1 and C-1 solution were added by the double jet method for a period of 37 min. and the emulsion was immediately desalted. From electron microscopic observation of the resulting seed emulsion, it was proved that the emulsion was comprised of monodisperse silver halide seed grains having two parallel twin planes, an average grain diameter (equivalent circle diameter) of 0.72 μm and a grain diameter distribution of 16%.

Preparation of Tabular Grain Emulsion Em-1

Using seed emulsion T-land the following solutions, a emulsion (Em-1) was prepared.

| A-2 Solution | |
|---|---|
| Ossein gelatin | 519.9 g |
| $CH_3.HO(CH_2CH_2O)m(CHCH_3O)_{19.8}(CH_2CH_2O)_nH$ (m + n = 9.77, 10% ethanol solution) | 4.5 ml |
| Seed emulsion (T-1) | 5.3 mol equivalent |
| Water to make | 18.0 lit. |
| **B-2 Solution** | |
| 3.5N Silver nitrate aqueous solution | 2787 ml |
| **C-2 Solution** | |
| Potassium bromide | 1020 g |
| Potassium iodide | 29.1 g |
| Water to make | 2500 ml |

-continued

| D-2 Solution | |
|---|---|
| Potassium bromide | 618.5 g |
| Potassium iodide | 8.7 g |
| Water to make | 1500 ml |
| **E-2** | |
| Potassium bromide | 208.3 g |
| Water to make | 1000 ml |
| **F-2 Solution** | |
| Aqueous 56 wt. % acetic acid solution | Necessary amount |
| **G-2 Solution** | |
| Potassium bromide | 624.8 g |
| Water to make | 1500 ml |
| **H-2 Solution** | |
| Fine grain emulsion* comprised of 3.0 wt. % gelatin and fine silver iodide grains (average diameter of 0.05 μm) | 0.672 mol equivalent |
| **I-2 Solution** | |
| Aqueous solution containing thiourea dioxide of $1.4 \times 10^{-6}$ mol/mol Ag | 10 ml |
| **J-2 Solution** | |
| Aqueous solution containing sodium ethylthiosulfonate of $1.4 \times 10^{-6}$ mol/mol Ag | 100 ml |
| **K-2 Solution** | |
| Aqueous 10% potassium hydroxide solution | Necessary amount |

*Preparation
To 9942 ml of a 5.0 wt. % gelatin aqueous solution containing 0.254 mol potassium iodide was added 3092 ml of an aqueous solution containing 10.59 mol silver nitrate and 3092 ml of an aqueous solution containing 10.59 mol potassium iodide at a constant flow rate for 35 min. During addition, the temperature was maintained at 40° C., and the pH and EAg were not specifically controlled.

To a reaction vessel was added solution A-2 and after adding solution I-2, solutions B-2, C-2 and D-2 were added with vigorously stirring at 75° C. by the double jet addition, as shown below, so that the seed grains were allowed to grow to prepare a comparative silver halide grain emulsion Em-1. Herein, taking into account a critical growth rate, solutions B-2, C-2 and D-2 were added at an accelerated flow rate so that production of fine grains other than growing seed grains and widening of grain diameter distribution due to Ostwald ripening between growing grains did not occur. Grain growth was performed in a manner such that the first addition was conducted, while the temperature, pAg and pH of a solution within a reaction vessel were controlled at 75° C., 8.9 and 5.8, respectively. In the first addition, 65.8% of solution B-2 was added. Thereafter, the temperature was raised to 60° C. in 15 min., solution H-2 was added at a constant flow rate for a period of 2 min. and then the second addition was conducted while controlled at a temperature of 60° C., a pAg of 9.4 and a pH of 5.0, in which residual B-2 was added. The pAg and pH were each controlled by adding solutions E-2, F-2 and K-2. After completing grain formation, the emulsion was desalted according to the procedure described in JP-A 5-72658 and re-dispersed by adding gelatin thereto to obtain an emulsion with a pAg of 8.06 and a pH of 5.8. From electron microscopic observation of silver halide emulsion grains, it was proved that the resulting emulsion was comprised of monodispersed, hexagonal tabular silver halide grains having an average diameter of 1.50 μm, a grain diameter distribution of 14% and an average aspect ratio of 7.0.

| Added solution | Add. time (min) | Added silver amount (%) | Iodide content* (mol %) | Remark |
|---|---|---|---|---|
| B-2 | 0.00 | 0.0 | 2.0 | 1st |
| C-2 | 5.26 | 11.7 | 2.0 | Addition |
| | 8.63 | 21.2 | 2.0 | |
| | 12.65 | 34.8 | 2.0 | |
| | 12.81 | 47.3 | 2.0 | |
| | 19.85 | 65.8 | 2.0 | |
| B-2 | 0.00 | 65.8 | 1.0 | 2nd |
| D-2 | 6.23 | 73.8 | 1.0 | Addition |
| | 12.62 | 82.5 | 1.0 | |
| | 18.67 | 91.1 | 1.0 | |
| | 24.42 | 100.0 | 1.0 | |

Chemical Sensitization Spectral Sensitization

Emulsion Em-1 was divided to small amounts and to each of them were added spectral sensitizing dyes, optimal amounts of sodium thiocyanate, sodium thiosulfate, triethylthiourea, chloroauric acid, and 1-(3-acetoamidophenyl)-5-mercaptotetrazole (AF-5) were added and the emulsion was ripened at 50° C. over a optimal period of time. After completion of ripening, the emulsion was cooled and stabilizer ST-1 and antifoggant AF-5 were added thereto to obtain red-sensitive silver halide emulsion-1, green-sensitive silver halide emulsion-1, and blue-sensitive silver halide emulsion-1. Sensitizing dyes added to each emulsion were added as follows, in which the amount is per mol of silver halide:

| | |
|---|---|
| Red-sensitive silver halide emulsion-1 | |
| Sensitizing dye (SD-1) | 0.04 mmol |
| Sensitizing dye (SD-2) | 0.07 mmol |
| Sensitizing dye (SD-3) | 0.04 mmol |
| Sensitizing dye (SD-4) | 0.13 mmol |
| Green-sensitive silver halide emulsion-1 | |
| Sensitizing dye (SD-5) | 0.04 mmol |
| Sensitizing dye (SD-6) | 0.03 mmol |
| Sensitizing dye (SD-7) | 0.17 mmol |
| Sensitizing dye (SD-8) | 0.02 mmol |
| Sensitizing dye (SD-9) | 0.02 mmol |
| Sensitizing dye (SD-10) | 0.02 mmol |
| Blue-sensitive silver halide emulsion-1 | |
| Sensitizing dye (SD-11) | 0.19 mmol |
| Sensitizing dye (SD-12) | 0.06 mmol |

Preparation of Processing Element P-1

On a transparent subbed PEN base (85 $\mu$m thick), the following compositions were each successively coated to prepare processing element P-1. The amount of each additive is expressed in mg/m$^2$.

| | (mg/m$^2$) |
|---|---|
| 1st Layer | |
| Gelatin | 280 |
| Water soluble polymer (PS-2) | 12 |
| Surfactant (SU-3) | 14 |
| Hardener (H-5) | 185 |

-continued

| | (mg/m$^2$) |
|---|---|
| 2nd Layer | |
| Gelatin | 2400 |
| Water soluble polymer (PS-3) | 360 |
| Water soluble polymer (PS-1) | 700 |
| Water soluble polymer (PS-4) | 600 |
| High boiling solvent (OIL-3) | 2000 |
| Picolinic acid guanidine | 2800 |
| Potassium quinolinate | 225 |
| Sodium quinolinate | 180 |
| Surfactant (SU-3) | 24 |
| 3rd Layer | |
| Gelatin | 240 |
| Water soluble polymer (PS-1) | 24 |
| Hardener (H-5) | 180 |
| Surfactant (SU-3) | 9 |
| 4th Layer | |
| Gelatin | 220 |
| Water soluble polymer (PS-2) | 60 |
| Water soluble polymer (PS-3) | 200 |
| Potassium nitrate | 12 |
| Matting agent (PM-2) | 10 |
| Surfactant (SU-3) | 7 |
| Surfactant (SU-5) | 7 |
| Surfactant (SU-6) | 10 |

Further, photographic element P-1(A) was prepared in the same manner as P-1, except that picolinic acid-guanidine (or guanidine picolinate) used in the 2nd layer was removed and developing agent A-1 (1560 mg/m$^2$) was contained. Photographic element P-1(B) was prepared in the same manner as P-1, except that guanidine picolinate used in the 2nd layer was replaced by 10 mg/m$^2$ of guanidine terephthalate. Photographic element P-1(C) was prepared in the same manner as P-1, except that a hot water-soluble layer was provided between the 3rd and 4th layers and developing agent (A-1) was contained in the 4th layer. Photographic element P-1(D) was prepared in the same manner as P-1, except that a hot water-soluble layer was provided between the 3rd and 4th layers, and 2 g/m$^2$ of 2-diethylaminoethyl-1-mercaptotetrazole and 3 g/m$^2$ of gelatin were contained in the 1st layer.

Preparation of Silver Halide Emulsion

A silver halide emulsion which was comprised of monodisperse tabular silver iodobromide grains containing 3 mol % iodide and exhibiting ECD (circular equivalent diameter) of 0.59 $\mu$m, an average aspect ratio of 3.4 and a variation coefficient of grain diameter of 16%, was subjected to chemical sensitization and spectral sensitization similarly to emulsion Em-1 to obtain red-sensitive silver halide emulsion-2, green-sensitive silver halide emulsion-2, and blue-sensitive silver halide emulsion-2. Sensitizing dyes added to each emulsion were added as follows, in which the amount is per mol of silver halide:

| | |
|---|---|
| Red-sensitive silver halide emulsion-2 | |
| Sensitizing dye (SD-1) | 0.08 mmol |
| Sensitizing dye (SD-3) | 0.08 mmol |
| Sensitizing dye (SD-4) | 0.42 mmol |
| Green-sensitive silver halide emulsion-2 | |
| Sensitizing dye (SD-5) | 0.04 mmol |
| Sensitizing dye (SD-6) | 0.15 mmol |

-continued

| | |
|---|---|
| Sensitizing dye (SD-7) | 0.35 mmol |
| Sensitizing dye (SD-9) | 0.05 mmol |
| Blue-sensitive silver halide emulsion-2 | |
| Sensitizing dye (SD-11) | 0.38 mmol |
| Sensitizing dye (SD-12) | 0.11 mmol |

Preparation of Photographic Material 101

Using the thus obtained silver halide emulsions, the following photographic layer compositions were each successively coated on a transparent subbed PEN base (85 $\mu$m thick), to prepare processing element P-1. The amount of each additive is expressed in mg/m$^2$ and that of silver halide is represented by equivalent converted to silver.

| | |
|---|---|
| 1st Layer (Antihalation layer) | |
| gelatin | 800 |
| UV absorbent (UV-1) | 200 |
| High boiling solvent (OIL-2) | 200 |
| Zinc hydroxide | 500 |
| Dye (AI-1) | 280 |
| Dye (AI-2) | 240 |
| Dye (AI-3) | 400 |
| 2nd Layer (Cyan dye forming layer) | |
| Gelatin | 1000 |
| Red-sensitive silver halide emulsion-1 | 350 |
| Red-sensitive silver halide emulsion-2 | 290 |
| Color developing agent (A-1) | 520 |
| Cyan coupler (C-1) | 230 |
| Cyan coupler (C-2) | 160 |
| High boiling solvent (OIL-1) | 460 |
| High boiling solvent (OIL-2) | 130 |
| Antifoggant (AF-6) | 1 |
| 3rd Layer (Interlayer) | |
| Gelatin | 800 |
| Dye (AI-2) | 160 |
| Additive (HQ-2) | 20 |
| High boiling solvent (OIL-2) | 60 |
| Water soluble polymer (PS-1) | 60 |
| Zinc hydroxide | 500 |
| 4th Layer (Magenta dye forming layer) | |
| Gelatin | 1800 |
| Green-sensitive silver halide emulsion-1 | 350 |
| Green-sensitive silver halide emulsion-2 | 290 |
| Color developing agent (A-1) | 520 |
| Magenta coupler (M-1) | 400 |
| High boiling solvent (OIL-1) | 460 |
| High boiling solvent (OIL-2) | 90 |
| Antifoggant (AF-6) | 1 |
| Water soluble polymer (PS-1) | 20 |
| 5th Layer (Interlayer) | |
| Gelatin | 800 |
| Dye (AI-1) | 320 |
| Additive (HQ-1) | 6 |
| Additive (HQ-2) | 20 |
| High boiling solvent (OIL-1) | 75 |
| Zinc hydroxide | 300 |
| 6th Layer (yellow dye forming layer) | |
| Gelatin | 3200 |
| Blue-sensitive silver halide emulsion-1 | 670 |
| Blue-sensitive silver halide emulsion-2 | 550 |
| Color developing agent (A-1) | 520 |
| Yellow coupler (Y-1) | 1060 |
| High boiling solvent (OIL-1) | 450 |
| High boiling solvent (OIL-2) | 300 |
| Antifoggant (AF-6) | 2 |
| Water soluble polymer (PS-1) | 40 |

-continued

| | |
|---|---|
| 7th Layer (Interlayer) | |
| Gelatin | 1500 |
| Water soluble polymer (PS-1) | 60 |
| Zinc hydroxide | 700 |
| 8th Layer (protective layer) | |
| Gelatin | 1000 |
| Matting agent (WAX-1) | 200 |
| Water soluble polymer (PS-1) | 120 |

In addition to the above composition were added coating aids SU-1, SU-2 and SU-3; a dispersing aid SU-4; viscosity-adjusting agent V-1; stabilizers ST-1 and ST-2; antifoggants AF-1, AF-2, AF-3, AF-4 and AF-5; hardener H-1, H-2, H-3 and H-4; and antiseptic Ase-1. F-2, F-3, F-4 and F-5 were each added in amounts of 15.0 Mg/m$^2$, 60.01 mg/m$^2$, 50.0 mg/m$^2$, and 10.0 mg/m$^2$.

Further, photographic materials 101(A) was prepared in the same manner as photographic material 101, except that developing agent A-1 was removed. Photographic material 101(B) was also prepared in the same manner as photographic material 101, except that developing agent (A-1) and zinc hydroxide were removed.

PS-1

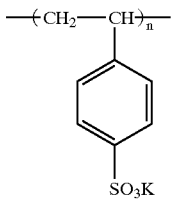

M.W. 100,000

PS-2

κ-carageenan (available from Wako Junyaku)

PS-3

Dextran (M.W. 700,000)

PS-4

MP polymer MP102 (available from Kuraray Co. Ltd.)

H-5

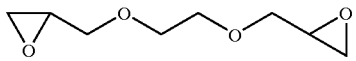

OIL-3

Liquid paraffin (available from KANTO KAGAKU

SU-3

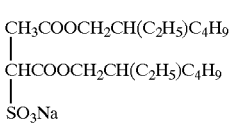

SU-5

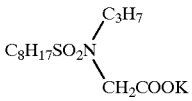

SU-6

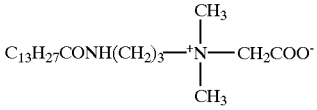

-continued
PM-2
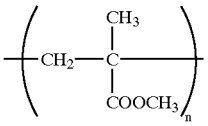
n: degree of polymerization
Weight-average M.W. 50,000
SD-1
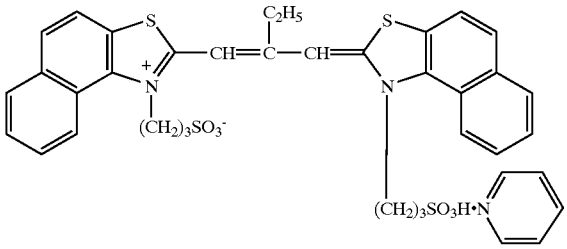
SD-2
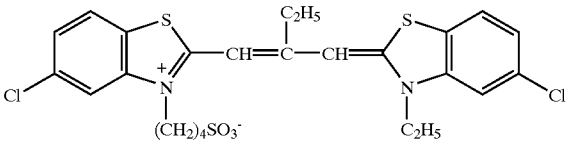
SD-3
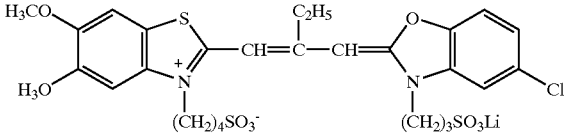
SD-4
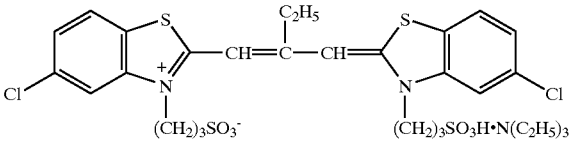
SD-5
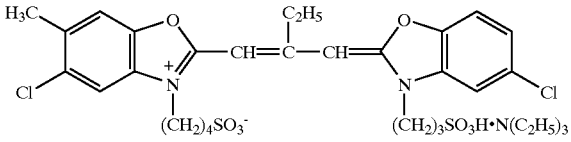
SD-6
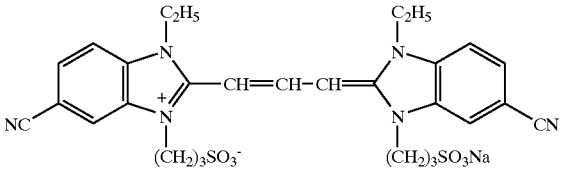
SD-7
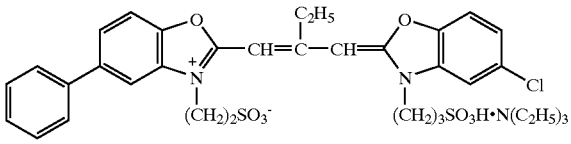
-continued
SD-8
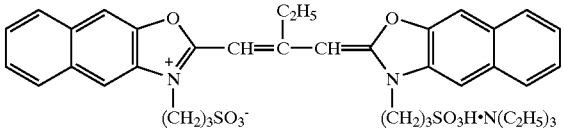
SD-9
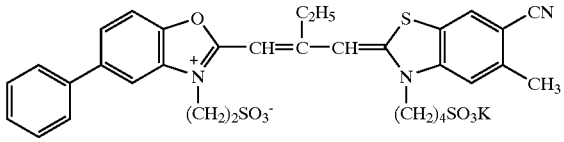
SD-10
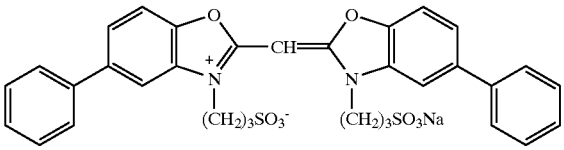
SD-11
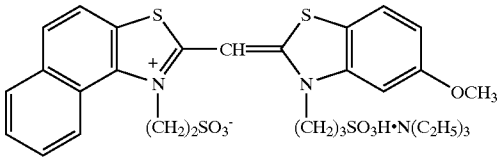
SD-12
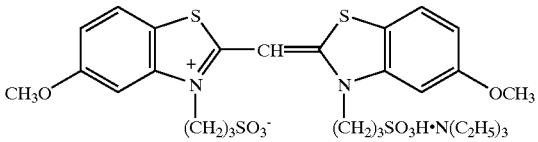
Al-1
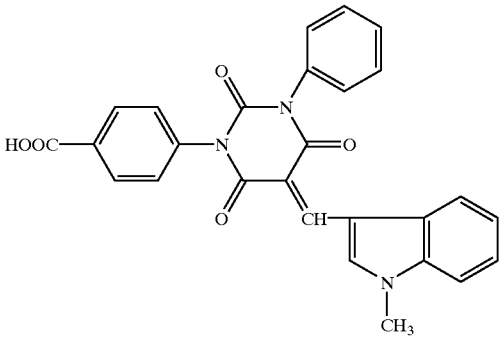
Al-2
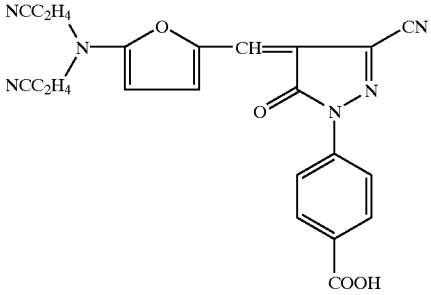

-continued
Al-3
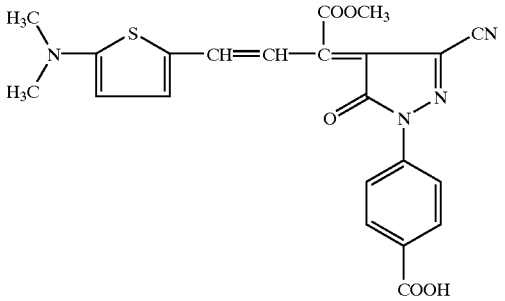
OIL-1
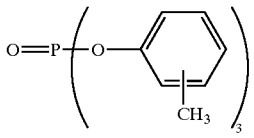
OIL-2
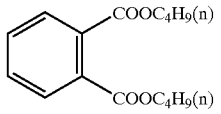
SU-4
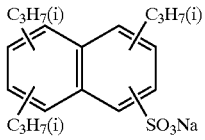
M-1
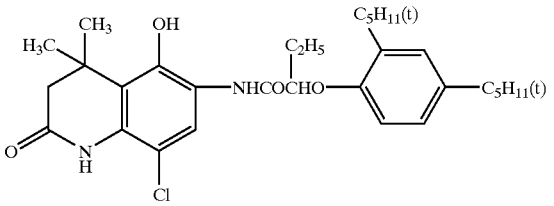
F-1
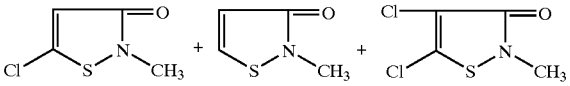
(50%) (46%) (4%)
(mole rate)
V-2
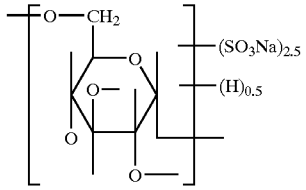
Weight-averaged M.W. 20,000
H-1
$[(CH_2{=}CH{-}SO_2CH_2)_3CCH_2SO_2CH_2CH_2]_{2/2}{-}NCH_2CH_2SO_3K$
H-2
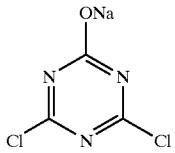
-continued
WAX-1
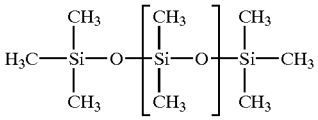
Weight-averaged M.W. 3,000
Y-1 (yellow coupler)
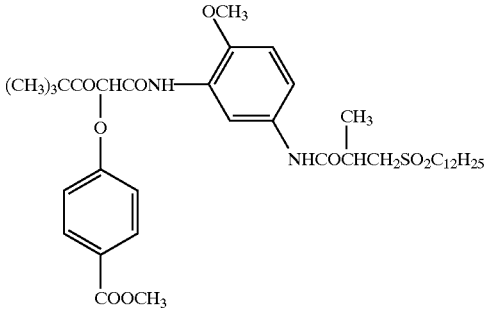
C-1 (cyan coupler)
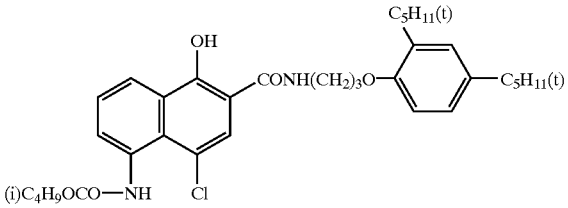
C-2 (cyan coupler)
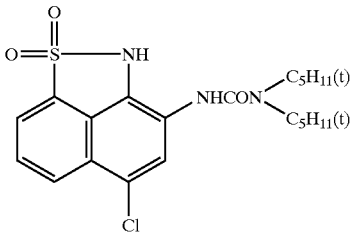
ST-1
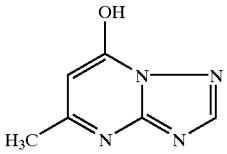
ST-2
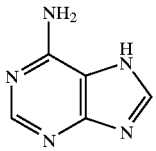
AF-1,2
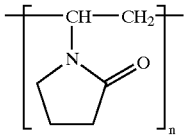
AF-1 M.W. ca.10,000
AF-2 M.W. ca.100,000
n: degree of polymerization -continued

AF-3

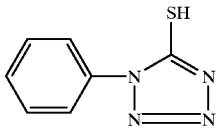

AF-4

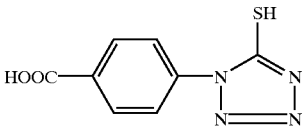

AF-5

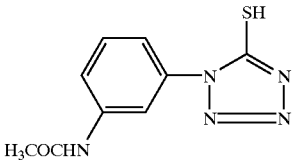

A-6

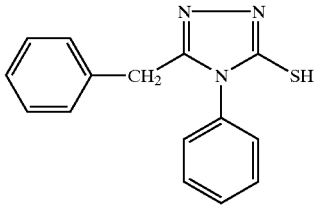

HQ-1

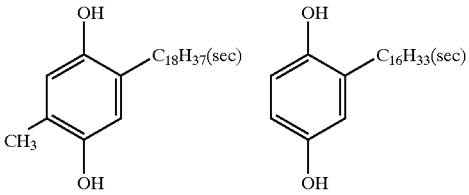

(mixture of 2:3)

HQ-2

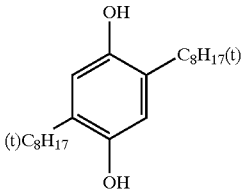

UV-1

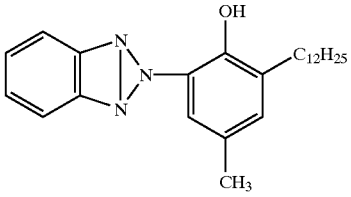

SU-1

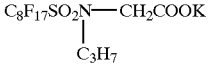

SU-2

$C_8F_{17}SO_2NH(CH_2)_3N^+(CH_3)_3Br^-$

SU-3

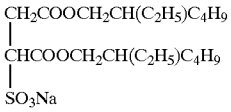

-continued

SU-4

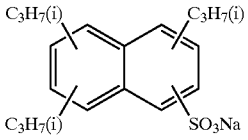

H-3

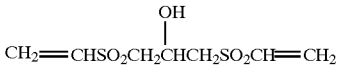

H-4

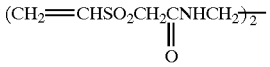

Fungicide (F-2)

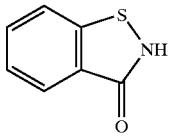

Fungicide (F-3)

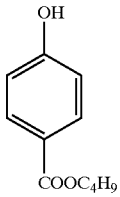

Fungicide (F-4)

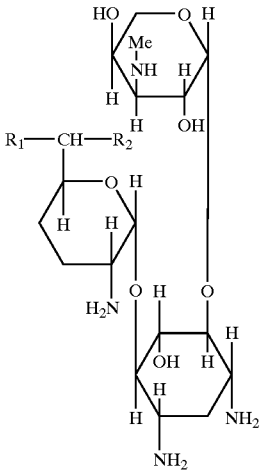

| | $R_1$ | $R_2$ |
|---|---|---|
| a | —Me | —NHMe |
| b | —Me | —$NH_2$ |
| c | —H | —$NH_2$ |
| d | —H | —NHMe |

(mixture, a:b:c:d = 1:1:1:1)

Fungicide (F-5)

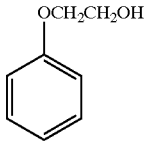

Color developing agent (A-1)

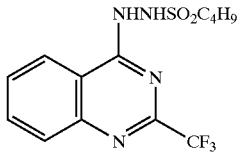

Preparation of Water-soluble Processing Film

Fine powdery PVA KURARIA HM (available from Kuraray Co., Ltd.) was dispersed in water and adding 3% glycerin, suspension was dissolved at 60° C. for 30 min. The solution was adjusted to a viscosity of 2000 mP·s at 25° C. using a B-type viscometer and then, the pH was adjusted to 6.5. The solution was cast onto polyethylene terephthalate (PET) film, was allowed to stand at a temperature of 60° C. for 4 hrs., and peeled off from the PET to obtain a 45 μm thick water-soluble processing film P-2.

Further, processing film P-2(A) was prepared similarly to P-2, provided that after forming the solution, developing agent A-1 (1560 mg/M$^2$) and zinc hydroxide (2000 mg/m$^2$) were added. Processing film P-2(B) was prepared similarly to P-2, provided that after forming the solution, developing agent A-1 (1560 mg/m$^2$) was added. Processing film P-2(C) was prepared similarly to P-2, provided that after forming the solution, zinc hydroxide (2000 mg/m$^2$) was added. Processing film P-2(D) was prepared similarly to P-2, provided that after forming the solution, guanidine picolinate (2800 mg/m$^2$) was added.

Preparation of Water-permeable Processing Film

To a 30% solids solution of crystalline powder of cellulose (Avicel, available from ASAHI Chemical Ind. Co., Ltd.) was added a 30% solids solution of a fine dispersion of tricresyl phosphate having a mean particle size of 0.2 μm. The solution was adjusted to a viscosity of 2000 mP·s at 25° C. using a B-type viscometer and then, the pH was adjusted to 6.5. The solution was cast onto polyethylene terephthalate (PET) film, was allowed to stand at a temperature of 60° C. for 10 hrs., and peeled off from the PET to obtain a 70 μm thick water-permeable processing film P-3.

Further, processing film P-3(A) was prepared similarly to P-3, provided that after forming the solution, developing agent A-1 (1560 mg/m$^2$) and zinc hydroxide (2000 mg/m$^2$) were added. Processing film P-3(B) was prepared similarly to P-3, provided that after forming the solution, developing agent A-1 (1560 mg/m$^2$) was added. Processing film P-3(C) was prepared similarly to P-3, provided that after forming the solution, developing agent A-1 (1560 mg/m$^2$) and 1-phenyl-5-mercaptotetrazole (10 mg/m $^2$) were added. Processing film P-3(D) was similarly prepared, comprising a layer containing guanidine picolinate (2800 mg/m$^2$)/hot water-soluble layer/layer containing zinc hydroxide (2000 mg/m$^2$). Processing film P-3(E) was prepared prepared similarly to P-3, provided that guanidine picolinate (2800 mg/m$^2$) was further added.

Coating of Hot Water-soluble Layer

In the foregoing photographic material and processing element, a hot water-soluble layer which was comprised of gelatin of 1.5 g/m$^2$ and PVA 203 (available from Kuraray Co., Ltd.) was provided together with other component layers, as shown in Table 1. To adjust the dissolution time or dissolution temperature, compound VS-44 described in JP-A 10-153833 was optionally added within the range of 5 to 30 mg per gelatin.

Evaluation of Samples

Photographic material No. 101 was exposed through an optical wedge to light of 1000 lux for 1/100 sec. To the surface of the exposed photographic material, hot water of 40° C. was provided in an amount of 15 ml/m$^2$, the emulsion side of the photographic material was superposed on the processing layer-side of the processing element P-1 and developed at 40° C. for 120 sec. using a heated drum. In cases where a water-soluble processing film or water-permeable processing film is used, the water-soluble or water-permeable film was interposed between the photographic material and the processing element, and developed at a temperature 40° C. for 120 sec. The combination or variation of the processing element is shown in Table 1. In the Table, a first water-soluble or water-permeable processing film which is interposed between the photographic material and the processing element is denoted as Second Processing Element, and a second water-soluble or water-permeable processing film which is interposed between the photographic material and the processing element is denoted as Third Processing Element. After completion of processing, the photographic material was peeled apart and stepped-wedge images were obtained. The thus processed photographic material samples were each measured with blue, green and red light to determine transmission density. Making corrections for residual silver, so-called characteristic curves for each sample were obtained. Sensitivity was represented by a relative value of exposure necessary to give a density of a fog density plus 0.30, based on the sensitivity of Sample 101 being 100. Photographic material were aged under an atmosphere of 40° C. and 80% RH over a period of 7 days and similarly evaluated. Results thereof are shown in Table 1. In the Table, the sensitivity and the fog density of magenta images are shown, which are denoted as Fog and S, respectively.

As can be seen from the Table 1, inventive samples exhibit low fogging and enhanced sensitivity, and fogging and variation in sensitivity were minimal even after being aged. With respect to yellow and cyan densities, similar results were obtained.

TABLE 1

| Process | Photographic | Processing | 2nd Processing | 3rd Processing | Fresh (magenta) | | Aged (magenta) | |
|---|---|---|---|---|---|---|---|---|
| No. | Material | Element | Element | Element | Fog | S | Fog | S |
| 101 | 101 | P-1 | — | — | 0.71 | 100 | 1.02 | 88 |
| 102 | 101 (A) | P-1 | P-2 (A) | — | 0.81 | 110 | 0.71 | 98 |
| 103 | 101 (B) | P-1 | P-2 (B) | — | 0.39 | 109 | 0.50 | 102 |
| 104 | 101 (A) | P-1 | P-3 (A) | — | 0.27 | 104 | 0.34 | 105 |
| 105 | 101 (A) | P-1 | P-2 (B) | P-2 (C) | 0.20 | 105 | 0.39 | 103 |
| 106 | 101 (A) | P-1 (A) | P-2 (C) | P-3 (E) | 0.18 | 120 | 0.23 | 104 |
| 107 | 101 (A) | P-1 (B) | P-3 (B) | — | 0.31 | 107 | 0.43 | 99 |
| 108 | 101 (B) | P-1 | P-3 (C) | — | 0.31 | 120 | 0.50 | 101 |
| 109 | 101 (B) | P-1 (C) | — | — | 0.39 | 111 | 0.48 | 98 |
| 110 | 101 (B) | P-1 (D) | P-3 (B) | — | 0.23 | 115 | 0.35 | 101 |
| 111 | 101 (A) | P-1 (A) | P-3 (D) | — | 0.15 | 125 | 0.20 | 100 |
| 112 | 101 (A) | P-1 | P-2 (A) | P-2 (D) | 0.20 | 106 | 0.44 | 103 |

Example 2

The silver halide photographic material described in Example 1 of JP-A 11-212200 was developed in a manner similar to Samples Nos. 104, 105, 107, 108 or 119 of Example 1 of this invention, provided that the color developing agent was replaced by 4-amino-3-methyl-N-ethyl-N-(β-hydroxyethyl)-aniline sulfate (5 g/m$^2$). Separately, the photographic material was developed according to Example 1 of JP-A 11-212200, followed by bleaching, fixing and stabilizing for 45 sec, 1 min. 30 sec and 60 sec., respectively. Samples obtained by both processing methods were compared with respect to sensitivity, fog density and the maximum density. As a result, samples according to this invention achieved in a developing time of 120 sec the same performance as obtained in conventional developing time of 3 min. 15 sec. Further, variations of sensitivity, fog density and maximum density obtained according to various running process conditions with a color developing solution described in JP-A 11-218867 were compared with those obtained by repletion of the foregoing processing according to this invention. As a result, it was proved that the variations of this invention were apparently less.

Evaluation was made with respect to the developing temperature and time of 48° C. and 90 sec, and 60° C. and 70 sec. As a result, it was proved that the higher the developing temperature, the effects of the invention was more enhanced. It was further proved that replacement of developing agent CD 4 by developing agent precursor 2-22 led to similar results.

Example 3

Photographic material samples prepared in-Example 1 were evaluated in the same manner as in Example 13 of this invention, as will be described later. As a result, superior results were obtained.

Example 4

Preparation of Photographic Material 102

Photographic material 102 was prepared in the same manner as in photographic material 101, except that 230 mg/m$^2$ of cyan coupler (C-1) and 160 mg/m$^2$ of cyan coupler (C-2) used in the 2nd layer were varied to 240 mg/m$^2$ of cyan coupler (C-3) and 240 mg/m$^2$ of cyan coupler (C-1), respectively; 400 mg/m$^2$ of magenta coupler (M-1) used in the 4th layer was varied to 420 mg/m$^2$ of magenta coupler (M-2); and 1060 mg/m$^2$ of yellow coupler (Y-1) used in the 6th layer was varied to 1300 mg/m$^2$.

Cyan coupler (C-3)

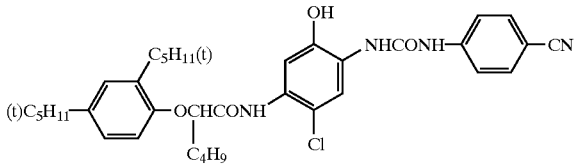

Magenta coupler (M-2)

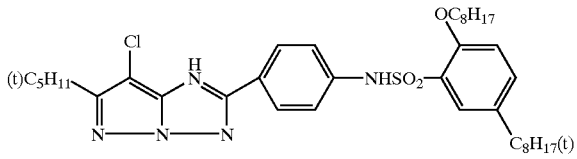

Preparation of Photographic Material 103

Photographic material 103 was prepared in the same manner as photographic material 102, except that 520 mg/m$^2$ of color developing agent (A-1) used in the 2nd, 4th and 6th layers was changed to 580 mg/m$^2$ of color developing agent (A-2).

A-2

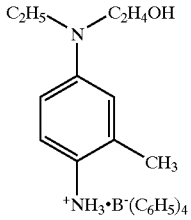

Preparation of Photographic Material 104

Photographic material 104 was prepared in the same manner as photographic material 102, except that color developing agents (A-1) used in the 2nd, 4th and 6th layers were removed.

Preparation of Photographic Material 106

Photographic material 106 was prepared in the same manner as photographic material 104, except zinc hydroxide used in the 1st, 3rd, 5th and 7th layers were removed.

Preparation of Processing Element P-2

On a transparent subbed PEN base (85 $\mu$m thick), the following compositions were each successively coated to prepare processing element P-2. The amount of each additive is expressed in mg/m$^2$.

| | (mg/m$^2$) |
|---|---|
| 1st Layer | |
| Gelatin | 280 |
| Water soluble polymer (PS-2) | 12 |
| Surfactant (SU-3) | 14 |
| Hardener (H-5) | 185 |
| 2nd Layer | |
| Peel polymer (PA-1) | 150 |
| Remover (PA-2) | 90 |
| 3rd Layer | |
| Gelatin | 2400 |
| Water soluble polymer (PS-3) | 360 |
| Water soluble polymer (PS-1) | 700 |
| Water soluble polymer (PS-4) | 600 |
| High boiling solvent (OIL-3) | 2000 |
| Color developing agent (A-2) | 1740 |
| Surfactant (SU-3) | 24 |
| 4th Layer | |
| Gelatin | 240 |
| Water soluble polymer (PS-1) | 24 |
| Hardener (H-5) | 180 |
| 5th Layer | |
| Gelatin | 220 |
| Water soluble polymer (PS-2) | 60 |
| Water soluble polymer (PS-3) | 200 |
| Potassium nitrate | 12 |
| Polyethylene glycol (#2000, available from Wako Junyaku Co., Ltd) | 30 |
| Surfactant (SU-3) | 10 |

Preparation of Processing Element P-3

Processing element p-3 was prepared in the same manner as processing element P-2, except that 1740 mg/m$^2$ of color developing agent (A-2) used in the 3rd layer was changed to 790 mg/m$^2$ of color developing agent (A-3).

Preparation of Processing Element P-4

On a transparent subbed PEN base (85 $\mu$m thick), the following compositions were each successively coated to prepare processing element P-4. The amount of each additive is expressed in mg/m$^2$.

| | (mg/m$^2$) |
|---|---|
| 1st Layer | |
| Gelatin | 280 |
| Water soluble polymer (PS-2) | 12 |
| Surfactant (SU-3) | 14 |
| Hardener (H-5) | 185 |
| 2nd Layer | |
| Peel polymer (PA-1) | 150 |
| Remover (PA-2) | 90 |
| 3rd Layer | |
| Gelatin | 2400 |
| Water soluble polymer (PS-3) | 360 |
| Water soluble polymer (PS-1) | 700 |
| Water soluble polymer (PS-4) | 600 |
| Zinc hydroxide | 2000 |
| Surfactant (SU-3) | 24 |

-continued

| | (mg/m²) |
|---|---|
| 4th Layer | |
| Gelatin | 240 |
| Water soluble polymer (PS-1) | 24 |
| Hardener (H-5) | 180 |
| Surfactant (SU-3) | 9 |
| 5th Layer | |
| Gelatin | 220 |
| Water soluble polymer (PS-2) | 60 |
| Water soluble polymer (PS-3) | 200 |
| Potassium nitrate | 12 |
| Matting agent (PM-2) | 1o |
| Surfactant (SU-3) | 7 |
| Surfactant (SU-5) | 7 |
| Surfactant (SU-6) | 10 |

Preparation of Processing Element P-5

On a transparent subbed PEN base (85 μm thick), the following compositions were each successively coated to prepare processing element P-5. The amount of each additive is expressed in mg/m².

| | (mg/m²) |
|---|---|
| 1st Layer | |
| Gelatin | 280 |
| Water soluble polymer (PS-2) | 12 |
| Surfactant (SU-3) | 14 |
| Hardener (H-5) | 185 |
| 2nd Layer | |
| Peel polymer (PA-1) | 150 |
| Remover (PA-2) | 90 |
| 3rd Layer | |
| Gelatin | 2400 |
| Water soluble polymer (PS-3) | 360 |
| Water soluble polymer (PS-1) | 700 |
| Water soluble polymer (PS-4) | 600 |
| Color developing agent (A-2) | 1740 |
| Zinc hydroxide | 2000 |
| Surfactant (SU-3) | 24 |
| 4th Layer | |
| Gelatin | 240 |
| Water soluble polymer (PS-1) | 24 |
| Hardener (H-5) | 180 |
| Surfactant (SU-3) | 9 |
| 5th Layer | |
| Gelatin | 220 |
| Water soluble polymer (PS-2) | 60 |
| Water soluble polymer (PS-3) | 200 |
| Potassium nitrate | 12 |
| Matting agent (PM-2) | 10 |
| Surfactant (SU-3) | 7 |
| Surfactant (SU-5) | 7 |
| Surfactant (SU-6) | 10 |

Peel polymer (PA-1)

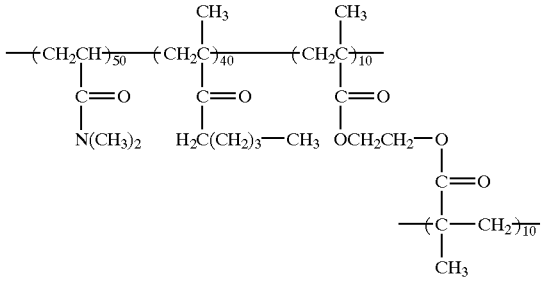

Remover (PA-2)

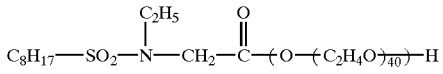

Color developing agent (A-3)

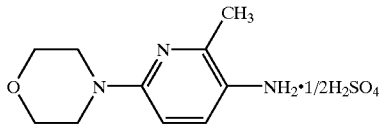

Evaluation of Sample

Processing 1 to 3

Photographic materials Nos. 101 to 103 were exposed through an optical wedge to light of 1000 lux for 1/100 sec. After exposure, hot water of 40° C. was provided to the surface of the exposed photographic material and then excess water was removed by passing through paired squeegee rollers. The emulsion side of the photographic material was superposed on the processing layer-side of the processing element and developed at 80° C. for 30 sec., using a heated drum.

Processing 4 to 6

Photographic material No. 104 was exposed through an optical wedge to light of 1000 lux for 1/100 sec. After exposure, water of 20° C. was provided to the surface of the exposed photographic material and then excess water was removed by passing through paired squeegee rollers. The emulsion side of the photographic material was superposed on the processing layer-side of the first processing element P-2 and was allowed to pass through paired laminating rollers heated at 50° C. (under the pressure of 19.6 Pa). After allowed to be in close contact with each other, the support of processing element P-2 was peeled off. Further, hot water of 40° C. was provided to the surface of the photographic material and then excess water was removed by passing through paired squeegee rollers. Subsequently, the emulsion side of the photographic material was superposed on the processing layer-side of the second processing element P-1 and was allowed to pass through paired laminating rollers (under the pressure of 19.6 Pa). After allowed to be in close contact with each other, development was carried out at 80° C. for 30 sec., using a heated drum.

Photographic materials 104 and 106 each were developed in a manner similar to the foregoing using, as the first processing element, P-3, P-4, and P-5, respectively, and P1 as the second processing element, as shown in Table 2.

Processing 7 and 8

Photographic material No. 106 was exposed through an optical wedge to light of 1000 lux for 1/100 sec. After exposure, water of 20° C. was provided to the surface of the expose photographic material and then excess water was removed by passing through paired squeegee rollers. The emulsion side of the photographic material was superposed on the processing layer-side of the first processing element P-4 and was allowed to pass through paired laminating rollers heated at 50° C. (under the pressure of 19.6 Pa). After allowed to be in close contact with each other, the support of processing element P-4 was peeled off. Further, water of 20° C. was provided to the surface of the exposed photographic material and then excess water was removed by passing through paired squeegee rollers. Subsequently, the emulsion side of the photographic material was superposed on the processing layer-side of the second processing element P-2 and was allowed to pass through paired laminating rollers (under the pressure of 19.6 Pa). After allowed to be in close contact with each other, the support of processing element P-2 was peeled off. Further, hot water of 40° C. was provided to the surface of the photographic material and then excess water was removed by passing through paired squeegee rollers. Subsequently, the emulsion side of the photographic material was superposed on the processing layer-side of the third processing element P-1 and was allowed to pass through paired laminating rollers (under the pressure of 19.6 Pa). After allowed to be in close contact with each other, development was carried out at 80° C. for 30 sec., using a heated drum.

Similarly to the foregoing, photographic material 106 was processed, provided that the second processing element was changed to P-3, as shown in Table 2.

After completion of processing 1 to 8, the photographic material was peeled apart and stepped wedge images were obtained. The thus processed photographic material samples were each measured with blue, green and red light with respect to transmission density. Making corrections for residual silver, so-called characteristic curves for each sample were obtained. Sensitivity was represented by a relative value of exposure necessary to give a density of a fog density plus 0.30, based on the sensitivity of a sample obtained in processing 1 being 100. The minimum density (also denoted as Dmin), maximum density (also denoted as Dmax) and sensitivity (also denoted as S) are shown in Table 2.

TABLE 2

| Processing No. | Photographic Material | Processing Element 1st | 2nd | 3rd | Minimum Density Blue | Green | Red | Maximum Density Blue | Green | Red | Sensitivity Blue | Green | Red |
|---|---|---|---|---|---|---|---|---|---|---|---|---|---|
| 1 | 101 | P-1 | — | — | 0.23 | 0.21 | 0.18 | 1.59 | 1.84 | 1.76 | 100 | 100 | 100 |
| 2 | 102 | P-1 | — | — | 0.09 | 0.07 | 0.05 | 0.16 | 0.23 | 0.15 | — | — | — |
| 3 | 103 | P-1 | — | — | 0.41 | 0.31 | 0.33 | 1.72 | 1.90 | 1.88 | 90 | 87 | 91 |
| 4 | 104 | P-2 | P-1 | — | 0.18 | 0.15 | 0.14 | 1.68 | 1.81 | 1.83 | 106 | 108 | 110 |
| 5 | 104 | P-3 | P-1 | — | 0.14 | 0.12 | 0.13 | 1.55 | 1.69 | 1.66 | 103 | 98 | 102 |
| 6 | 106 | P-5 | P-1 | — | 0.19 | 0.15 | 0.12 | 1.64 | 1.73 | 1.80 | 100 | 99 | 105 |
| 7 | 106 | P-4 | P-2 | P-1 | 0.15 | 0.15 | 0.13 | 1.70 | 1.85 | 1.88 | 110 | 104 | 112 |
| 8 | 106 | P-4 | P-3 | P-1 | 0.11 | 0.11 | 0.09 | 1.60 | 1.68 | 1.70 | 105 | 100 | 105 |

As is apparent from Table 2, inventive samples in which processing was carried out using a processing element having a peel layer exhibited a lower minimum density, higher maximum density and enhanced sensitivity.

Processing 3 of photographic material 103 which contained a color developing agent (A-2) resulted in a relatively high minimum density. On the other hand, when color developing agent (A-2) was removed from the photographic material and Processing 4 was conducted, relatively low minimum density resulted.

There were problems that photographic material 102 which contained a two-equivalent coupler and a color developing agent exhibited a relatively low maximum density and photographic material 103 in which the color developing agent was replaced by another one exhibited a relatively high minimum density (in processing 3). However, the combination of the processing according to this invention and photographic material (104, 106) exhibited superior color formation according to a simple processing at a relatively high temperature.

Example 5

Evaluation of Storage Stability of Photographic Material

Photographic materials 101 through 106 were aged under an atmosphere of 40° C. and 80% RH for a period of 7 days and thereafter processed similarly to Example 4. The thus obtained minimum density, maximum density and sensitivity are shown in Table 3. Sensitivity was represented by a relative value, based on the sensitivity of the sample obtained in Processing 1 being 100.

TABLE 3

| Processing No. | Photographic Material | Processing Element 1st | 2nd | 3rd | Minimum Density Blue | Green | Red | Maximum Density Blue | Green | Red | Sensitivity Blue | Green | Red |
|---|---|---|---|---|---|---|---|---|---|---|---|---|---|
| 1 | 101 | P-1 | — | — | 0.31 | 0.28 | 0.26 | 1.65 | 1.86 | 1.74 | 88 | 83 | 85 |
| 2 | 102 | P-1 | — | — | 0.10 | 0.09 | 0.05 | 0.19 | 0.26 | 0.16 | — | — | — |
| 3 | 103 | P-1 | — | — | 0.91 | 0.83 | 0.75 | 1.98 | 2.06 | 2.00 | 54 | 43 | 59 |
| 4 | 104 | P-2 | P-1 | — | 0.23 | 0.19 | 0.16 | 1.70 | 1.81 | 1.85 | 100 | 105 | 105 |
| 5 | 104 | P-3 | P-1 | — | 0.16 | 0.13 | 0.13 | 1.56 | 1.64 | 1.65 | 102 | 100 | 99 |
| 6 | 106 | P-5 | P-1 | — | 0.21 | 0.17 | 0.16 | 1.65 | 1.73 | 1.78 | 104 | 102 | 105 |
| 7 | 106 | P-4 | P-2 | P-1 | 0.17 | 0.17 | 0.16 | 1.68 | 1.83 | 1.90 | 108 | 105 | 110 |
| 8 | 106 | P-4 | P-3 | P-1 | 0.12 | 0.11 | 0.10 | 1.62 | 1.68 | 1.72 | 104 | 100 | 103 |

As apparent from Table 3, inventive samples which was processed using a processing element having a peel layer exhibited lower minimum density, higher maximum density and little variation in sensitivity even after aged under the condition at high temperature and high humidity.

Photographic material 103 which contained a color developing agent (A-2) exhibited marked variations in minimum density and sensitivity after aged under an atmosphere of high temperature and high humidity (Processing 3). When processed with a processing element containing a color developing agent and having a peel layer (P-4), variations in minimum density and sensitivity were reduced (Processing 4). From other results, it was proved that processing by the use of the processing element having a peel layer enhanced storage stability of the photographic material and was nevertheless a simple high temperature processing.

Example 6

Processing elements P-2b through P-2d, P-3b through P-3d, P-4b though P-4d, and P-5b through P-5d were prepared in the same manner as processing elements P-2 through P-5, respectively, except that 150 mg/m$^2$ of peel polymer (PA-1) and 90 mg/m$^2$ of remover (PA-2) used in the 2nd layer were replaced as below.

| | |
|---|---|
| Preparation of each of P-2b, P-3b, P-4b and P-5b | |
| Water soluble nylon (A-90, available from Toray Co., Ltd.) | 800 mg/m$^2$ |
| Preparation of each P-2c P-3c, P-4c and P-5c | |
| Polyvinyl alcohol (PVA 205, available from Kuraray Co., Ltd.) | 500 mg/m$^2$ |
| Polyethylene glycol (PEO #2000, available from Wako Junyaku Co., Ltd.) | 200 mg/m$^2$ |
| Preparation of each of P-2d, P-3d, P-4d and P-5d | |
| Adipinic acid polyester | 130 mg/m$^2$ |
| Cellulose acid hydrogen phthalate | 120 mg/m$^2$ |

Using these processing elements, evaluation was made similarly to Example 4 and similar results were obtained. Thus, even when the constitution of the peel layer was varied, effects of this invention were also achieved.

Example 7

Photographic material 106 was cut to 135 film size and put into a patrone and loaded into Nikkon F4 to which was mounted a lens of 35 mm focus and F=2 lens. Using this, people, a Macbeth chart, a monochromatic chart and a sharpness chart were each photographed. After completion of photographing, photographic materials were processed using processing elements P-4, P-2 and P-1 according to Processing 7 of Example 4. After completion of processing, the processing element was peeled off from the photographic material and images of the photographic material was read according to the method described in Japanese Patent Application No. 11-324496, then, image synthesis, removal of silver images and preparation of prints were conducted. The thus obtained color prints were slightly inferior in color reproduction and sharpness but resulted in a color hard copy at sufficiently acceptable levels for enjoyment, as compared to color prints which were obtained by printing on color paper through analog exposure based on color negative obtained by using the processing method employing conventional processing solutions and a commercially available color film. Thus, it was shown that the processing method and image information preparation method provided evidence of capability of providing superior color hard copy obtained by simple processing method.

Example 8

Color prints were prepared similarly to Example 7, except that photographic material 106 was replaced by color film CENTURIA 100 (available from Konica Corp.) In this case, superior color hard copies were obtained in the combined use of image processing described in Japanese Patent Application No. 11-7747. The thus obtained color prints were slightly inferior but at sufficiently acceptable levels for enjoyment with respect to color reproduction and sharpness, as compared to color prints obtained by printing on color paper through analog exposure based on color negative obtained by the conventional processing method. Thus, it was shown that the processing method and image information preparation method provided evidence of capability of providing superior color hard copies obtained by a simple processing method.

Example 9

Activator Processing

Processing 11

Photographic material 106 was exposed through an optical wedge to light of 1000 lux for 1/100 sec. and processed by immersing in the following processing solution (color developing solution) at 38° C. for 3 min.

Processing solution 1

| | |
|---|---|
| Potassium carbonate anhydride | 37.5 g |
| Sodium bromide | 1.3 g |
| Potassium hydroxide | 1.0 g |

-continued

| | |
|---|---|
| Sodium sulfite anhydride | 4.25 g |
| 4-Amino-3-methyl-N-ethyl-N-(β-hydroxyethyl)aniline sulfate | 4.75 g |

Water was added to make 1 lit. and the pH was adjusted to 10.1 with potassium hydroxide or sulfuric acid.

Processing 12

Photographic material 106 was exposed through an optical wedge to light of 1000 lux for 1/100 sec. Water of 20° C. was provided to the surface of the exposed photographic material and excess water was removed by passing through paired squeegee rollers. Then, the emulsion-side of the photographic material was superposed on the layer-side of the first processing element P-2 and was allowed to pass through paired laminating rollers and after being in close contact with each other, the support of P-2 was peeled, and then was processed by immersing in the following processing solution (activator solution) at 38° C. for 3 min.

Processing solution 2

| | |
|---|---|
| Potassium carbonate anhydride | 37.5 g |
| Sodium bromide | 1.3 g |
| Potassium hydroxide | 1.0 g |
| Sodium sulfite anhydride | 4.25 g |

Water was added to make 1 lit. and the pH was adjusted to 10.1 with potassium hydroxide or sulfuric acid.

Evaluation

The photographic material samples obtained in processing 11 and 12 were each measured with blue, green and red light with respect to transmission density. Making corrections for residual silver, so-called characteristic curves for each sample were obtained. Sensitivity was represented by a relative value of exposure necessary to give a density of a fog density plus 0.30, based on the sensitivity of a sample obtained in processing 11 being 100. The minimum density, maximum density and sensitivity are shown in Table 4.

After processing solutions 1 and 2 were allowed to stand at room temperature for 3 days, the foregoing processing 11 and 12 were carried out and evaluation was made similarly to the foregoing. Results thereof are also shown in Table 4.

TABLE 4

| Processing Solution | Process No. | Photographic Material | Processing Element | Minimuim Density | | | Maximum Density | | | Sensitivity | | |
|---|---|---|---|---|---|---|---|---|---|---|---|---|
| | | | | Blue | Green | Red | Blue | Green | Red | Blue | Green | Red |
| Fresh | 11 | 106 | — | 0.31 | 0.26 | 0.22 | 1.55 | 2.03 | 1.84 | 100 | 100 | 100 |
| | 12 | 106 | P-2 | 0.23 | 0.20 | 0.18 | 1.49 | 1.86 | 1.72 | 94 | 98 | 95 |
| Aged | 11 | 106 | — | 0.52 | 0.40 | 0.31 | 1.20 | 1.69 | 1.33 | 80 | 76 | 82 |
| | 12 | 106 | P-2 | 0.23 | 0.19 | 0.17 | 1.48 | 1.82 | 1.70 | 92 | 95 | 95 |

As compared to comparative processing 11,, processing 12 according to this invention slightly inferior in maximum density and sensitivity but markedly superior in storage stability of processing solution, and the results after being allowed to stand were almost the same as those before being allowed to stand. Accordingly, the processing method relating to this invention (processing 12) provide means for achieve the object of this invention of providing a simplified processing method in terms of superior storage stability and easy handling of the processing solution.

Further, processing solution 2 contains no developing agent and there is no fear that the developing agent might contact human body, so that it is a processing solution preferable in handling.

Example 10

Preparation of Color Filter

On a 85 μm thick transparent subbed polyethylene naphthalate support (hereinafter, also denoted as PEN), coating solutions corresponding the constitution of Sample No. 110 of Example 1 in Japanese Patent Application No. 10-326017 were simultaneously coated. The thus coated film was exposed through a masking filter so as to form a 20 μm square R•G•R Bayer arrangement pattern and processed according to the process described in Japanese Patent Application No. 10-326017 to obtain a color filter.

Subsequently, a photographic material and a processing element were prepared in accordance with the following procedure.

Preparation of Photographic Material a

On the filter-side of the support having the filter described above, the photographic component layers having the following composition were coated to prepare a multi-layer photographic material a. The amount of each additive is expressed in mg/m$^2$ and that of a sensitizing dye is expressed in mol per mol of silver halide contained in the same layer.

| | |
|---|---|
| 1st Layer (Sub-layer) | |
| Gelatin | 0.8 |
| UV absorbent (UV-1) | 0.2 |
| High boiling solvent (OIL-2) | 0.2 |
| 2nd Layer (High-sensitive color forming layer) | |
| Gelatin | 1.7 |
| Silver iodobromide emulsion c | 2.5 |
| Sensitizing dye (SD-1) | $1.12 \times 10^{-4}$ |
| Sensitizing dye (SD-3) | $1.08 \times 10^{-4}$ |
| Sensitizing dye (SD-4) | $1.93 \times 10^{-4}$ |
| Sensitizing dye (SD-7) | $1.05 \times 10^{-4}$ |
| Cyan coupler (C-4) | 0.16 |
| Magenta coupler (M-3) | 0.09 |
| Yellow coupler (Y-2) | 0.21 |
| High boiling solvent (OIL-1) | 0.35 |
| High boiling solvent (OIL-2) | 0.09 |

-continued

| | |
|---|---|
| Antifoggant (AF-9) | 0.002 |
| Water soluble polymer (PS-1) | 0.04 |
| 3rd Layer (Low-sensitive color forming layer) | |
| Gelatin | 3.30 |
| Silver iodobromide emulsion a | 0.5 |

-continued

| | |
|---|---|
| Silver iodobromide emulsion b | 1.0 |
| Sensitizing dye (SD-1) | $1.46 \times 10^{-4}$ |
| Sensitizing dye (SD-3) | $1.60 \times 10^{-4}$ |
| Sensitizing dye (SD-4) | $1.85 \times 10^{-4}$ |
| Sensitizing dye (SD-7) | $1.34 \times 10^{-4}$ |
| Cyan coupler (C-4) | 0.32 |
| Magenta coupler (M-3) | 0.18 |
| Yellow coupler (Y-2) | 0.42 |
| High boiling solvent (OIL-1) | 0.70 |
| High boiling solvent (OIL-2) | 0.17 |
| Antifoggant (AF-6) | 0.002 |
| Water soluble polymer (PS-1) | 0.02 |
| 4th Layer (Antihalation layer) | |
| Gelatin | 0.80 |
| Dye (AI-1) | 0.28 |
| Dye (AI-2) | 0.24 |
| Dye (AI-3) | 0.40 |
| 5th Layer (Base-generating layer) | |
| Gelatin | 1.20 |
| Additive (HQ-2) | 0.02 |
| High boiling solvent (OIL-2) | 0.06 |
| Water soluble polymer (PS-1) | 0.06 |
| Zinc oxide | 1.63 |
| Zinc hydroxide | 0.40 |
| 6th Layer (protective layer) | |
| Gelatin | 0.50 |
| Matting agent (WAX-1) | 0.20 |
| Water soluble polymer (PS1) | 0.12 |

In addition to the above composition were added coating aids SU-1, SU-2 and SU-3; a dispersing aid SU-4; viscosity-adjusting agent V-1; stabilizers ST-1 and ST-2; antifoggants AF-1, AF-2, AF-3, AF-4 and AF-5; hardener H-1, H-2, H-3 and H-5; and fungicide F-2, F-3, F-4 and F-5 were each added in amounts of 15.0 mg/m$^2$, 60.0 mg/m$^2$, 50.0 mg/m$^2$, and 10.0 mg/m$^2$.

Emulsions used in the foregoing sample are as follows, in which the grain size is cubic equivalent edge length.

TABLE 5

| Emuslion | Av. Grain Size ($\mu$m) | A. Iodide Content (mol %) | Ratio of Grain Size/Thickness |
|---|---|---|---|
| a | 0.27 | 2.0 | 1.0 |
| b | 0.48 | 2.6 | 3.7 |
| c | 0.68 | 7.6 | 6.5 |

Silver iodobromide grain emulsion b was comprised of silver iodobromide grains containing iridium of $1\times10^{-7}$ to $1\times10^{-6}$ mol/Ag mol. Silver iodobromide grain emulsions a and b were added with the sensitizing dyes described above and thereafter chemically sensitized with sodium thiosulfate, chloroauric acid and potassium thiocyanate to an optimal level with respect to the relationship between sensitivity and fogging. Silver iodobromide grain emulsion c was added with the sensitizing dyes described above and thereafter chemically sensitized with sodium thiosulfate, triphenylphosphine selenide, chloroauric acid and potassium thiocyanate to an optimal level with respect to the relationship between sensitivity and fogging.

Compounds used in the photographic material are shown below.

M-3

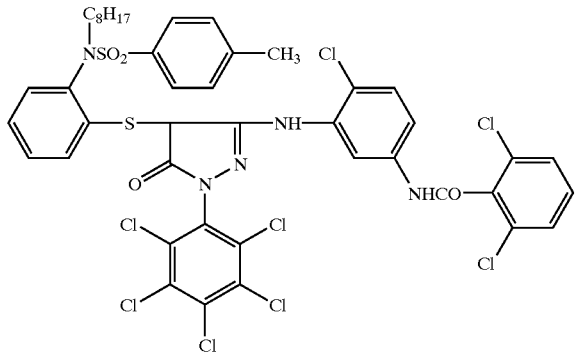

C-4

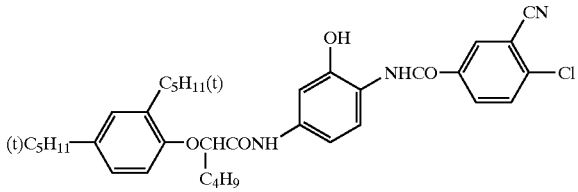

Y-2

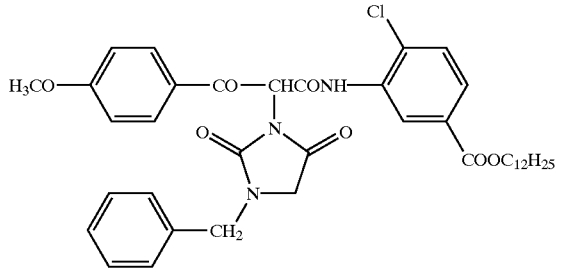

Preparation of Processing Element a

On a transparent subbed PEN base (85 $\mu$m thick), the following compositions were each successively coated to prepare processing element a. The amount of each additive is expressed in g/m$^2$. Besides the compounds described earlier, compounds as sown below are employed. In the 2nd layer, with regard to the ratio of picolinic acid to guanidine, picolinic acid was used in excess, and the pH was adjusted with sulfuric acid so that the processing element layer exhibited a pH of 5.5.

| | (mg/m$^2$) |
|---|---|
| 1st Layer | |
| Gelatin | 0.46 |
| Water soluble polymer (PS-2) | 0.02 |
| Surfactant (SU-3) | 0.023 |
| 2nd Layer | |
| Gelatin | 2.4 |
| Water soluble polymer (PS-3) | 0.36 |
| Water soluble polymer (PS-1) | 0.7 |
| Water soluble polymer (PS-4) | 0.6 |
| High boiling solvent (OIL-3) | 2.0 |
| Picolinic acid•guanidine | 3.2 |
| Picolinic acid | 0.5 |
| Surfactant (SU-3) | 0.024 |

-continued

| | (mg/m$^2$) |
|---|---|
| 3rd Layer | |
| Gelatin | 0.24 |
| Water soluble polymer (PS-1) | 0.7 |
| Water soluble polymer (PS-3) | 0.36 |
| Water soluble polymer (PS-4) | 0.6 |
| Surfactant (SU-3) | 0.024 |
| 4th Layer | |
| 4-Amino-3-methyl-N-ethyl-N-(-hydroxy)-aniline sulfate (CD-4) | 2.0 |
| Gelatin | 3.0 |
| 5th Layer | |
| Gelatin | 0.22 |
| Water soluble polymer (PS-2) | 0.06 |
| Water soluble polymer (PS-3) | 0.20 |
| Antifoggant (AF-7) | 0.02 |
| Matting agent (FM-2) | 0.01 |
| Surfactant (SU-3) | 0.007 |
| Surfactant (SU-S) | 0.007 |
| Surfactant (SU-6) | 0.01 |
| Hardener (H-5) | 0.37 |

Using the thus prepared photographic material a and processing element a, the following processing P-1 was carried out to obtained developed sample. This is denoted as combined processing 1.

Processing P-1

To the surface of the photographic material a, hot water of 40° C. was provided in an amount of 15 ml/m$^2$, the emulsion side of the photographic material was superposed on the processing layer-side of the processing element a and developed at 40° C. for 150 sec. using a heated drum. After completion of processing, the processing element was peeled to obtained a processed sample.

Further, process Nos. 2 through 17 each was similarly carried out using processing elements a-1 through a-16, as shown in Table 7. Processing elements a-1 through a-16 were prepared similarly to processing element a, provided that, in processing element a, CD-4 was replaced by other developing agents or the halide content was varied, as shown below:

a-1: CD-4 was replaced by equimolar (1-1), a-2: CD-4 was replaced by equimolar (1-8), a-3: CD-4 was replaced by equimolar (1-6);

a-4: CD-4 was replaced by equimolar (2-20), a-5: CD-4 was replaced by equimolar (2-19), a-6: CD-4 was replaced by equimolar (2-21), a-7: CD-4 was replaced by equimolar (3-16), a-8: CD-4 was replaced by equimolar (3-13), a-10: 5 mmol/m$^2$ of (3-27) was added to the 4th layer, a-11: CD-4 was replaced by equimolar (4-8), a-12: CD-4 was replaced by equimolar (4-5), a-13: CD-4 was replaced by equimolar (5-1), a-14: CD-4 was replaced by equimolar (6-1), a-15: 2 mmol/m$^2$ of KBr was added to the 1st layer, a-16: 0.3 mmol/m$^2$ of KI was added to the 1st layer.

Furthermore, processing 18 was similarly carried out, provided that photographic material a was replaced by photographic material b described below, processing element a was replaced by processing element b described below, and processing P-1 was changed to P-2. Processing 19 through 25 were each carried out using processing elements b-1 through b-7. Processing element b-1 through b-7 were prepared similarly to processing element b, provided that, in processing element b, CD-4 was replaced by other developing agents or the halide content was varied, as shown below:

b-1: CD-4 was replaced by equimolar (1-8), b-2: CD-4 was replaced by equimolar (2-19), b-3: CD-4 was replaced by equimolar (3-16), b-4: CD-4 was replaced by equimolar (4-5), b-5: CD-4 was replaced by equimolar (5-1), b-6: CD-4 was replaced by equimolar (6-1), b-7: 2 mmol/m$^2$ of KBr was added to the 1st layer.

Furthermore, processing 26 was similarly carried out, provided that photographic material a was replaced by photographic material b described below, processing element a was replaced by processing element c described below, and processing P-1 was changed to P-3. Processing 27 through 33 were each carried out using processing elements c-1 through c-7. Processing element c-1 through c-7 were prepared similarly to processing element c, provided that, in processing element c, CD-4 was replaced by other developing agents or the halide content was varied, as shown below:

c-1: CD-4 was replaced by equimolar (1-1), c-2: CD-4 was replaced by equimolar (2-20), c-3: CD-4 was replaced by equimolar (3-16), c-4: CD-4 was replaced by equimolar (4-8), c-5: CD-4 was replaced by equimolar (5-1), c-6: CD-4 was replaced by equimolar (6-1), c-7: 0.3 Mmol/m$^2$ of KI was added to the 1st layer.

Preparation of Photographic Material b

Photographic material b was prepared in the same manner as photographic material a, except that the composition of the 5th or 6th layer was varied as below:

the 5th layer was removed, and in the 6th layer, the constitution was 1.70 g of gelatin alone.

Preparation of Processing Element b

Processing element b was prepared in the same manner as processing element a, except that the composition of the 2nd layer was varied as follows:

2nd layer; picolinic acid-guanidine and picolinic acid were replaced by 1.63 g of zinc oxide and 0.40 g of zinc hydroxide.

Preparation of Processing Element c

Processing element c was prepared in the same manner as processing element b, except that zinc oxide and zinc hydroxide were removed from the 2nd layer.

Processing P-2

Processing P-2 was carried out in a manner similar to processing P-1, provided that water was replaced by the following solution a.

Solution a

| | |
|---|---|
| Picolinic acid.guanidine | 200 g |
| 5-Nitroindazole | 0.35 g |
| 1-phenyl-5-mercaptotetrazole | 0.06 g |
| 5-Methylbenzotriazole | 0.06 g |
| 2-mercaptobenzimidazole-5-sulfonic acid | 0.3 g |
| Potassium bromide | 0.3 g |
| Sodium sulfite | 50 g |
| Boric acid | 10 g |

-continued

| | |
|---|---|
| N-n-butylethanolamine | 15 g |
| Ethlenediaminedisuccinic-acid-diacetic acid | 1.0 g |

Water was added to make 1 lit. and the pH was adjusted to 9.0.

Processing P-3

Processing P-3 was carried out in a manner similar to processing P-1, provided that water was replaced by solution b described below.

Solution b

Solution b was prepared in the same manner as solution a, except that picolinic acid guanidine (or guanidine picolinate) was replaced by sodium hydroxide and the pH was adjusted to 12.

Using the thus prepared photographic materials and processing elements, processing was carried out and processing 1 through 33 each was evaluated as follows.

Evaluation of Storage Stability

Photographic materials are allowed to stand in an air-tight wrapping form under the condition of 25° C. and 50% RH for a period of 10 days. Separately, photographic materials were similarly allowed to stand under the condition of 40° C. and 55% RH for a period of 10 days. Thereafter, the photographic materials were exposed to white light of 1000 lux for 1/100 sec and then processed according to processing 1 through 33 by the combination of the photographic material and processing element, as shown in Tables 6 and 7. The thus processes photographic materials were measured with respect to Visual transmission density, based on white light, using a densitometer produced by X-rite Corp. Making corrections for reduction in sensitivity caused by filter and base-line density, D (density ordinate)–Log E (exposure abscissa), so-called characteristic curves for each sample were obtained. Sensitivity was represented by a relative value of exposure necessary to give a density of the minimum density plus 0.1, based on the sensitivity of Sample which was aged at 25° C. and 50% RH and processed according to processed 1 being 100.

Evaluation of Stain

Processed photographic materials obtained by processing 1 through 33 were measure with respect to visual transmission density in a manner similar to the above. Making corrections of the base-line due to residual silver, corrected transmission density $D_1$ was obtained for each of the processed photographic materials. These processed photographic materials were further subjected to bleaching, fixing and stabilizing treatments and the transmission density $D_2$ was determined. Stain was determined based on the following equation:

$$D_{stain}=D_1-D_2.$$

In this invention, the value of $D_{stain}$ is defined as an extent of staining caused by a developing agent. Thus, the more $D_{stain}$ is more marked in staining after developing.

Results are shown in Tables 6 and 7.

TABLE 6

| Process No. | Photo-graphic Material | Pro-cessing Element | Pro-cessing | Storage Stability (sensitivity) 25° C. 50% RH | 40° C. 55% RH | Stain |
|---|---|---|---|---|---|---|
| 1 | a | a | P-1 | 100 | 63 | 0.55 |
| 2 | a | a-1 | P-1 | 103 | 90 | 0.31 |
| 3 | a | a-2 | P-1 | 105 | 78 | 0.38 |
| 4 | a | a-3 | P-1 | 110 | 90 | 0.29 |
| 5 | a | a-4 | P-1 | 108 | 88 | 0.24 |
| 6 | a | a-5 | P-1 | 113 | 85 | 0.26 |
| 7 | a | a-6 | P-1 | 118 | 90 | 0.39 |
| 8 | a | a-7 | P-1 | 109 | 83 | 0.39 |
| 9 | a | a-8 | P-1 | 121 | 97 | 0.35 |
| 11 | a | a-10 | P-1 | 108 | 81 | 0.21 |
| 12 | a | a-11 | P-1 | 113 | 86 | 0.37 |
| 13 | a | a-12 | P-1 | 110 | 83 | 0.31 |
| 14 | a | a-13 | P-1 | 107 | 79 | 0.29 |
| 15 | a | a-14 | P-1 | 110 | 84 | 0.18 |
| 16 | a | a-15 | P-1 | 111 | 83 | 0.30 |
| 17 | a | a-16 | P-1 | 108 | 80 | 0.33 |

TABLE 7

| Process No. | Photo-graphic Material | Pro-cessing Element | Pro-cessing | Storage Stability (sensitivity) 25° C. 50% RH | 40° C. 55% RH | Stain |
|---|---|---|---|---|---|---|
| 18 | b | b | P-2 | 99 | 61 | 0.58 |
| 19 | b | b-1 | P-2 | 111 | 100 | 0.23 |
| 20 | b | b-2 | P-2 | 115 | 102 | 0.19 |
| 21 | b | b-3 | P-2 | 110 | 111 | 0.30 |
| 22 | b | b-4 | P-2 | 120 | 105 | 0.25 |
| 23 | b | b-5 | P-2 | 119 | 108 | 0.21 |
| 24 | b | b-6 | P-2 | 122 | 99 | 0.31 |
| 25 | b | b-7 | P-2 | 121 | 101 | 0.22 |
| 26 | b | c | P-3 | 97 | 60 | 0.60 |
| 27 | b | c-1 | P-3 | 108 | 103 | 0.22 |
| 28 | b | c-2 | P-3 | 105 | 100 | 0.19 |
| 29 | b | c-3 | P-3 | 110 | 108 | 0.15 |
| 30 | b | c-4 | P-3 | 120 | 113 | 0.14 |
| 31 | b | c-5 | P-3 | 112 | 111 | 0.20 |
| 32 | b | c-6 | P-3 | 104 | 100 | 0.18 |
| 33 | b | c-7 | P-3 | 109 | 115 | 0.22 |

As can be seen from Tables 6 and 7, combined processing according to this invention exhibited less reduction in sensitivity even after being aged and little staining after development.

Example 11

According to the following procedure, photographic materials c and d, and processing elements d to f were prepared.

Preparation of Photographic-Material c

On a triacetyl cellulose film support were formed the following layers containing composition as shown below to prepare a multi-layered color photographic material Samples 101 to 105. The addition amount of each compound was represented in term of g/m$^2$, provided that the amount of silver halide or colloidal silver was converted to the silver amount and the amount of a sensitizing dye was represented in mol/Ag mol.

| | |
|---|---|
| 1st Layer (Anti-Halation Layer) | |
| Black colloidal silver | 0.24 |
| UV absorbent (UV-1) | 0.3 |
| Gelatin | 1.5 |
| 2nd Layer (Intermediate Layer) | |
| Gelatin | 0.7 |
| 3rd Layer (Low-speed Red-Sensitive Layer) | |
| Silver iodobromide emulsion a | 0.34 |
| Silver iodobromide emulsion b | 0.09 |
| Sensitizing dye (SD-1) | $1.62 \times 10^{-5}$ |
| Sensitizing dye (SD-3) | $7.93 \times 10^{-5}$ |
| Sensitizing dye (SD-4) | $1.84 \times 10^{-4}$ |
| Cyan coupler (C-1) | 0.3 |
| Colored cyan coupler (CC-1) | 0.054 |
| DIR compound (DI-1) | 0.02 |
| High boiling solvent (OIL-2) | 0.3 |
| Compound (AS-2) | 0.001 |
| Gelatin | 0.8 |
| 4th Layer (Medium-speed Red-sensitive Layer) | |
| Silver iodobromide emulsion b | 0.41 |
| Sensitizing dye (SD-1) | $2.20 \times 10^{-5}$ |
| Sensitizing dye (SD-3) | $1.03 \times 10^{-4}$ |
| Sensitizing dye (SD-4) | $2.42 \times 10^{-4}$ |
| Cyan coupler (C-1) | 0.18 |
| Colored cyan coupler (CC-1) | 0.038 |
| DIR compound (DI-1) | 0.01 |
| High boiling solvent (OIL-2) | 0.23 |
| Compound (AS-2) | 0.001 |
| Gelatin | 0.8 |
| 5th Layer (High-speed Red-Sensitive Layer) | |
| Silver iodobromide emulsion a | 0.044 |
| Silver iodobromide emulsion b | 0.21 |
| Silver iodobromide emulsion c | 0.56 |
| Sensitizing dye (SD-1) | $1.91 \times 10^{-5}$ |
| Sensitizing dye (SD-3) | $8.81 \times 10^{-5}$ |
| Sensitizing dye (SD-4) | $2.06 \times 10^{-4}$ |
| Cyan coupler (C-1) | 0.17 |
| Colored cyan coupler (CC-1) | 0.03 |
| DIR compound (DI-1) | 0.004 |
| High boiling solvent (OIL-2) | 0.19 |
| Compound (AS-2) | 0.002 |
| Gelatin | 0.7 |
| 6th Layer (Intermediate Layer) | |
| High boiling solvent (OIL-1) | 0.10 |
| Compound (AS-1) | 0.08 |
| Gelatin | 0.9 |
| 7th Layer (Low-speed Green-Sensitive Layer) | |
| Silver iodobromide emulsion a | 0.25 |
| Silver iodobromide emulsion d | 0.10 |
| Sensitizing dye (SD-5) | $2.20 \times 10^{-4}$ |
| Sensitizing dye (SD-6) | $5.50 \times 10^{-5}$ |
| Magenta coupler (M-1) | 0.31 |
| Colored magenta coupler (CM-1) | 0.12 |
| DIR compound (DI-2) | 0.017 |
| Compound (AS-2) | 0.0015 |
| High boiling solvent (IIL-1) | 0.44 |
| Gelatin | 1.2 |
| 8th Layer (Medium-speed Green-Sensitive Layer) | |
| Silver iodobromide emulsion d | 0.51 |
| Sensitizing dye (SD-6) | $3.08 \times 10^{-5}$ |
| Sensitizing dye (SD-7) | $2.36 \times 10^{-4}$ |
| Sensitizing dye (SD-13) | $3.53 \times 10^{-5}$ |
| Magenta coupler (M-1) | 0.10 |
| Colored cyan couple (CM-1) | 0.05 |
| High boiling solvent (OIL-1) | 0.15 |
| Compound (AS-2) | 0.001 |
| Gelatin | 0.9 |
| 9th Layer (High-speed Green-Sensitive Layer) | |
| Silver iodobromide emulsion a | 0.03 |
| Silver iodobromide emulsion e | 0.53 |

-continued

| | |
|---|---|
| Sensitizing dye (SD-6) | $2.79 \times 10^{-5}$ |
| Sensitizing dye (SD-7) | $2.10 \times 10^{-4}$ |
| Sensitizing dye (SD-13) | $3.08 \times 10^{-5}$ |
| Magenta coupler (M-1) | 0.033 |
| Magenta coupler (M-4) | 0.023 |
| Colored magenta coupler (CM-1) | 0.023 |
| DIR compound (DI-2) | 0.009 |
| DIR compound (DI-3) | 0.001 |
| High boiling solvent (OIL-1) | 0.08 |
| Compound (AS-2) | 0.002 |
| Gelatin | 0.7 |
| 10th Layer (Yellow Filter Layer) | |
| Yellow colloidal silver | 0.06 |
| High boiling solvent (OIL-1) | 0.06 |
| Compound (AS-1) | 0.07 |
| Compound (FS-1) | 0.056 |
| Gelatin | 0.9 |
| 11th Layer: Low-speed Blue-sensitive Layer | |
| Silver iodobromide emulsion a | 0.21 |
| Silver iodobromide emulsion f | 0.16 |
| Silver iodobromide emulsion g | 0.09 |
| Sensitizing dye (SD-11) | $1.69 \times 10^{-4}$ |
| Sensitizing dye (SD-14) | $8.23 \times 10^{-5}$ |
| Sensitizing dye (SD-10) | $3.76 \times 10^{-4}$ |
| Yellow coupler (Y-1) | 1.0 |
| High boiling solvent (OIL-1) | 0.4 |
| Compound (AS-2) | 0.002 |
| Compound (FS-1) | 0.11 |
| Gelatin | 1.7 |
| 12th Layer (High-sped Blue-sensitive Layer) | |
| Silver iodobromide emulsion g | 0.34 |
| Silver iodobromide emulsion h | 0.34 |
| Sensitizing dye (SD-11) | $1.05 \times 10^{-4}$ |
| Sensitizing dye (SD-10) | $3.51 \times 10^{-5}$ |
| Yellow coupler (Y-1) | 0.08 |
| High boiling solvent (OIL-1) | 0.03 |
| Compound (AS-2) | 0.002 |
| Compound (Fs-1) | 0.03 |
| Gelatin | 0.63 |
| 13th Layer (First Protective Layer) | |
| Silver iodobromide emulsion i | 0.2 |
| UV absorbent (UV-2) | 0.53 |
| Compound (FS-1) | 0.057 |
| Gelatin | 0.9 |
| 14th Layer (Base-generating Layer) | |
| Zinc oxide | 2.5 |
| Gelatin | 1.3 |
| 15th Layer (Second protective Layer) | |
| Matting agent (PM-1) | 0.15 |
| Matting agent (PM-2) | 0.04 |
| Lubricant (WAX-1) | 0.02 |
| Gelatin | 0.55 |

In addition to the foregoing composition, Compound SU-1 and SU-2, hardener H-1 and H-3, stabilizer ST-1 and ST-2, antifoggant Af-3,AF04 and AF-7, dye AI-4, Ai-5 and Ai-6, viscosity-adjusting agent V-1 and antiseptic agent DA-1 are optionally added to each layer to enhance coatability, storage stability and fungicidal property.

Characteristics of silver iodobromide emulsions described above are shown in Table 8, in which the average grain size refers to an edge length of a cube having the same volume as that of the grain. Silver iodobromide emulsions a, b and c were the same as those used in Example 12.

TABLE 8

| Emulsion | Av. Grain Size (μm) | Av. Iodide Content (mol %) | Ratio of Grain Size/Thickness |
|---|---|---|---|
| d | 0.45 | 2.7 | 3.7 |
| e | 0.70 | 2.6 | 7.0 |
| f | 0.38 | 8.0 | 1.0 |
| g | 0.65 | 8.0 | 1.5 |
| h | 0.80 | 8.0 | 2.0 |
| i | 0.03 | 2.0 | 1.0 |

Silver iodobromide grain emulsion e, g and h were comprised of silver iodobromide grains containing iridium of $1\times10^{-7}$ to $1\times10^{-6}$ mol/Ag mol. Silver iodobromide emulsions except e and i were added with the sensitizing dyes described above and thereafter chemically sensitized with sodium thiosulfate, chloroauric acid and potassium thiocyanate to an optimal level with respect to the relationship between sensitivity and fogging. Silver iodobromide emulsions e and i were added with the sensitizing dyes described above and thereafter chemically sensitized with sodium thiosulfate, triphenylphosphine selenide, chloroauric acid and potassium thiocyanate to an optimal level with respect to the relationship between sensitivity and fogging.

Compounds used in the photographic material are shown below.

SD-13

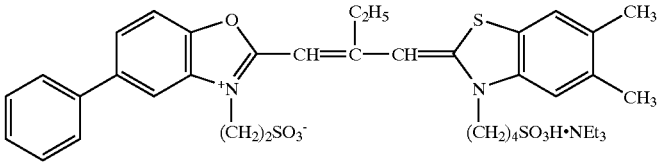

SD-14

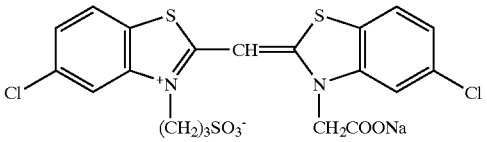

M-2

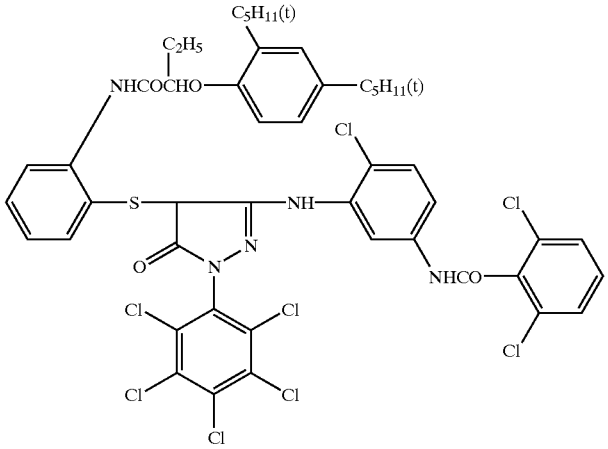

CC-1

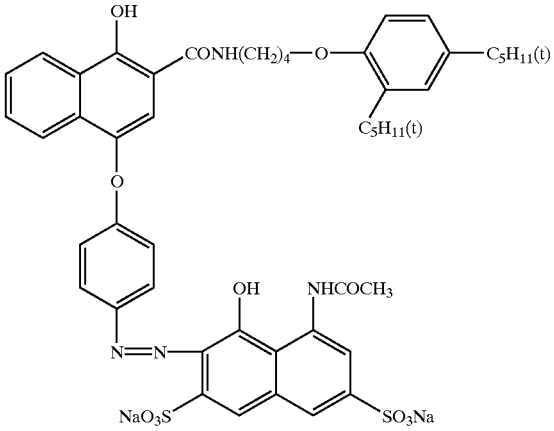

-continued
CM-1
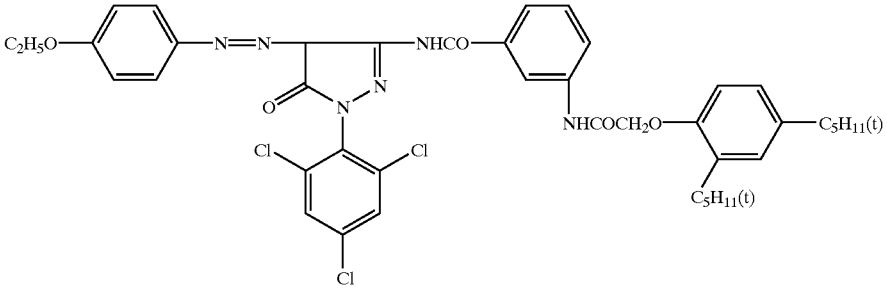
AS-1
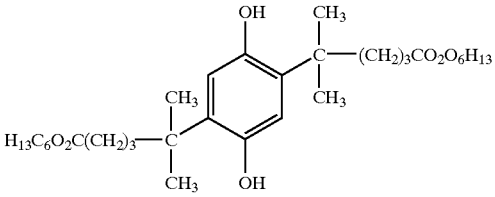
AS-2
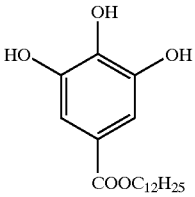
FS-1
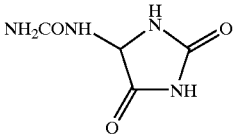
UV-2
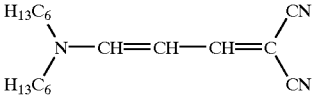
V-1
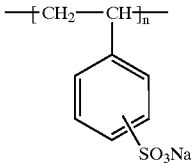
n: degree of polymerization
Weight-average molecular weight
MW = 10,000
DA- (Mixture of the following components)
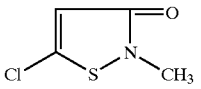
A
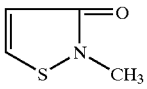
B
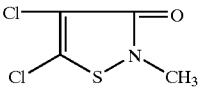
C
A : B : C = 50 : 46 : 4 (molar ratio)
AF-7
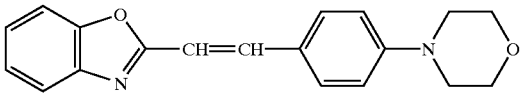
PM-3
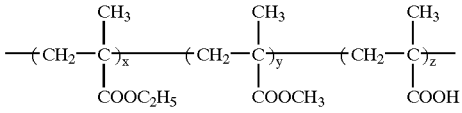
x:y:z = 3:3:4
PM-4
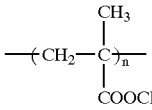
n: degree of polymerization
Weight-average molecular weight
MW = 20,000

-continued
AI-4
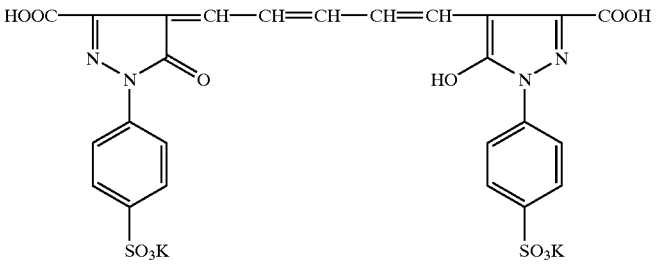
AI-5
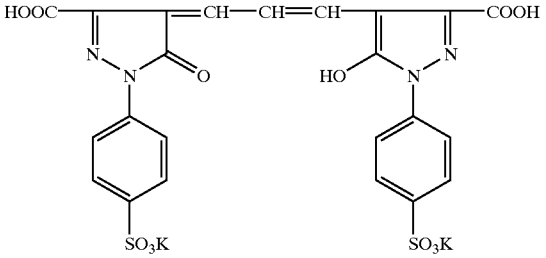
AI-6
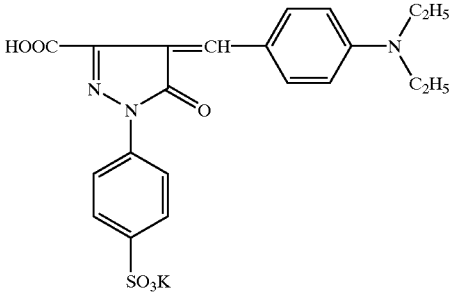
DI-1
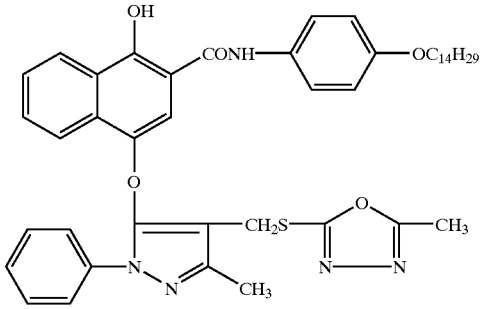
DI-2
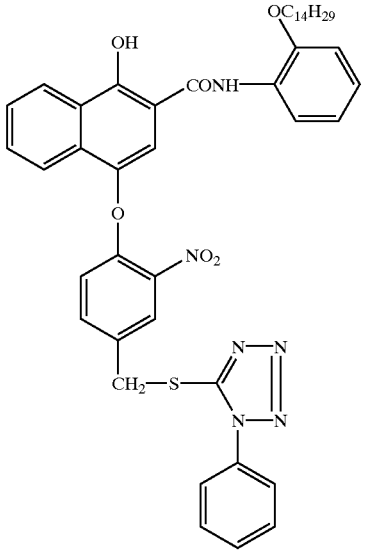
DI-3
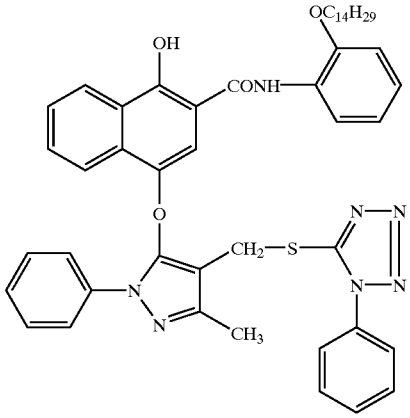

Preparation of Photographic Material d

Photographic material d was prepared in the same manner as photographic material c, except that the 14th base-generating layer was removed.

Preparation of Processing Element (Water-permeable Processing Film)

To aqueous 20% gelatin solution, a 5% solids solution of Avicel (available from ASAHI Chemical Ind. Co., Ltd.), hardener H-5 of 20 mg/g gelatin and a dispersion emulsified with OIL-1 of 5% solids were added and then developing agent CD-4 was further added thereto. The solution was adjusted to a viscosity of 2000 mP·s at 25° C. using a B-type viscometer and then, the pH was adjusted to 6.5. The solution was cast on polyethylene terephthalate (PET) film, was allowed to stand at a 23° C. and 50% RH for 10 hrs., then dried at 40° C. for 3 hrs. and peeled off from the PET to obtain 70 $\mu$m thick water-permeable processing film d.

Further, processing elements d-1 through d-14 were prepared similarly processing element a, provided that CD-4 was replaced by other developing agents or other additives were added, as shown below:

d-1: CD-4 was replaced by equimolar (1-1), d-2: CD-4 was replaced by equimolar (1-8), d-3: CD-4 was replaced by equimolar (2-20), d-4: CD-4 was replaced by equimolar (2-22), d-5: CD-4 was replaced by equimolar (3-16), d-6: CD-4 was replaced by equimolar (4-5), d-7: 5 mmol/m$^2$ of (3-27) was added, d-8: 5 mmol/m$^2$ of (7-23) was added, d-9: 5 mmol/m$^2$ of (7-23) was added, d-10: CD-4 was replaced by equimolar (5-2), d-11: CD-4 was replaced by equimolar (6-1), d-12: 6 mmol/m$^2$ of KBr was added, d-13: 5 mmol/m$^2$ of sodium sulfite was added, d-14: CD-4 was replaced by equimolar (2-19).

Preparation of Processing Element (Water Soluble Processing Film)

Fine powdery PVA KURARIA HM (available from Kuraray Co., Ltd.) was dispersed in water and adding 3% glycerin, suspension was dissolved at 60° C. for 30 min. To this solution was added 2.5 g/m$^2$ of developing agent CD-4, the pH was adjusted to 6.5 and after adding 1.5 g/m$^2$ of zinc oxide, the solution was adjusted to a viscosity of 2000 mP·s at 25° C using a B-type viscometer and then, and the pH was again adjusted to 6.5. The solution was cast on polyethylene terephthalate (PET) film, was allowed to stand at 23° C. and 50% RH for 8 hrs., dried at 40° C. for 4 hrs and peeled off from the PET to obtain 45 $\mu$m thick water-soluble processing film e.

Further, processing elements e-1 through e-12 were prepared similarly processing element a, provided that CD-4 was replaced by other developing agents or other additives were added, as shown below:

e-1: CD-4 was replaced by equimolar (1-1), e-2: CD-4 was replaced by equimolar (2-11), e-3: CD-4 was replaced by equimolar (3-13), e-4: 8 mmol/m$^2$ of (3-27) was added, e-5: 8 mmol/m$^2$ of (7-23) was added, e-6: 8 mmol/m$^2$ of (7-47) was added, e-7: CD-4 was replaced by equimolar (5-1), e-8: CD-4 was replaced by equimolar (6-1), e-9: CD-4 was replaced by equimolar (4-8), e-10: 1 mmol/m$^2$ of KI was added, e-11: 5 mmol/m$^2$ of sodium sulfite was added, e-12: CD-4 of e-11 was replaced by equimolar (1-4).

Preparation of Processing Element f

Processing element f was prepared in the same manner as processing element prepared in Example 12, except that developing agent CD-4 used in the 4th layer was removed.

Using the thud prepared photographic material c or d, and processing element d to f and processing elements in which the developing agent or a halide ion used in processing element d or e was varied as shown in Tables 9 and 10, processed photographic materials were prepared in combination with the following processing P-4 or P-5. Thus, processing 34 through 61 were conducted as shown in Tables 9 and 10.

Processing P-4

On the emulsion-side of the photographic material was superposed processing element d or processing element in which a developing agent or another one used in processing element e was varied (these referred to second processing element) and 15 ml/m$^2$ of 40° C. water was provided thereto. Further thereon, processing element f (which was referred to first processing element) was superposed and developed at 40° C. for 120 sec. using a heated drum. After completing development, the processing elements were peeled off.

Processing P-5

On the emulsion-side of the photographic material was superposed processing element e or processing element in which a developing agent or another one used in processing element e was varied (these referred to second processing element) and 15 ml/m$^2$ of 40° C. water was provided thereto. Further thereon, processing element f (which was referred to first processing element) was superposed and developed at 40° C. for 120 sec. using a heated drum. After completing development, the processing elements were peeled off.

The thus obtain processed samples were evaluated in the same manner as in Example 10, with respect to storage stability and staining. Resutls thereof are shown in Tables 9 and 10.

TABLE 9

| Process No. | Photographic Material | Processing Element | Processing | Storage Stability (sensitivity) 25° C. 50% RH | 40° C. 55% RH | Stain |
|---|---|---|---|---|---|---|
| 34 | c | d | P-4 | 100 | 58 | 0.67 |
| 35 | c | d-1 | P-4 | 104 | 83 | 0.35 |
| 36 | c | d-2 | P-4 | 103 | 78 | 0.42 |
| 37 | c | d-3 | P-4 | 108 | 79 | 0.41 |
| 38 | c | d-4 | P-4 | 110 | 84 | 0.39 |
| 39 | c | d-5 | P-4 | 103 | 78 | 0.42 |
| 40 | c | d-6 | P-4 | 111 | 83 | 0.41 |
| 41 | c | d-7 | P-4 | 109 | 86 | 0.39 |
| 42 | c | d-8 | P-4 | 105 | 79 | 0.29 |
| 43 | c | d-9 | P-4 | 104 | 83 | 0.33 |
| 44 | c | d-10 | P-4 | 103 | 80 | 0.40 |
| 45 | c | d-11 | P-4 | 112 | 83 | 0.37 |
| 46 | c | d-12 | P-4 | 107 | 80 | 0.35 |
| 47 | c | d-13 | P-4 | 108 | 81 | 0.41 |
| 48 | c | d-14 | P-4 | 115 | 95 | 0.26 |

TABLE 10

| Process No. | Photographic Material | Processing Element 1st | Processing Element 2nd | Processing | Storage Stability (sensitivity) 25° C. 50% RH | Storage Stability (sensitivity) 40° C. 55% RH | Stain |
|---|---|---|---|---|---|---|---|
| 49 | d | f | e | P-5 | 100 | 58 | 0.62 |
| 50 | d | f | e-1 | P-5 | 115 | 103 | 0.15 |
| 51 | d | f | e-2 | P-5 | 117 | 115 | 0.23 |
| 52 | d | f | e-3 | P-5 | 118 | 110 | 0.29 |
| 53 | d | f | e-4 | P-5 | 121 | 113 | 0.18 |
| 54 | d | f | e-5 | P-5 | 125 | 109 | 0.15 |
| 55 | d | f | e-6 | P-5 | 113 | 105 | 0.22 |
| 56 | d | f | e-7 | P-5 | 109 | 99 | 0.24 |
| 57 | d | f | e-8 | P-5 | 117 | 104 | 0.17 |
| 58 | d | f | e-9 | P-5 | 116 | 109 | 0.19 |
| 59 | d | f | e-10 | P-5 | 122 | 110 | 0.24 |
| 60 | d | f | e-11 | P-5 | 111 | 104 | 0.22 |
| 61 | d | f | e-12 | P-5 | 130 | 115 | 0.14 |

As can be seen from Tables 9 and 10, it was proved that combined processing according to this invention exhibited, similarly to Example 10, less reduction in sensitivity even after being aged and little staining after development.

Example 12

Replacing A-1 of the water-permeable processing film of Example 1, A-2 of processing element P-2 of Example 4, or CD-4 of processing elements 11 to 13 of Examples 14 and 17 by an equimolar amount of the developing agent precursor used in the second processing shown in Table 10, evaluation tests were carried out and as a result, advantageous effects of this invention were obtained.

Further, in the water-permeable processing film containing picolinic acid used in Example 1 (Sample 107), processing element P-2 of Example 4 and processing elements 11 to 13 of Examples 14 and 17 described later, 5 mmol/$m^2$ of KBr was further added thereto and evaluation tests were carried out. As a result, effects of this invention were obtained.

Furthermore, in the water-permeable processing film containing picolinic acid used in Example 1 (Sample 107), processing element P-2 of Example 4 and processing elements 11 to 13 of Examples 14 through 17 described later, 10 mmol/$m^2$ of sodium sulfite was further added thereto and evaluation tests were carried out.

Example 13

Photographic materials prepared in Examples 10 and 11 were each were each converted to 135 size film, packaged into a patrone and loaded into Nikon single-lens reflex camera F4 to which was mounted a focal distance of 35 mm and F=2 lens (available from Nikon Corp.); thereafter, setting a film speed to ISO 800, five kinds of scenes including people, flowers, greenish woods and distant mountains and blue sky were photographed. After photographing, photographic materials were processed according to the combination described in Examples 10 and 11. From the processed photographic materials, separation negative images of R, G and B were obtained using a monochromatic CCD camera of 2048×2048 pixels, KX4 (available from Eastman Kodak Corp.), in which a red separation filter (gelatin filter No.W26, available from Eastman Kodak Corp.), a green separation filter (No.W99) or a blue separation filter (No.W98) was arranged between the sample and the light source.

The thus obtained RGB image data were printed on $A_4$ size (210×297 mm) Konica color paper type $QAA_7$, using an LED printer (produced by Konica Corp.) at a resolution of 300 dpi. herein, "dpi" refers to the number of dots per inch (or 2.54 cm). The thus obtained prints were subjected to sensory examination by 10 experimental photographers with respect to faithfulness of reproduction, specifically, color and vividness with regard-to the green of trees and perception of depth with regard to mountains. As a result, it was proved that color prints prepared according to the combined processing of this invention were almost at the same level as images obtained through a conventional photographic system.

Example 14

Preparation of Processing Element 1

On a transparent subbed PEN base (85 μm thick), the following compositions were each successively coated to prepare processing element 1. The amount of each additive is expressed in mg/$m^2$.

| | (mg/$m^2$) |
|---|---|
| 1st Layer | |
| Gelatin | 0.46 |
| Water soluble polymer (PS-2) | 0.02 |
| Surfactant (SU-3) | 0.023 |
| 2nd Layer | |
| Gelatin | 2.4 |
| Water soluble polymer (PS-3) | 0.36 |
| Water soluble polymer (PS-1) | 0.7 |
| Water soluble polymer (PS-4) | 0.6 |
| High boiling solvent (OIL-3) | 2.0 |
| Picolinic acid.guanidine | 3.2 |
| Picolinic acid | 0.5 |
| Surfactant (SU-3) | 0.024 |
| 3rd Layer | |
| Gelatin | 2.4 |
| Water soluble polymer (PS-1) | 0.7 |
| Water soluble polymer (PS-3) | 0.36 |
| Water soluble polymer (PS-4) | 0.6 |
| Surfactant (SU-3) | 0.024 |
| 4th Layer | |
| Gelatin | 0.22 |
| Water soluble polymer (PS-2) | 0.06 |
| Water soluble polymer (PS-3) | 0.20 |
| Antifoggant (AF-7) | 0.02 |
| Matting agent (PM-2) | 0.01 |
| Surfactant (SU-3) | 0.007 |
| Surtactant (SU-5) | 0.007 |
| Surfactant (SU-6) | 0.01 |
| Hardener (H-5) | 0.37 |

Preparation of Processing Element 11

To aqueous 20% gelatin solution were added a 30% solids disperion of tricresyl phosphate (TCP) dispersed in the form of oil in water and hardener H-5 of 20 mg/g gelatin, and developing agent 4-amino-3-methyl-N-ethyl-N-(β-hydroxyethyl)aniline sulfate was further added thereto. The solution was adjusted to a viscosity of 2000 mP·s at 25° C. using a B-type viscometer and then, the pH was adjusted to 6.5 with ½M sulfuric acid or 1M aqueous sodium hydroxide. Then, 3 g/$m^2$ of zinc oxide (ZnO) having an average particle size of 200 nm was added and mixed with stirring. The solution was cast on polyethylene terephthalater (PET) film, was allowed to stand at a 23° C. and 50% RH for 10 hrs., then dried at 40° C. and 80% RH for 14 hrs. and peeled off from the PET to obtain a 70 μm thick processing element 11.

Processing 1

A photographic material was exposed to white light of 1000 lux for 1/100 sec, and to the emulsion-side thereof, hot water of 40° C. was provided in an amount of 15 ml/m$^2$. Further thereon, processing element 11 and/or the processing layer-side of processing element 1 were superposed and developed at 80° C. for 90 sec. using a heated drum. In this case, the photographic material was photographic material C used in Example 13. After completion of processing, processing element 1 and processing element 11 were peeled and the processed photographic materials were evaluated with respect to photographic characteristics as below.

Evaluation of Storage Stability

The photographic materials were measured with respect to R, G, and B transmission densities, based on white light, using a densitometer produced by X-rite Corp. Making corrections for the base-line density, D (density ordinate)–Log E (exposure abscissa), so-called characteristic curves for each sample were obtained, from which the maximum density (Dmax), minimum density (Dmin) and sensitivity were determined. Sensitivity was represented by a relative value of exposure necessary to give a density of the minimum density plus 0.1, based on the sensitivity obtained in process 1 of the fresh sample being 100.

Before subjected to processing 1 or processing 11, photographic materials were allowed to stand in an air-tight wrapping form under the condition of 40° C. and 80% RH for a period of 14 days and then processed according to processing 1 to determine the maximum density, minimum density and sensitivity in a manner similar to the above. The variation rate of sensitivity between before and after being aged. The closer to 100% the rate, the variation before being aged is the less. Replacing processing element 11 and processing element 1 by processing elements 11-1 through 11-8 or 1-1 through 1-4, as shown in Tables 11 and 12, the combined processing No. 2 through 14 were conducted. Results thereof are shown in Tables 11 and 12.

Thus, processing elements 11-1 through 11-8 were obtained similarly to processing element 11, provided that zinc oxide (ZnO) was replaced by other compounds or removed, as shown below:

11-1: ZnO was replaced by 30 mmol/m$^2$ of compound I-1, 11-2: ZnO was replaced by 30 mmol/m$^2$ of compound I-2, 11-3: ZnO was replaced by 30 mmol/m$^2$ of compound I-12, 11-4: ZnO was replaced by 30 mmol/m$^2$ of compound II-1, 11-5: ZnO was replaced by 30 mmol/m$^2$ of compound II-10, 11-6: ZnO was replaced by 30 mmol/m$^2$ of guanidine oxalate, 11-7: ZnO was replaced by 30 mmol/m$^2$ of guanidine thalate, 11-8: ZnO was removed.

Further, processing elements 1-1 through 1-4 was obtained similarly to processing element 1, provided that picolinic acid-guanidine (or guanidine picolinate, also denoted as Gu-Pi) was removed or replaced by other compounds, as shown below:

1-1: Gu-Pi was replaced by 30 mmol/m$^2$ of compound of II-1, 1-2: Gu-Pi was removed, 1-3: Gu-Pi was replaced by 30 mmol/m$^2$ of compound of I-2 and 1-4.5 g/m$^2$ of CD-4 was further added, 1-4: Gu-Pi was replaced by 30 mmol/m$^2$ of compound of II-10 and 4.5 g/m$^2$ of CD-4 was further added.

TABLE 11

| Process No. | Processing | Processing Element 1st | Processing Element 2nd | Storage Stability Fresh Dmin | Fresh Dmax | Fresh S | Aged Dmin | Aged Dmax | Aged S |
|---|---|---|---|---|---|---|---|---|---|
| 1 | 1 | 11 | 1 | 0.52 | 1.57 | 100 | 0.77 | 1.40 | 85 |
| 2 | 1 | 11-1 | 1 | 0.43 | 1.75 | 103 | 0.42 | 1.76 | 99 |
| 3 | 1 | 11-1 | 1 | 0.38 | 1.85 | 108 | 0.35 | 1.84 | 110 |
| 4 | 1 | 11-3 | 1 | 0.39 | 1.80 | 105 | 0.37 | 1.80 | 107 |
| 5 | 1 | 11-4 | 1 | 0.40 | 1.81 | 104 | 0.39 | 1.79 | 103 |
| 6 | 1 | 11-5 | 1 | 0.35 | 1.95 | 103 | 0.36 | 1.93 | 105 |
| 7 | 1 | 11-6 | 1 | 0.41 | 1.83 | 107 | 0.40 | 1.79 | 106 |
| 8 | 1 | 11-7 | 1 | 0.43 | 1.65 | 102 | 0.41 | 1.66 | 104 |

TABLE 12

| Process No. | Processing | Processing Element 1st | Processing Element 2nd | Storage Stability Fresh Dmin | Fresh Dmax | Fresh S | Aged Dmin | Aged Dmax | Aged S |
|---|---|---|---|---|---|---|---|---|---|
| 9 | 1 | 11-1 | — | 0.37 | 1.81 | 110 | 0.35 | 1.80 | 111 |
| 10 | 1 | 11-8 | 1-1 | 0.35 | 1.95 | 115 | 0.38 | 1.93 | 114 |
| 11 | 1 | 11-7 | — | 0.39 | 1.79 | 108 | 0.41 | 1.80 | 109 |
| 12 | 1 | 11-4 | 1-2 | 0.38 | 1.80 | 110 | 0.39 | 1.81 | 112 |
| 13 | 1 | — | 1-3 | 0.43 | 1.85 | 111 | 0.41 | 1.83 | 113 |
| 14 | 1 | — | 1-4 | 0.39 | 1.81 | 108 | 0.41 | 1.79 | 105 |

In the Tables, storage stability of the red-sensitive layer is shown. Similar results were also obtained with respect to the green-sensitive and blue-sensitive layers. As apparent from the results, the combined processing No. 2 through 14 according to this invention exhibited enhanced color formation and reduced fogging and improvements in variation of sensitivity or density between before and after being aged.

Using a water-permeable film containing picolinic acid-guanidine (or guanidine picolinate) of Sample No. 107 of Example 1, processing element P-2 of Example 4 and processing element f of Example 11 in which picolinic acid-guanidine was replaced by an equimolar amount of ammonium phthalate, ammonium oxalate, I-1 or II-1, evaluation tests were similarly conducted. As a result, effects of this invention were obtained.

Example 15

Processing 2

Similarly to processing 1, the photographic material was exposed to white light. After providing 40° C. hot water of 15 ml/m$^2$ to processing element 11, processing element 11 and the processing layer-side of processing element 1 were superposed on the emulsion side of the photographic material, and developed at 80° C. for 60 sec. using a heated drum. After completion of processing, processing element 1 and processing element 11 were peeled to obtain the processed photographic material was obtained.

Processing 3

Similarly to processing 1, the photographic material was exposed to white light. After providing 40° C. hot water of 15 ml/m$^2$ to processing element 1, processing element 11 and the processing layer-side of processing element 1 were superposed on the emulsion side of the photographic material, and developed at 80° C. for 60 sec. using a heated drum. After completion of processing, processing element 1 and processing element 11 were peeled to obtain the processed photographic material.

Processing 4

Similarly to processing 1, the photographic material was exposed to white light and processing element 11 was superposed on the emulsion side of the photographic material. 40° C. hot water of 15 ml/m$^2$ was provided to this laminated material and further thereon was superposed the processing layer-side of processing element 1 and developed at 80° C. for 60 sec. using a heated drum. After completion of processing, processing element 1 and processing element 11 were peeled and the processed photographic material was obtained.

Processing 5

Similarly to processing 1, the photographic material was exposed to white light, and processing element 11 and the processing layer-side of processing element 1 were superposed on the emulsion side of the photographic material. This laminated material was provided with 40° C. hot water of 15 ml/m$^2$ and then was developed at 80° C. for 60 sec. using a heated drum. After completion of processing, processing element 1 and processing element 11 were peeled to obtain the processed photographic material.

The thus processed photographic material samples were evaluated with respect to Maximum density (Dmax), minimum density (Dmin) and sensitivity (S), similarly to Example 14 and results thereof are shown in Table 13.

TABLE 13

| Process | | Processing Element | Storage Stability (60" Dev.) | | |
|---|---|---|---|---|---|
| No. | Processing | (1st/2nd) | Dmin | Dmax | S |
| 1 | 1 | 11/1 | 0.52 | 1.57 | 100 |
| 15 | 2 | 11/1 | 0.20 | 1.99 | 115 |
| 16 | 3 | 11/1 | 0.15 | 2.00 | 118 |
| 17 | 4 | 11/1 | 0.18 | 2.03 | 120 |
| 18 | 5 | 11/1 | 0.17 | 1.95 | 113 |

In the Tables, storage stability of the red-sensitive layer is shown. Similar results were also obtained with respect to the green-sensitive and blue-sensitive layers. As apparent from the results, combined processing No. 15 to 18 according to this invention exhibited capability of rapid access (60 sec) and further exhibiting enhance color formation and reduced fogging.

Example 16

Processing 6

Similarly to processing 1, the photographic material was exposed to white light and the emulsion-side of the photographic material was provided with 40° C. hot water of 15 ml/m$^2$. Further thereon was superposed processing element 11 or the processing layer-side of processing element 1, each of which was heated at 120° C. for 30 sec. This laminated material was developed at 80° C. for 40 sec. using a heated drum. After completion of processing, processing element 1 and processing element 11 were peeled to obtain the processed photographic material. Similarly to Example 14, the thus obtained photographic materials were evaluated with respect to Dmax, Dmin and sensitivity. Results thereof are shown in Table 14.

TABLE 14

| Process | | Processing Element | Storage Stability (60" Dev.) | | |
|---|---|---|---|---|---|
| No. | Processing | (1st/2nd) | Dmin | Dmax | S |
| 13 | 1 | —/1-3 | 0.43 | 1.85 | 111 |
| 19 | 6 | —/1-3 | 0.21 | 1.99 | 120 |
| 20 | 6 | —/1-4 | 0.23 | 2.05 | 119 |
| 21 | 6 | 11-1/— | 0.19 | 1.90 | 115 |

In the Tables, storage stability of the red-sensitive layer is shown. Similar results were also obtained with respect to the green-sensitive and blue-sensitive layers. As apparent from the results, combined processing No. 19 to 21 according to this invention exhibited capability of rapid access (40 sec) and further exhibiting enhance color formation and reduced fogging.

Example 17

Preparation Processing Element 12

On side of the foregoing processing element 11, EVA #86 latex (available from Denkikagaku Co., Ltd.) was coated so as to have 0.5 g solids/m$^2$ and dried to obtain processing element 12 having a heat-sealing, water-permeable layer.

Processing 7

Similarly to processing 1, 40° C. water of 15 ml/m$^2$ was provided to the emulsion-side of the photographic material exposed to white light. The latex coat-side of the foregoing processing element 12 was superposed on the processing layer-side of the foregoing processing element 1 and subjected to laminating compression at 120° C. for 15 sec. The thus laminated material was superposed on the emulsion-side of the photographic material and developed at 90° C. for 80 sec. using a heated drum.

Preparation of Processing Element 13

On side of the foregoing processing element 11, commercially available starch was coated so as to have 0.3 g solids/$m^2$ and dried to obtain processing element 12 having a water-soluble adhesive layer.

Processing 8

Similarly to processing 1, 40° C. water of 15 ml/$m^2$ was provided to the emulsion-side of the photographic material exposed to white light. The water-soluble adhesive-side of the foregoing processing element 13 was superposed on the processing layer-side of the foregoing processing element 1. The thus laminated material was superposed on the emulsion-side of the photographic material and developed at 90° C. for 80 sec. using a heated drum.

From the thus processed photographic material sample, five portion having a size of 1×1 cm and containing the formed dye were extracted, in each of which the number of pin-holes of a diameter of 2 mm or less was counted by an optical microscope. The averaged number thereof was determined. The less value indicates the less non-uniformity of the image caused by processing and the superior results. Evaluation results are shown in Table 15.

TABLE 15

| Process No. | Processing | Processing Element ($1^{st}/2^{nd}$) | Pin-hole No. |
|---|---|---|---|
| 1 | 1 | 11/1 | 35 |
| 22 | 7 | 11-6/1 | 5 |
| 23 | 8 | 11-7/1 | 3 |

In combined processing Nos. 22 and 23 according to this invention, as can be seen from Table 15, reduced non-uniformity of the image caused by processing was achieved.

Example 18

Preparation of Processing Element 2

On a transparent subbed PEN base (85 μm thick), the following compositions were each successively coated to prepare processing element 2-1. The amount of each additive is expressed in mg/$m^2$.

| | (mg/$m^2$) |
|---|---|
| 1st Layer | |
| Gelatin | 0.46 |
| Water soluble polymer (PS-2) | 0.02 |
| Surfactant (SU-3) | 0.023 |
| Hardener (H-5) | 0.60 |
| 2nd Layer | |
| Gelatin | 2.4 |
| Water soluble polymer (PS-3) | 0.36 |
| Water soluble polymer (PS-1) | 0.7 |

-continued

| | (mg/$m^2$) |
|---|---|
| Water soluble polymer (PS-4) | 0.6 |
| High boiling solvent (OIL-3) | 2.0 |
| Picolinic acid.guanidine | 3.2 |
| Picolinic acid | 0.5 |
| Surfactant (SU-3) | 0.024 |

On a transparent non-subbed PEN base (85 μm thick), the following compositions were each successively coated to prepare processing element 2-2.

| | (mg/$m^2$) |
|---|---|
| 1st Layer | |
| Hardener (H-5) | 0.01 |
| Gelatin | 0.5 |
| Surfactant (SU-3) | 0.024 |
| 2nd Layer | |
| EVA #86 | 1.0 |
| Surfactant (SU-3) | 0.04 |

The coating side of processing element 2-1 was superposed on the coating side of processing 2-2 and subjected to heat-sealing at 120° C. for 30 sec. Then, the PEN support of processing element 2-2 was peeled and processing element 2 was obtained.

Preparation of Processing Element 3

Processing element 3-1 was prepared in the same manner as processing element 2-2, except that EVA #86 was replaced by carboxymethyl cellulose (available from Wako Junyaku Co., Ltd.). The coating side of processing 3-2 was provided with water of 0.2 ml/$m^2$ and then superposed on the coating side of processing element 2-1 while applying pressure. Then, the PEN support of processing element 3-2 was peeled and processing element 3 was obtained.

Preparation of Processing Element 4

Processing element 4 was prepared in the same manner as processing element 2, except that a layer containing gelatin of 2.0 g/$m^2$ and zinc oxide of 3.0 g/$m^2$ was provided between the 1st and 2nd layers of processing element 2-2.

Preparation of Processing Element 5

Processing element 5 was prepared in the same manner as processing element 3, except that a layer containing gelatin of 2.0 g/$m^2$ and zinc oxide of 3.0 g/$m^2$ was provided between the 1st and 2nd layers of processing element 3-1.

Using each of the thus obtained processing elements, processing as shown in Table 16 was carried out and evaluated similarly to Example 14. As a result, effects of the combined processing according to this invention were confirmed. In the Tables, storage stability of the red-sensitive layer is shown. Similar results were also obtained with respect to the green-sensitive and blue-sensitive layers.

TABLE 16

| Process No. | Processing | Processing Element 1st | Processing Element 2nd | Storage Stability Fresh Dmin | Fresh Dmax | Fresh S | Aged Dmin | Aged Dmax | Aged S |
|---|---|---|---|---|---|---|---|---|---|
| 1 | 1 | 11 | 1 | 0.52 | 1.57 | 100 | 0.77 | 1.40 | 85 |
| 24 | 1 | 11 | 2 | 0.18 | 1.95 | 123 | 0.15 | 1.95 | 121 |
| 25 | 1 | 11 | 3 | 0.17 | 1.99 | 119 | 0.14 | 1.98 | 118 |

TABLE 16-continued

| Process No. | Processing | Processing Element 1st | Processing Element 2nd | Storage Stability Fresh Dmin | Fresh Dmax | Fresh S | Aged Dmin | Aged Dmax | Aged S |
|---|---|---|---|---|---|---|---|---|---|
| 26 | 1 | 11-8 | 4 | 0.20 | 1.96 | 121 | 0.21 | 1.94 | 123 |
| 27 | 1 | 11-8 | 5 | 0.21 | 1.88 | 120 | 0.23 | 1.90 | 121 |

Example 19

Process 1

Photographic material C of Example 11 (hereinafter, referred to as photograohic material C) was exposed to white light of 1000 lux for 1/100 sec, and immersed in water of 12° C. for 30 sec. Then, processing element 11 of Example 16 and the processing layer-side of processing element 1 of Example 16 were superposed on the emulsion side of the photographic material, and developed at 80° C. for 60 sec. using a heated drum. In this case, water was provided in an amount of 23 ml/$m^2$ and water provided was water in which the photographic material was processed at a rate of 3 $m^2$/l and which exhibited a conductivity of 1500 $\mu$S/cm and a residual halide concentration of 230 ppm. The time between water-providing and development was 20 sec. and the process other than development was carried out at a trempera-ture of 14° C. After completion of processing, processing element 1 and processing element 11 were peeled to obtain the processed photographic material was obtained. The thus processes photographic materials were measured with respect to RGB transmission density, based on white light, using a densitometer produced by X-rite Corp. Making corrections for base-line density, D (density ordinate)–Log E (exposure abscissa), so-called characteristic curves for each sample were obtained. Sensitivity was represented by a relative value of exposure necessary to give a density of the minimum density plus 0.1, based on the sensitivity of a sample processed according to process 1 being 100.

Evaluation of Unevenness of Images

Five 1×1 cm portions of dye-forming areas were extracted from the processed photographic material sample, the number of pin-holes having a diameter of 2 mm or less was counted and averaged out for the five portions. The less average value is less in process unevenness of images and superior.

Evaluation of Process Variation in Continuous Processing

Process 1 was continuously run 100 times and the result thereof was evaluated with respect to variations in maximum and minimum densities and sensitivity. Thus, the width of variation was evaluated, based on five grades of 1 to 5. The more value is less in variation and superior in process variation.

Process 2 through 15

Process 2 through 15 were also run and evaluated in the same manner as in process 1. Process 2 through 15 was carried out similarly to process 1, provided that water was provided in the manner as described below:

Process 2: 23 ml/$m^2$ of water was provided to the photographic material by a gravure roller;

Process 3: 23 ml/$m^2$ of water was provided to the photographic material by a spray coater;

Process 4: 38 ml/$m^2$ of water was provided to the photographic material;

Process 5: water of 35° C. was provided to the photographic material;

Process 6: sodium perfluorooctanesulfonate was dissolved in water to adjust a surface tension to $18\times10^{-3}$ N/m;

Process 7: PVA 203 (available from Kurare Co., Ltd) was contained in water to adjust a viscosity to 16 cps;

Process 8: water was desalted by a microacilyzer (cartridge AC110-10, available from Asahi Kasei Co., Ltd.), in which the conductivity and residual chlorine concentration were 100 $\mu$s/cm and 220 ppm, respectively;

Process 9: residual chlorine was removed with activated carbon, in which the conductivity and residual chlorine concentration were 100 $\mu$s/cm and 220 ppm, respectively;

Process 10: water was filtered with a membrane filter of 0.20 $\mu$m;

Process 11: after provided with water, the photographic material was squeezed by squeegee rollers at pressure of 15 N/$m^2$;

Process 12: the processing film was superposed on the photographic material and squeezed by squeegee rollers at pressure of 15 N/$m^2$;

Process 13: photographic material, processing film and processing sheet were previously heated to 45° C. using a heated roller and then water was provided;

Process 14: water was provided in a closed vessel maintained at 45° C. and 60% RH;

Process 15: development at a relatively high temperature was started at 45 sec. after providing water.

Results are shown in Table 17.

TABLE 17

| Process No. | No. of Pin-hole | Process Variation |
|---|---|---|
| 1 | 25 | 2 |
| 2 | 10 | 4 |
| 3 | 8 | 5 |
| 4 | 13 | 3 |
| 5 | 11 | 4 |
| 6 | 14 | 4 |
| 7 | 9 | 4 |
| 8 | 14 | 3 |
| 9 | 15 | 4 |
| 10 | 10 | 3 |
| 11 | 9 | 5 |
| 12 | 6 | 5 |
| 13 | 17 | 4 |
| 14 | 15 | 4 |
| 15 | 8 | 4 |

Example 20

Photographic material C which was processed in process 1 was further subjected to bleaching of 45 sec., fixing of 1 min. 30 sec. and stabilizing of 60 sec., as described in JP-A 11-212200. Evaluation thereof was similarly made and results similar to Example 19 were obtained.

Example 21

Processing and evaluation were conducted similarly to Example 19, provided that CD 4 of processing element 11 used in Example 19 was replaced by an equimolar amount of compound 21 described in JP-A 53-135628. It was proved that results similar to Example 19 were obtained.

Example 22

Processing and evaluation were conducted similarly to Example 19, provided that hardener H-5 of processing element 11 used in Example 19 was removed. It was proved that results similar to Example 19 were obtained.

Example 23

Processing and evaluation were conducted similarly to Example 19, provided that photographic material C was replaced by photographic material 1 described in JP-A 11-178566 and processing element 11 was removed. It was proved that results similar to Example 19 were obtained.

Example 24

Processing and evaluation were conducted similarly to Example 19, provided that an image correction treatment described in JP-A 6-28468 was made for photographic material C. It was proved that results similar to example 19 were obtained.

What is claimed is:

1. A photographic processing element comprising a precursor of a color developing agent represented by one of the following formulas (1) through (6):

formula (1)

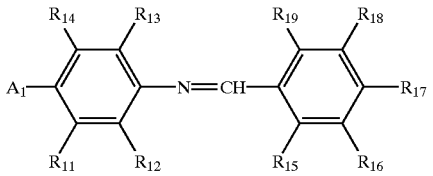

wherein $R_{11}$ through $R_{19}$ each represent a hydrogen atom or a substituent, provided that $R_{11}$ and $R_{12}$, $R_{13}$ and $R_{14}$, $R_{15}$ and $R_{16}$, $R_{16}$ and $R_{17}$, $R_{17}$ and $R_{18}$, or $R_{18}$ and $R_{19}$ may combine with each other to form a ring; and $A_1$ represents a hydroxy group or a substituted amino group, provided that the substituted amino group of $A_1$ may combine with $R_{11}$ or $R_{14}$ to form a ring;

formula (2)

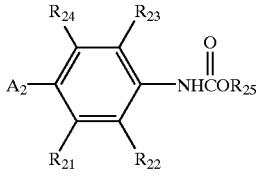

wherein $R_{21}$ through $R_{25}$ each represent a hydrogen atom or a substituent, provided that $R_{21}$ and $R_{22}$, or $R_{23}$ and $R_{24}$ may combine with each other to form a ring; and $A_2$ represents a hydroxy group or a substituted amino group, provided that the substituted amino group of $A_2$ may combine with $R_{21}$ or $R_{24}$ to form a ring;

formula (3)

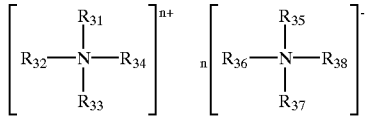

wherein $R_{31}$ through $R_{38}$ each represent a hydrogen atom or a substituent and n is an integer of 1 to 5;

formula (4)

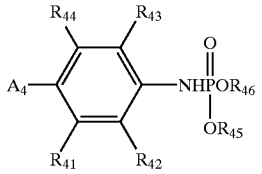

wherein $R_{41}$ through $R_{44}$ each represent a hydrogen atom or a substituent, provided that $R_{41}$ and $R_{42}$, or $R_{43}$ and $R_{44}$ may combine with each other to form a ring; $A_4$ represents a hydroxy group or a substituted amino group, provided that the substituted amino group of $A_4$ may combine with $R_{41}$ or $R_{44}$ to form a ring; and $R_{45}$ and $R_{46}$ each represent an alkyl group having 1 to 12 carbon atoms or an aryl group;

formula (5)

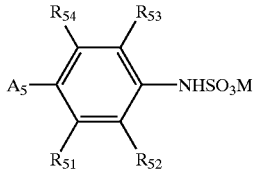

wherein $R_{51}$ through $R_{54}$ each represent a hydrogen atom or a substituent, provided that $R_{51}$ and $R_{52}$, or $R_{53}$ and $R_{54}$ may combine with each other to form a ring; $A_5$ represents a hydroxy group or a substituted amino group, provided that the substituted amino group of $A_5$ may combine with $R_{51}$ or $R_{54}$ to form a ring; and M represents a hydrogen atom, an alkali metal, ammonium, a nitrogen-containing organic base or a quaternary nitrogen-containing compound;

formula (6)

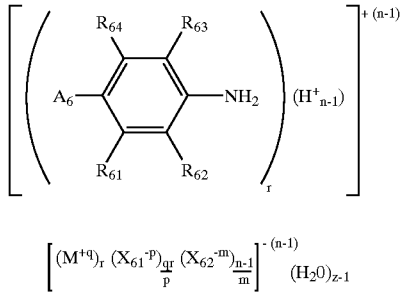

wherein $R_{61}$ through $R_{64}$ each represent a hydrogen atom or a substituent, provided that $R_{61}$ and $R_{62}$, or $R_{63}$ and $R_{64}$ may combine with each other to form a ring; $A_6$ represents a hydroxy group or a substituted amino group, provided that the substituted amino group of $A_6$ may combine with $R_{61}$ or $R_{64}$ to form a ring; $M^{+q}$ is a metal ion; q is an integer of 2 or 3; r is an integer of 1 or 2; $X_{61}^-$ and $X_{62}^-$ each represents an anion; p is an integer of 1 or 2; m is an integer of 1 or 2; n is an integer of 1 through 3; and z is an integer of 1 through 5.

2. The processing element of claim 1, wherein the processing element comprises a heat-sealable water-permeable binder layer.

3. The processing element of claim 1, wherein the processing element comprises a layer containing a water-soluble adhesive.

4. The processing element of claim 1, wherein the processing element comprises a base or a precursor of a base.

5. The processing element of claim 1, wherein the processing element comprises a compound represented by the following formula (I) or (II):

formula (I)

formula (I)

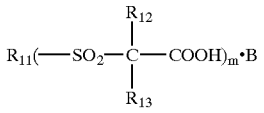

wherein m is an integer of 1 or 2; when m is 1, $R_{11}$ represents an alkyl group, a cycloalkyl group, an alkenyl group, an alkynyl group, an aralkyl group, an aryl group or a heterocycric residue, and when m is 2, $R_{11}$ represents an alkylene group, an arylenes group or a heterocyclic residue; $R_{12}$ and $R_{13}$ each represent a hydrogen atom, an alkyl group, an alkenyl, a cycloalkyl group, an aralkyl group, an aryl group and a heterocycric moiety group; and B represents an organic base, an alkali metal or an alkaline earth metal hydroxide;

$$R_{21}(—C{\equiv}C—COOH)_n.B \qquad \text{formula (II)}$$

wherein n is an integer of 1 or 2; when n is 1, $R_{21}$ represents an alkyl group, a cycloalkyl group, an alkenyl group, an alkynyl group, an aralkyl group, a carboxy group, an aryl group or a heterocycric residue, and when n is 2, $R_{21}$ represents an alkylene group, an arylene group or a heterocyclic residue; and B represents an organic base, an alkali metal hydroxide or an alkaline earth metal hydroxide.

6. The processing element of claim 1, wherein the processing element comprises a phthalic acid ammonium salt or an oxalic acid ammonium salt.

7. The processing element of claim 1, wherein the processing element comprises a compound represented by formula (III):

$$Z_mX_n \qquad \text{formula (III)}$$

wherein Z represents a metal other than an alkali metal; X represents an oxide ion, hydroxide ion, carbonate ion, phosphate ion, borate ion or aluminate ion; m and n are each an integer necessary to allow the valence number of Z to counter-balance with that of X.

8. The processing element of claim 7, wherein the processing element comprises a component layer containing the compound represented by formula (III) and a component layer containing a compound capable of forming a complex upon reaction with the compound of formula (III).

9. The processing element of claim 8, wherein the processing element comprises a hot water-soluble layer which is provided between the component layer containing the compound represented by formula (III) and the component layer containing a compound capable of forming a complex upon reaction with the compound of formula (III).

10. The processing element of claim 1, wherein the processing element comprises a compound represented by the following formula (7):

formula (7)

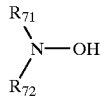

wherein $R_{71}$ and $R_{72}$ each represent a hydrogen atom or an alkyl group.

11. The processing element of claim 1, wherein the processing element comprises sulfite ion in an amount of 1 to 50 mmol/$m^2$.

12. The processing element of claim 1, wherein the processing element comprises a halide ion in an amount of 1 to 50 mmol/$m^2$.

13. The processing element of claim 1, wherein the processing element comprises a silver halide solvent.

14. The processing element of claim 1, wherein the processing element comprises a development inhibitor.

15. The processing element of claim 1, wherein the processing element consists of at least one selected from the group consisting of a water-soluble layer and a water-permeable layer.

16. The processing element of claim 1, wherein the processing element comprises a water-insoluble support having thereon at least a component layer, and a peel layer being provided between the support and the component layer.

17. The processing element of claim 1, wherein the processing element comprises a hot water-soluble layer.

18. The processing element of claim 17, wherein the processing element comprises a layer containing a color developing agent or a precursor of a color developing agent, a layer containing a base or a precursor of a base, and a hot water-soluble layer which is provided between the layer containing a color developing agent or a precursor of a color developing agent and the layer containing a base or a precursor of a base.

19. An image forming method comprising superposing a processing element comprising a precursor of a color developing agent on an exposed silver halide photographic material comprising a support having thereon a silver halide emulsion layer to perform development of the photographic material to form an image; the precursor of a color developing agent being represented by one of the formulas (1) through (6):

formula (1)

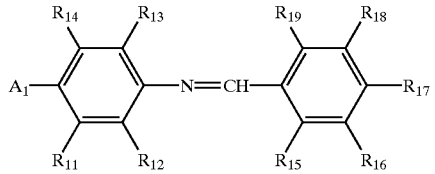

wherein $R_{11}$ through $R_{19}$ each represent a hydrogen atom or a substituent, provided that $R_{11}$ and $R_{12}$, $R_{13}$ and $R_{14}$, $R_{15}$ and $R_{16}$, $R_{16}$ and $R_{17}$, $R_{17}$ and $R_{18}$, or $R_{18}$ and $R_{19}$ may combine with each other to form a ring; and $A_1$ represents a hydroxy group or a substituted amino group, provided that the substituted amino group of $A_1$ may combine with $R_{11}$ or $R_{14}$ to form a ring;

formula (2)

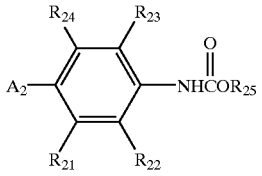

wherein $R_{21}$ through $R_{25}$ each represent a hydrogen atom or a substituent, provided that $R_{21}$ and $R_{22}$, or $R_{23}$ and $R_{24}$ may combine with each other to form a ring; and $A_2$ represents a hydroxy group or a substituted amino group, provided that the substituted amino group of $A_2$ may combine with $R_{21}$ or $R_{24}$ to form a ring;

formula (3)

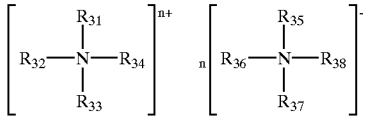

wherein $R_{31}$ through $R_{38}$ each represent a hydrogen atom or a substituent and n is an integer of 1 to 5;

formula (4)

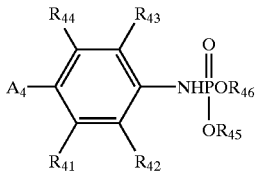

wherein $R_{41}$ through $R_{44}$ each represent a hydrogen atom or a substituent, provided that $R_{41}$ and $R_{42}$, or $R_{43}$ and $R_{44}$ may combine with each other to form a ring; $A_4$ represents a hydroxy group or a substituted amino group, provided that the substituted amino group of $A_4$ may combine with $R_{41}$ or $R_{44}$ to form a ring; and $R_{45}$ and $R_{46}$ each represent an alkyl group having 1 to 12 carbon atoms or an aryl group;

formula (5)

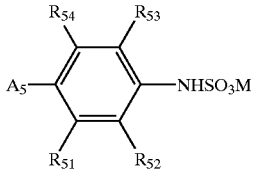

wherein $R_{51}$ through $R_{54}$ each represent a hydrogen atom or a substituent, provided that $R_{51}$ and $R_{52}$, or $R_{53}$ and $R_{54}$ may combine with each other to form a ring; $A_5$ represents a hydroxy group or a substituted amino group, provided that the substituted amino group of $A_5$ may combine with $R_{51}$ or $R_{54}$ to form a ring; and M represents a hydrogen atom, an alkali metal, ammonium, a nitrogen-containing organic base or a quaternary nitrogen-containing compound;

formula (6)

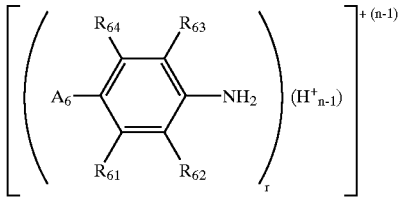

$$\left[(M^{+q})_r\,(X_{61}^{-p})_{\frac{qr}{p}}\,(X_{62}^{-m})_{\frac{n-1}{m}}\right]^{-(n-1)}(H_2O)_{z-1}$$

wherein $R_{61}$ through $R_{64}$ each represent a hydrogen atom or a substituent, provided that $R_{61}$ and $R_{62}$, or $R_{63}$ and $R_{64}$ may combine with each other to form a ring; $A_6$ represents a hydroxy group or a substituted amino group, provided that the substituted amino group of $A_6$ may combine with $R_{61}$ or $R_{64}$ to form a ring; $M^{+q}$ is a metal ion; q is an integer of 2 or 3; r is an integer of 1 or 2; $X_{61}^-$ and $X_{62}^-$ each represents an anion; p is an integer of 1 or 2; m is an integer of 1 or 2; n is an integer of 1 through 3; and z is an integer of 1 through 5.

20. The image forming method of claim 19, wherein the processing element comprises a base or a precursor of a base.

21. The image forming method of claim 19, wherein the development is performed in the presence of water.

22. The image forming method of claim 19, wherein the processing element comprising the precursor of a color developing agent is a processing film.

23. The image forming method of claim 22, wherein the method further comprises superposing a processing sheet comprising a base or a precursor of a base on the processing film.

24. The image forming method of claim 19, wherein the method comprises superposing a processing element comprising a base or a precursor of a base on the photographic material and further superposing the processing element comprising the precursor of a color developing agent on the processing element comprising a base or a precursor of a base.

25. The image forming method of claim 24, wherein the processing element comprising a base or a precursor of a base is a processing film, and the processing element comprising the precursor of a color developing agent is a processing sheet.

26. The image forming method of claim 19, wherein the method comprises superposing the processing element comprising the precursor of a color developing agent and a processing element on the photographic material, and at least one of the processing elements comprising a water-insoluble support.

27. The image forming method of claim 19, wherein the development is performed at a temperature of 43° C. or more.

28. The image forming method described in 27, wherein the development is performed at a temperature of 55 to 95° C.

29. The image forming method described in 19, wherein the processing element comprises a hot water-soluble layer.

30. The image forming method of claim 29, wherein the processing element comprises a component layer (1) containing the precursor of a color developing agent and a component layer (2) containing a base or a precursor of a base, and the processing element further comprising a hot water-soluble layer which is provided between the component layer (1) and component layer (2).

31. The image forming method of claim 30, wherein the development is performed in the presence of water at a temperature of 55 to 95° C.

32. The image forming method of claim 19, wherein the processing element is a processing sheet comprising on a water-insoluble support a component layer containing the precursor of a color developing agent and a peel layer which is provided between the support and the component layer, the method, after superposing the processing sheet on the photographic material, further comprising peeling a portion including the support from the processing sheet, while remaining the other portion including the component layer.

33. The image forming method of claim 32, wherein the method further comprises, after peeling a portion including the support, performing development at a temperature of 43° C. or more.

34. The image forming method of claim 32, wherein the method further comprises, after peeling a portion including the support, superposing thereon a processing element.

35. The image forming method of claim 19, wherein the processing element further comprises a compound represented by formula (III), the method further comprising superposing processing element containing a compound capable forming a complex upon reaction with the compound represented by formula (III):

$$Z_mX_n \qquad \text{formula (III)}$$

wherein Z represents a metal other than an alkali metal; X represents an oxide ion, hydroxide ion, carbonate ion, phosphate ion, borate ion or aluminate ion; m and n are each an integer necessary to allow the valence number of Z to counter-balance with that of X.

36. A photographic processing element comprising a color developing agent or a precursor of a color developing agent, wherein the processing element comprises a hot water-soluble layer which is provided between a component layer containing a compound represented by the following formula (III) and a component layer containing a compound capable of forming a complex upon reaction with the compound of formula (III)

$$Z_mX_n \qquad \text{formula (III)}$$

wherein Z represents a metal other than an alkali metal; X represents an oxide ion, hydroxide ion, carbonate ion, phosphate ion, borate ion or aluminate ion; m and n are each an integer necessary to allow the valence number of Z to counter-balance with that of X.

37. A photographic processing element comprising a color developing agent or a precursor of a color developing agent, wherein the processing element comprises a hot water-soluble layer.

38. The processing element of claim 37, wherein the processing element comprises a layer containing a color developing agent or a precursor of a color developing agent, a layer containing a base or a precursor of a base, and a hot water-soluble layer which is provided between the layer containing a color developing agent or a precursor of a color developing agent and the layer containing a base or a precursor of a base.

39. A photographic processing element comprising a color developing agent or a precursor of a color developing agent, wherein the processing element comprises a heat-sealable water-permeable binder layer.

40. An image forming method comprising superposing a processing element comprising a color developing agent or a precursor of a color developing agent on an exposed silver halide photographic material comprising a support having thereon a silver halide emulsion layer to perform development of the photographic material to form an image, and wherein the processing element comprising a color developing agent or a precursor of a color developing agent is a processing film.

41. The image forming method of claim 40, wherein the method further comprises superposing a processing sheet comprising a base or a precursor of a base on the processing film.

42. An image forming method, comprising superposing a processing element comprising a base or a precursor of a base on a photographic material comprising a support having thereon a silver halide emulsion layer and further superposing a processing element comprising a color developing agent or a precursor of a color developing agent on the processing element comprising a base or a precursor of a base to perform development of the photographic material to form an image, and wherein the processing element comprising a base or a precursor of a base is a processing film, and the processing element comprising a color developing agent or a precursor of a color developing agent being a processing sheet.

43. An image forming method comprising superposing a processing element comprising a color developing agent or a precursor of a color developing agent on an exposed silver halide photographic material comprising a support having thereon a silver halide emulsion layer to perform development of the photographic material to form an image, and wherein the processing element comprises a hot water-soluble layer.

44. The image forming method of claim 43, wherein the processing element comprises a component layer (1) containing a color developing agent or a precursor of a color developing agent and a component layer (2) containing a base or a precursor of a base, and the processing element further comprising a hot water-soluble layer which is provided between the component layer (1) and component layer (2).

* * * * *